US011123788B2

(12) United States Patent
Kasahara et al.

(10) Patent No.: US 11,123,788 B2
(45) Date of Patent: Sep. 21, 2021

(54) BINDING MACHINE

(71) Applicant: MAX CO., LTD., Tokyo (JP)

(72) Inventors: Akira Kasahara, Tokyo (JP); Osamu Itagaki, Tokyo (JP); Ichiro Kusakari, Tokyo (JP); Takeshi Morijiri, Tokyo (JP)

(73) Assignee: MAX CO., LTD., Tokyo (JP)

( * ) Notice: Subject to any disclaimer, the term of this patent is extended or adjusted under 35 U.S.C. 154(b) by 432 days.

(21) Appl. No.: 15/746,042

(22) PCT Filed: Jul. 21, 2016

(86) PCT No.: PCT/JP2016/071430
§ 371 (c)(1),
(2) Date: Jan. 19, 2018

(87) PCT Pub. No.: WO2017/014276
PCT Pub. Date: Jan. 26, 2017

(65) Prior Publication Data

US 2018/0207709 A1 Jul. 26, 2018

(30) Foreign Application Priority Data

Jul. 22, 2015 (JP) ..... JP2015-145261
Jul. 22, 2015 (JP) ..... JP2015-145262
Jul. 8, 2016 (JP) ..... JP2016-135747

(51) Int. Cl.
*B21F 15/04* (2006.01)
*B65B 13/28* (2006.01)
*E04G 21/12* (2006.01)

(52) U.S. Cl.
CPC ..... *B21F 15/04* (2013.01); *B65B 13/28* (2013.01); *E04G 21/123* (2013.01)

(58) Field of Classification Search
CPC .. B21F 15/04; B21F 7/00; B21F 23/00; B65B 13/28; B65B 13/025; B65B 13/285;
(Continued)

(56) References Cited

U.S. PATENT DOCUMENTS 3,387,556 A * 6/1968 Cranston, Jr. ..... B65B 13/06 100/4
4,053,094 A * 10/1977 Males ..... B25C 1/001 227/93

(Continued)

FOREIGN PATENT DOCUMENTS

CN 1129431 A 8/1996
CN 1561271 A 1/2005

(Continued)

OTHER PUBLICATIONS

International Search Report dated Sep. 6, 2016 in PCT/JP2016/071430 (7 pages) and Written Opinion of the International Search Authority (5 pages).

(Continued)

*Primary Examiner* — Gregory D Swiatocha
(74) *Attorney, Agent, or Firm* — Rothwell, Figg, Ernst & Manbeck, P.C.

(57) ABSTRACT

The wire fed or pulled back from the reel by the feeding unit can be properly restricted. The invention relates to a binding machine (2) having a feeding unit (16) for feeding out a wire (3) from a reel (12) provided in a housing unit (11). With respect to the entering route (81) of the wire (3) when the wire (3) drawn out from the reel (12) by the feeding unit (16) is guided to the feeding unit (83), the first restriction unit (83) that restricts the drawing portion (3*a*) of the wire (3) disposed between the reel (12) and the feeding unit (16) from being deviating from the entering route (81) is provided inside the housing unit (11).

15 Claims, 41 Drawing Sheets

(58) Field of Classification Search
CPC ..... B65B 13/04; B65B 13/06; B65B 13/184; B65B 13/185; B65B 27/10; E04G 21/123; B25B 25/00
See application file for complete search history.

(56) References Cited

U.S. PATENT DOCUMENTS

| | | | | |
|---|---|---|---|---|
| 5,279,336 | A | 1/1994 | Kusakari et al. | |
| 5,682,927 | A | 11/1997 | Takahashi et al. | |
| 5,947,166 | A * | 9/1999 | Doyle | E04G 21/123 140/119 |
| 5,983,473 | A * | 11/1999 | Yuguchi | E04G 21/122 29/33 F |
| 6,401,766 | B1 * | 6/2002 | Ishikawa | B65B 13/285 140/119 |
| D481,602 | S | 11/2003 | Hattori | |
| 2005/0005991 | A1 | 1/2005 | Ishikawa et al. | |
| 2005/0061389 | A1 * | 3/2005 | Nakagawa | E04G 21/122 140/119 |
| 2005/0077413 | A1 | 4/2005 | Nakagawa et al. | |
| 2006/0011254 | A1 | 1/2006 | Yokochi et al. | |
| 2006/0157139 | A1 * | 7/2006 | Hoyaukin | E04G 21/122 140/119 |
| 2006/0283516 | A1 * | 12/2006 | Nagaoka | E04G 21/122 140/119 |
| 2007/0227613 | A1 | 10/2007 | Matsuoka et al. | |
| 2009/0126824 | A1 | 5/2009 | Nakagawa et al. | |
| 2009/0160373 | A1 * | 6/2009 | Katou | E04G 21/123 318/286 |
| 2009/0283167 | A1 | 11/2009 | Nakagawa et al. | |
| 2014/0091171 | A1 | 4/2014 | Nakagawa et al. | |
| 2017/0130472 | A1 | 5/2017 | Nakagawa et al. | |

FOREIGN PATENT DOCUMENTS

| | | | |
|---|---|---|---|
| CN | 1688481 | A | 10/2005 |
| CN | 1969101 | A | 5/2007 |
| CN | 202464177 | U | 10/2012 |
| EP | 0731238 | A1 | 9/1996 |
| EP | 1 439 015 | A1 | 7/2004 |
| JP | 5-6015 | U | 1/1993 |
| JP | 6-25454 | U | 4/1994 |
| JP | 9-250205 | A | 9/1997 |
| JP | H11-156747 | A | 6/1999 |
| JP | 2006-2500 | A | 1/2006 |
| JP | 4016784 | B2 | 12/2007 |
| JP | 2010-001727 | A | 1/2010 |
| JP | 4747454 | B2 | 8/2011 |

OTHER PUBLICATIONS

European Search Report issued in Application No. 16827836.4, dated Apr. 5, 2019 (8 pages).
Chinese Office Action issued in Application No. 201680043004.5, dated Aug. 1, 2019 with English Translation, 13 pages.
JP Office Action for Application No. 2019-143463 dated Nov. 18, 2020 (4 pages).
The Extended European Search Report mailed in corresponding EP Patent Application No. 2058558.5 dated May 14, 2020 (7 pages).
Chinese Office Action for Chinese Application No. 202010406126.4 dated Jun. 11, 2021. (6 pp.).

* cited by examiner

131

B–B (COMPARATIVE EXAMPLE)

(COMPARATIVE EXAMPLE)

(COMPARATIVE EXAMPLE)

(COMPARATIVE EXAMPLE)

N-N

BINDING MACHINE

CROSS REFERENCE TO RELATED APPLICATIONS

This application is a 35 U.S.C. 371 National Phase Entry Application from PCT/JP2016/071430, filed Jul. 21, 2016, which claims priority to Japanese Patent Application Nos. 2015-145261 and 2015-145262, both filed Jul. 22, 2015, and 2016-135747, filed Jul. 8, 2016, the disclosures of which are incorporated herein in their entirety by reference.

TECHNICAL FIELD

The present invention relates to a binding machine for binding and fixing an object such as an intersecting reinforcing bar or an electric wire. More specifically, the present invention relates to a binding machine having a function of coping with problems caused by the feeding and pullback of a wire (for binding).

BACKGROUND ART

For example, a binding machine such as a reinforcing bar binding machine and the like is being used for binding an object such as a reinforcing bar at a construction site (for example, see Patent Literature 1). This binding machine includes a feeding unit for feeding (drawing out feeding) wire wound around a reel, a curve forming unit for curling the wire fed out from the feeding unit to make a loop, and a twisting unit for twisting to squeeze the loop formed by the curve forming unit to perform binding.

According to this configuration, the wire wound around the reel is fed out from the feeding unit while the wire is curled at the curve forming unit (or a bending deformation of an arc forms is performed), thereby a loop is formed and by twisting and squeezing the loop at a twisting unit, it is possible to bind an object such as a reinforcing bar.

Further, in the binding machine, by pulling back the wire fed out during the binding to match and shorten the loop to the size of the object, the amount of wire used in one binding is reduced, and binding is performed so that the possible number of binding times per reel is increased. Such feeding or pullback of the wire is performed by the feeding unit.

In addition, in such a binding machine, a housing unit (reel housing unit) that enables the reel on which a wire is wound to be detachably mounted is provided.

Further, a conventional binding machine feeds out the wire wound and mounted on the reel to apply a curling tendency with a curl arm, and after wrapping around a body to be bound, such as a reinforcing bar which is the object to be bound, the wire was twisted to bind the body to be bound (for example, see Patent Literature 1). FIGS. 38A, 38B and 38C are explanatory views illustrating the relationship between a curl arm 121 and a wire reel 122 in such a conventional binding machine 120. The binding machine 120 is a binding machine which uses a single wire (one wire), instead of multiple wires as illustrated in the following embodiments described. FIG. 38A is an explanatory view illustrating a state in which the relationship of a curl arm 121 and wire reel 122 is seen from a side. FIGS. 38B and 38C are explanatory views illustrating a state in which the relationship of the curl arm 121 and wire reel 122 illustrated in FIG. 38A is seen from the front side.

CITATION LIST

Patent Literature

[Patent Literature 1]: Japanese Patent Publication No. 4016784

SUMMARY

Technical Problem

The above binding machine had the following problems.

That is, in the case where the wire is forced to be pulled back at the feeding unit, looseness of the wire occurs between the feeding unit and the reel inside the housing unit unless a means for eliminating the looseness of the wire is provided. Further, when a curve is formed on the wire loosened inside the housing unit and the curve of the wire becomes greater than or equal to a predetermined curvature, the deformation resistance of the wire is lowered, so the wire buckles easily due to the force of the feeding unit forcing the wire to pull back. If the wire buckles at the reel side of the feeding unit in this way, problems of, for example, not being able to send the wire at the next binding or the bent or buckled wire protruding from the housing unit (the part entered between a case and a cover) or the like occurs.

There are cases where a plurality of small-diameter flexible wires are used at once in the binding machine in order for the wire to be in close contact with a reinforcing bar and objects of the like, but in such cases where small-diameter wires are used and the like, the problem of buckling due to the looseness of the wire grows bigger.

Therefore, the present invention is directed to solving the above-mentioned problems.

Further, in the binding machine 120 as disclosed in Patent Literature 1, for example, as illustrated in FIG. 38B, a virtual plane (an imaginary plane) extending in the front direction passing through the center (line Y1-Y1') of the curl arm 121 may be disposed so that it is almost identical to a virtual cross section (an imaginary cross section) extending in the front direction passing through the center (line Y2-Y2') of a winding portion of a wire reel 122. In the binding machine 120, the direction of the front end Ws of the wire W that was fed out from the wire reel 122 and passed through the curl arm 121 has the tendency to scatter to the left and right (the direction along the axial center direction Z-Z' of the wire reel 122) according to the position of drawing out the wire W being fed out from the wire reel 122, For example, as illustrated in FIG. 38B, in the case where the position of drawing out the wire W being fed out from the wire reel 122 is in a position biased more in the Z direction than the winding center O of the wire reel 122, the direction of the front end Ws of the wire W that passed through the curl arm 121 is positioned to be biased to the Z' direction. Further, as illustrated in FIG. 38C, in the case where the position of drawing out wire W being fed out from the wire reel 122 is in a position biased more in the Z' direction than the winding center O of the wire reel 122, the direction of the front end Ws of the wire W that passed through the curl arm 121 is positioned to be biased to the Z direction.

In this manner, in the case where the vertical plane of the center of the curl arm 121 and the central plane (virtual cross section of when cut in a direction substantially orthogonal to the axial center of a hub) of the winding portion of the wire reel 122 to have a layout almost identical to that of the binding machine 120, an arc shaped winding curl was made so there was a tendency that the direction in which the distal end Ws of the wire W fed from the curl arm 121 was unstable and scattered greatly. The wire W passing through the curl arm to be curved into an arc shape is made so as to be picked by a curl guide, which is a wire pickup unit of a wire installed below the curl arm 121, not illustrated in FIGS. 38A, 38B, and 38C. Therefore, it was necessary to keep the width of the curl guide to be wide so that the front end of the wire W which is scattered in various directions is reliably picked up. As a result, the size of the binding machine increased and the handling of the binding machine deteriorated, so there was the problem of decreasing the workability.

The present invention has been made in view of the above-mentioned problems, and is directed to provide a binding machine with high workability configured to have a curl guide with a small width, by preventing the wire that passes through the curl arm from scattering greatly when arriving at the curl guide.

Solution to Problem

In order to solve the above-mentioned problems, the present invention provides a binding machine which includes: a feeding unit that feeds a wire from a reel provided with a housing unit, characterized in that, with respect to an entering route of the wire when the wire fed from the reel by the feeding unit is guided to the feeding unit, a first restriction unit is provided inside the housing unit to restrict a drawn out portion of the wire from deviating from the entering route, the drawn out portion being between the reel and the feeding unit. The present invention also provides a binding machine which includes: a feeding unit that feeds a wire from a reel provided with a housing unit, and that pulls back the fed wire to a reel side, characterized in that, a second restriction unit is provided inside the housing unit to restrict the wire pulled back to the reel side by the feeding unit from deviating from a line extending in a pullback direction of the wire by the feeding unit.

Further, in order to solve the above-mentioned problems, the present invention provides a binding machine which includes: a wire feeding unit that is capable of feeding a wire from a wire reel which has a tubular hub to wind a wire and which is rotatably supported on a main body of the binding machine; and a curl arm that plastically deforms the wire fed out from the wire feeding unit to form a circle locus, wherein the binding machine twists the wire to bind a binding object after winding the wire which is plastically deformed by the curl arm, around the binding object, characterized in that a virtual plane is provided at a position offset with respect to a virtual cross section, the virtual plane is formed by the circle of the plastically deformed wire inside the curl arm and the virtual cross section is formed by cutting through a center point of the hub in a direction substantially orthogonal to an axial center of the hub.

Further, the binding machine according to the present invention is characterized in that the virtual plane is provided substantially the same as a virtual cross section formed by cutting through an axial end portion of the hub in the direction substantially orthogonal to the axial center of the hub.

Further, the binding machine according to the present invention is characterized in that the wire is a set of a plurality of wires and is fed out substantially concurrently.

Advantageous Effects of the Invention

According to the present invention, with the above configuration, it is possible to restrict a wire that is fed or pulled back from a reel by a feeding unit.

Further, according to the binding machine of the present invention, an imaginary plane (hereinafter referred to as "virtual plane") connecting an arc formed by a wire formed inside a curl arm with the center of the arc is arranged at an offset position with respect to a cross section (hereinafter referred to as "virtual cross section") of a hub which winds and mounts the wire that passes through the center in the longitudinal direction and is also cut in a direction substantially orthogonal to the axial center of the hub. According to such configuration, the present invention makes it possible to prevent the front end of the wire fed out from the curl arm from being greatly scattered when reaching the curl guide, and it is unnecessary to enlarge the guiding portion of the curl guide that includes the distal end portion of the wire, thereby the present invention has the effect of promoting downsizing of the machine.

DETAILED DESCRIPTION

Hereinafter, the present embodiment will be described in detail with reference to the drawings.

FIGS. 1 to 25 are for explaining this embodiment.

Example 1

<Configuration>

Hereinafter, the configuration of this example will be described.

Figure 1:
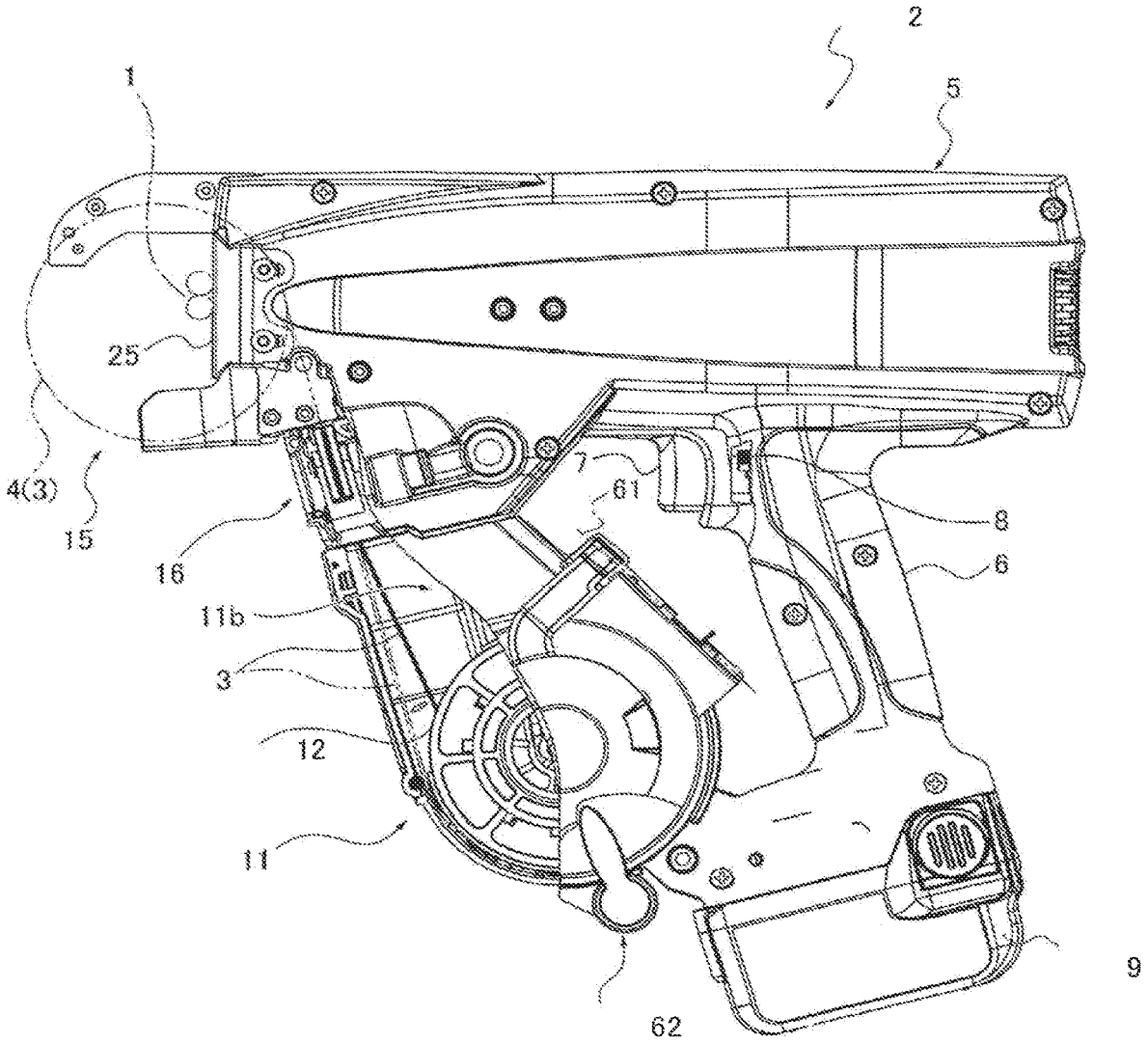
FIG. 1 is an overall side view of a binding machine according to an embodiment, a part of which is broken.
Figure 2:
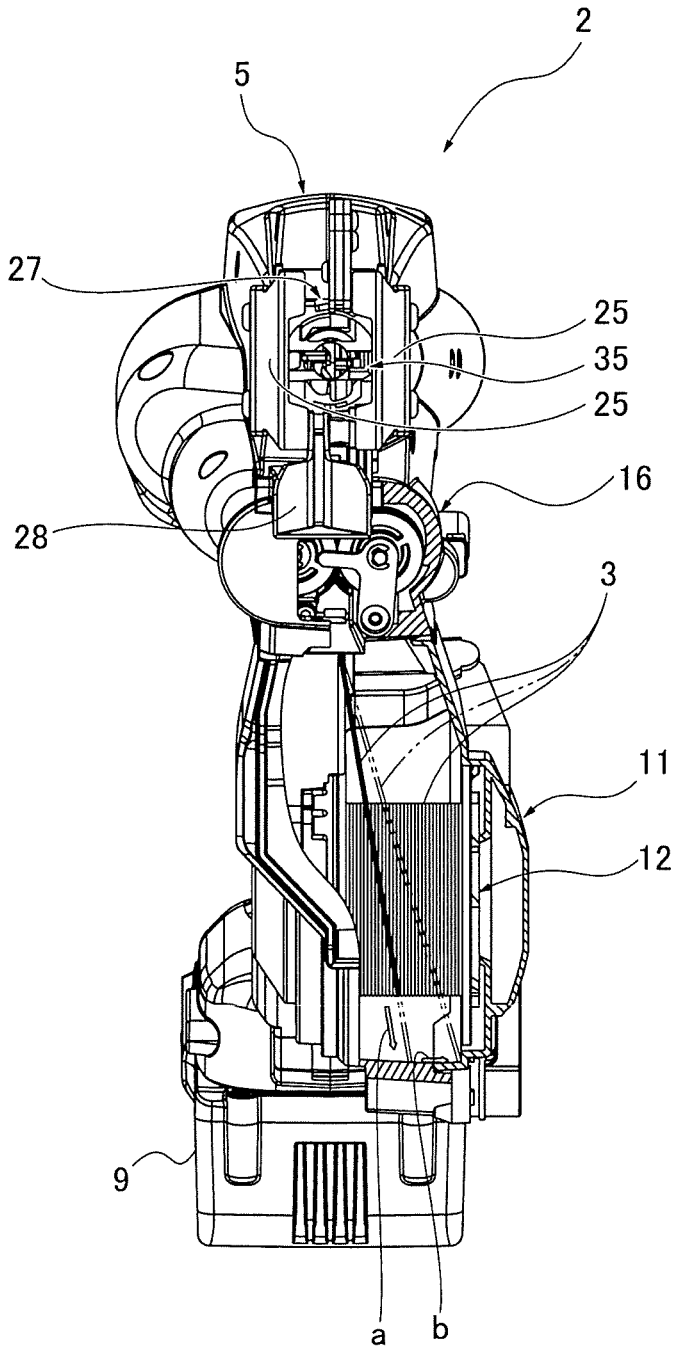
FIG. 2 is a front view of the binding machine of FIG. 1 (a view seen from the left side of FIG. 1).

For example, as illustrated in the side view of FIG. 1 and the front view of FIG. 2, a binding machine 2 such as a reinforcing bar binding machine is used to bind an (binding) object 1 such as a reinforcing bar or wire at a construction site. This binding machine 2 makes it possible to bind the object 1 by curling a wire 3 (or imparting an arc-like bending property) and feeding to form a ring 4 surrounding the periphery of the object 1, and tightening the ring 4.

Hereinafter, the binding machine 2 will be described.

The above-mentioned binding machine 2 has a binding machine main body 5 and a grip 6.

Further, in the following description, with respect to direction, it is based on the state illustrated in FIG. 1 (the state where the binding machine 2 is raised). Also, the longitudinal direction (a direction corresponding to the left-right direction in FIG. 1) of the binding machine main body 5 is set as a front-rear direction, and a predetermined direction out of the directions orthogonal to the longitudinal direction of the binding machine main body 5 (a direction corresponding to the upper-lower direction in FIG. 1) is set as an upper-lower direction (or height direction), and the direction orthogonal to the front-rear direction and the upper-lower direction is the left-right direction (or the width direction). Further, an end side of the longitudinal direction of the binding machine main body 5 is referred to as the front side or the distal end side, the other side in the longitudinal direction of the binding machine main body 5 (the side opposite to the object 1, that is, the right side of FIG. 1) is referred to as the rear side or the rear end side. Further, the upper side of FIG. 1 is referred to as the upper side with respect to the binding machine main body 5 and the lower side of FIG. 1 (a direction in which the grip 6 extends) is set as the lower side with respect to the binding machine main body 5. Further, the inner side of the sheet surface (the left side of FIG. 2) is set as the right side of the binding machine main body 5, and the front side of the sheet surface (the right side of FIG. 2) of FIG. 1 is set as the left side of the binding machine main body 5.

A grip 6 is provided so as to extend from substantially the middle portion in the longitudinal direction of the binding machine main body 5 toward substantially a downward direction. The grip 6 is provided with a trigger 7 and a lock switch 8, and at the same time, is capable of attaching/detaching a battery pack 9 to a lower portion thereof. In addition, when the lock switch 8 is released and the trigger 7 is pulled in the state where the power switch is on, the binding machine 2 is operated and the binding operation is performed.

Further, in the front side of the grip 6, a housing unit 11 for setting the (binding) wire 3 used for binding an object 1 such as a reinforcing bar is provided. In this case, the wire 3 made to be used is the kind wound in a coiled manner with respect to the reel 12. The reel 12 is capable of drawing one or more wires 3 simultaneously. The reel 12 wound with the wire 3 is set to be detachable with respect to the housing unit 11. In this case, the attaching/detaching direction of the reel 12 with respect to the housing unit 11 is the axial direction of the reel 12.

Figure 3:
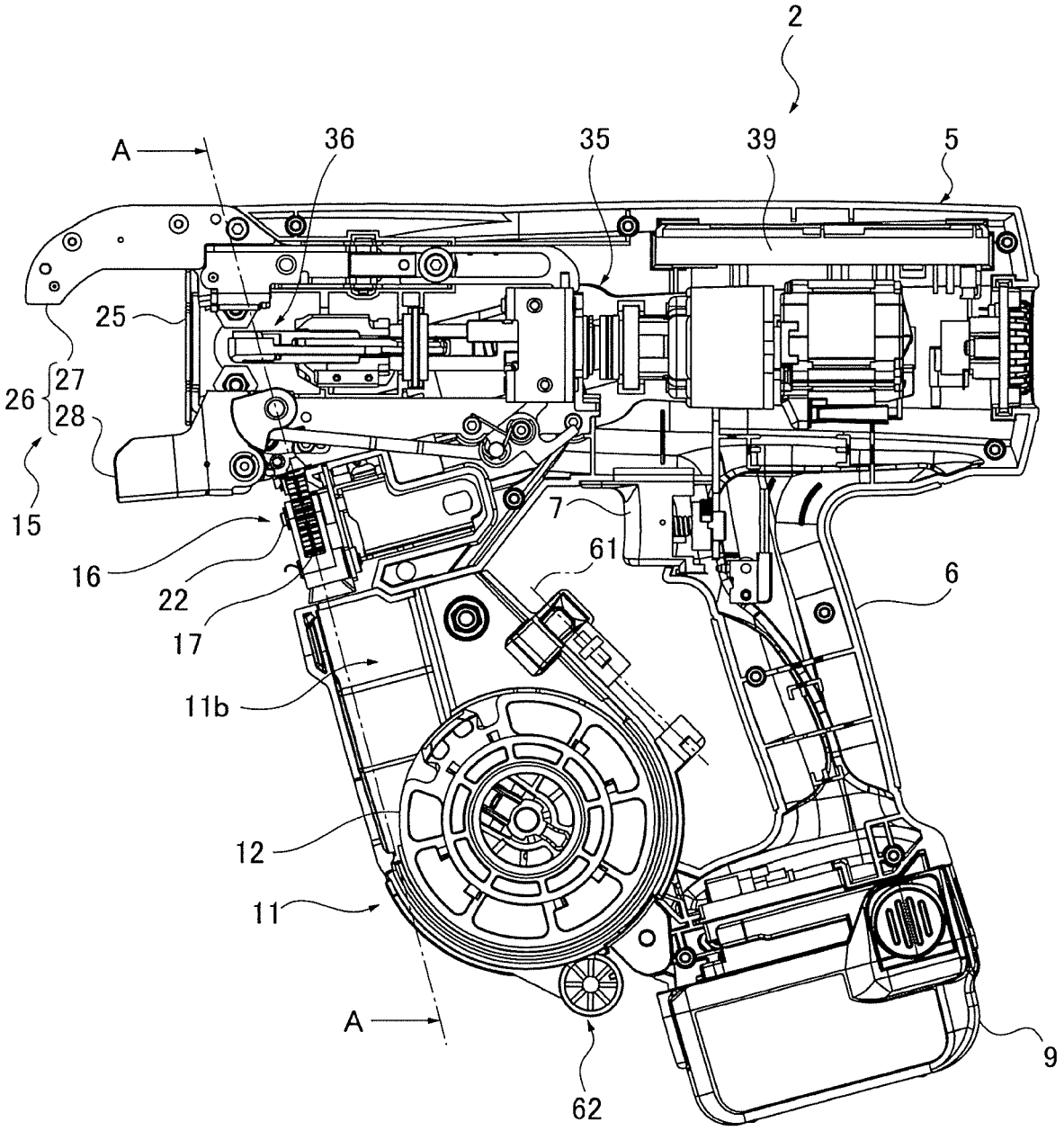
FIG. 3 is an internal structural view of the binding machine of FIG. 1.

Further, as illustrated in the internal structure view of FIG. 3, the binding machine main body 5 is provided with a feeding unit (feeding unit) 16 for feeding the wire 3 wound on the reel 12 toward the binding unit 15 provided at the distal end side of the binding machine body 5 (the wire 3 is omitted in FIG. 3). In this case, the feeding unit 16 is provided at the lower portion of the distal end side of the binding machine main body 5. Further, the housing unit 11 is provided at a lower portion of the feeding unit 16. The housing unit 11 is mounted between the distal end of the binding machine main body 5 and the lower end of the grip 6 in an erected state.

As described above, by providing the feeding unit 16 and the housing unit 11 at the lower portion of the front side of the binding machine main body 5 (for example, as compared with the case where the housing unit 11 is provided at the rear end side of the binding machine main body 5), the weight balance of the binding machine 2 is improved, the binding machine 2 is made easy to handle, and at the same time, the path of the wire 3 becomes more curved, so that a ring 4 of the wire 3 can be made easily.

Figure 4:
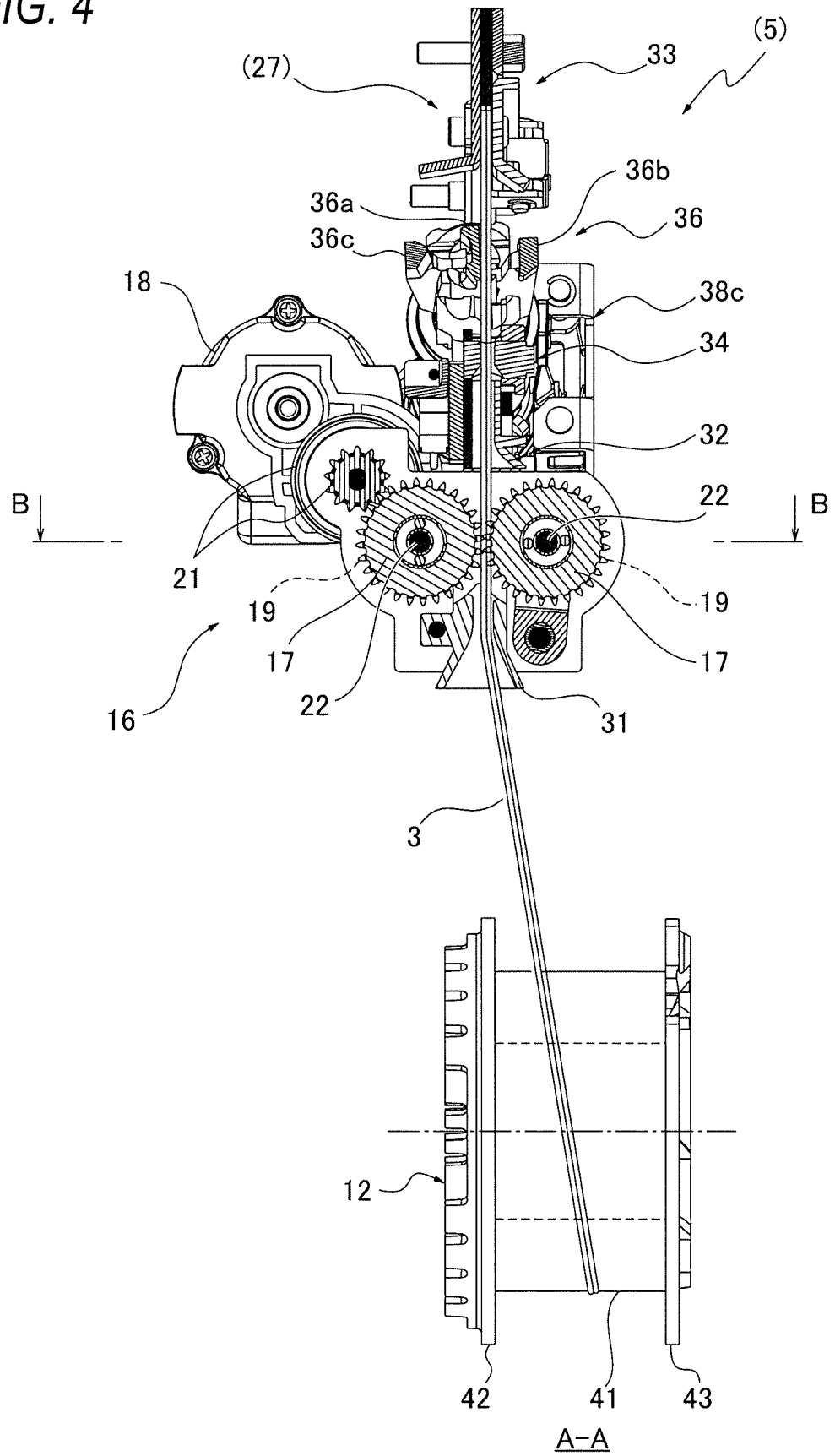
FIG. 4 is a front view illustrating the periphery of the feeding unit of FIG. 3 (a cross sectional view along line A-A of FIG. 3).
Figure 5:
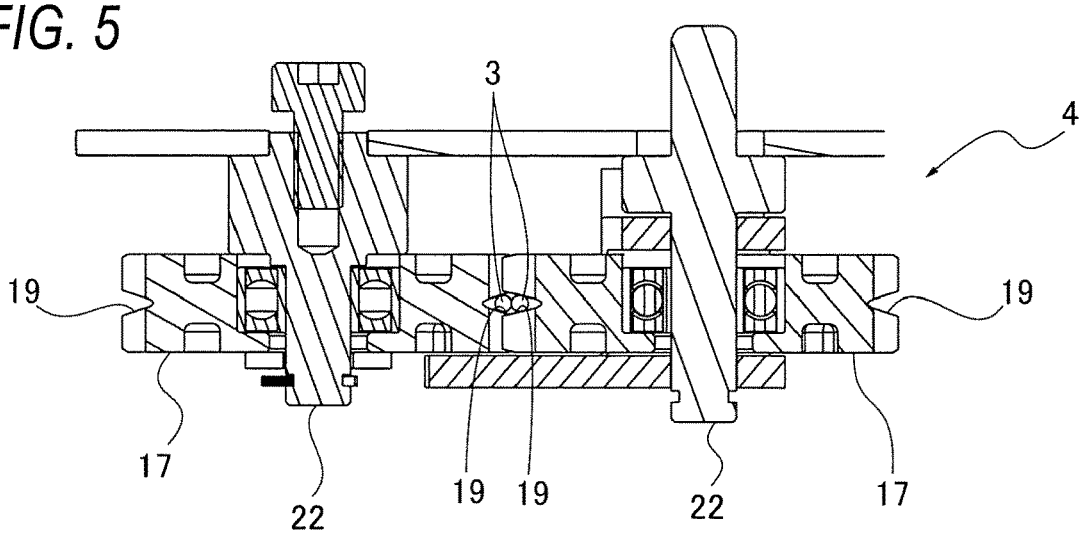
FIG. 5 is a cross sectional view illustrating the feeding unit of FIG. 4 as viewed from the top (a cross sectional view taken along line B-B of FIG. 4).
Figure 6:
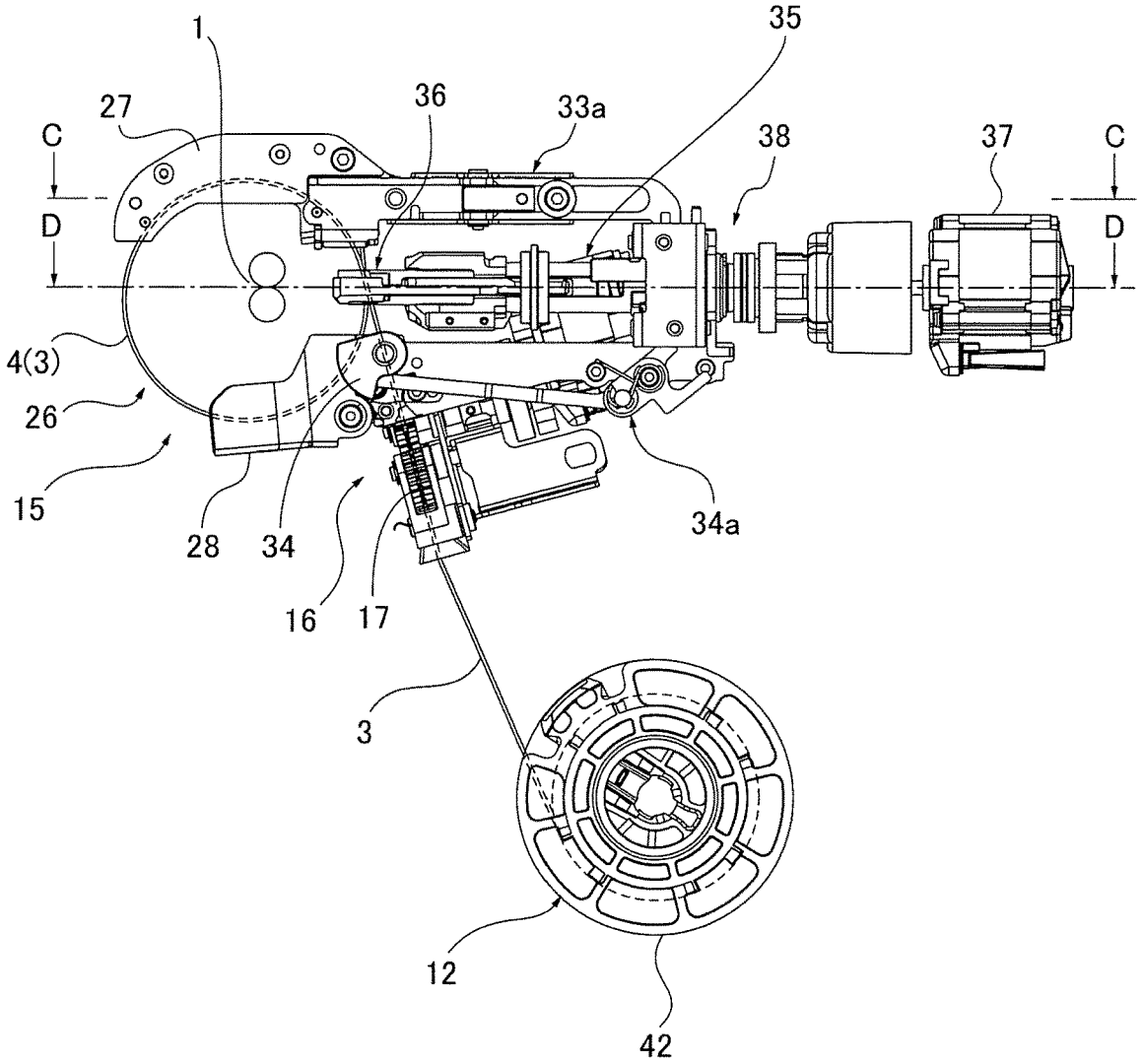
FIG. 6 is a side view of FIG. 3 illustrating the twisting unit and its periphery.
Figure 7:
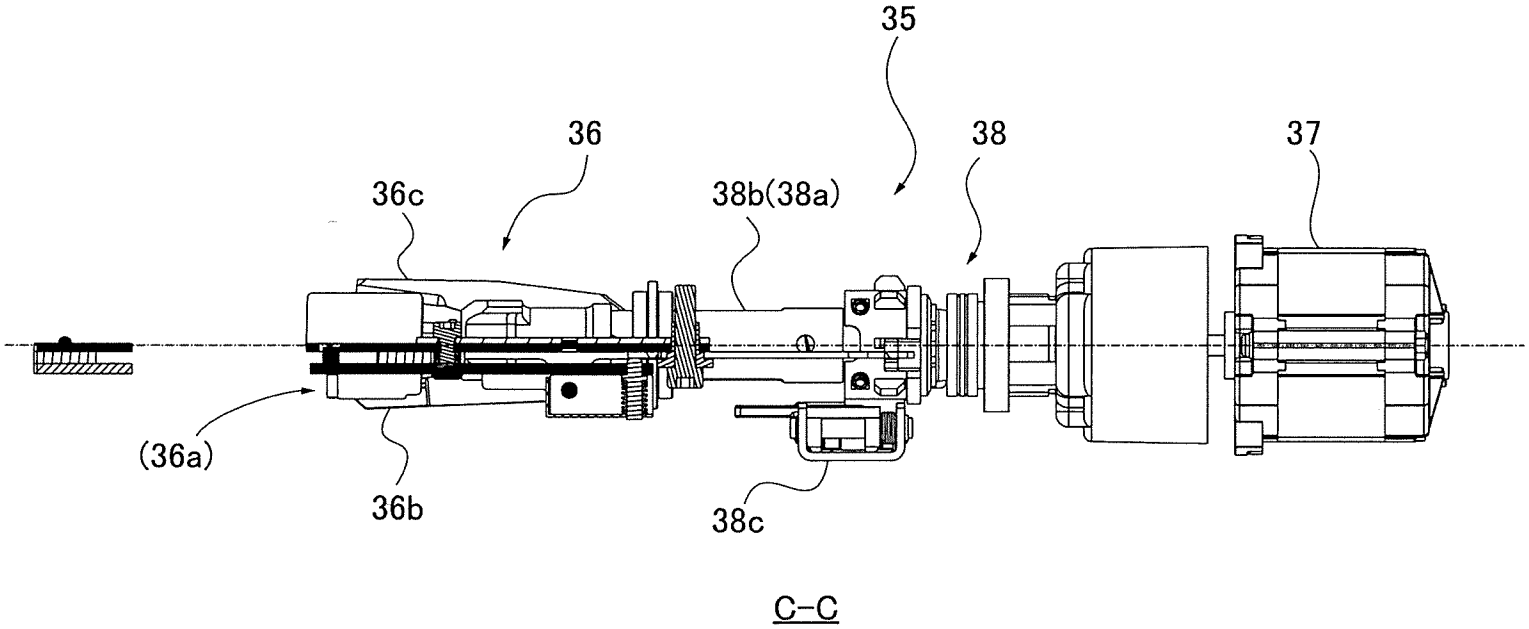
FIG. 7 is a cross sectional view illustrating the twisting unit of FIG. 6 as viewed from the top (a cross sectional view taken along line C-C of FIG. 6).

As illustrated in the views of FIGS. 4 and 5, the feeding unit 16 includes at least a feed gear 17 for feeding the wire 3 and a feed motor 18 for rotationally driving the feed gear 17. The feed gear 17 is provided in a pair, for example, in such a manner that the wires 3 are interposed between the right and left sides. In the pair of left and right feed gears 17, one side is set as a drive wheel, and the other side is set as a driven wheel. The feed gear 17 which was set as a driven wheel may be a tension roller or the like capable of being pushed away from the feed gear 17 set as a drive wheel at a close distance with a desired urging force.

A V-shaped notched portion 19 for receiving and frictionally driving the wire 3 is provided at the center portion in the thickness direction of the outer periphery of the feed gear 17, and an engaging groove portion extending in the circumferential direction is formed. Further, an intermediate gear 21 or the like may be provided between the feed gear 17 and an output gear mounted on the output shaft of the feed motor 18, as appropriate.

Also, by forwardly rotating the feed gear 17 by the feed motor 18, the wire 3 can be moved substantially upward and fed to the binding unit 15. In addition, the feed motor 18 reverses the feed gear 17, thereby the wire 3 that was fed out can be moved substantially downward and pulled back to the housing unit 11 from the binding unit 15. In this case, as illustrated in FIG. 3, a rotary shaft 22 of the feed gear 17 is inclined in a forward inclined state with respect to a horizontal direction, and the wire 3 is fed toward the substantially forward inclined direction.

Incidentally, the fed amount of the wire 3 is, for example, about 250 mm, and the pullback amount of the wire 3 is, for example, about 75 mm to 115 mm (about ½ to ⅓ of the fed amount). However, these amounts vary depending on the diameter of the reinforcing bars and the number of reinforcing bars to be the object 1.

Further, the binding unit 15 is provided with an abutting portion 25 that can be brought into contact with the object 1. In addition, the binding unit 15 is provided with a curve forming unit 26 for making the wire 3 fed by the feeding unit 16 into a ring 4. The curve forming unit 26 is configured to have a curl arm 27 and a curl guide 28 which are provided in pairs with the contact portion 25 therebetween (vertically).

The curl arm 27 has a curl groove portion for curling the wire 3 (or for imparting an arc shaped curvature property to the wire 3) on its inner peripheral side. The curl guide 28 has a receiving groove for receiving the wire 3 curled by the curl arm 27 on its inner peripheral side. In addition, the wire 3 is made to pass through the curl arm 27 and the curl guide 28 in the counterclockwise direction in the drawings, thereby forming a ring 4. In addition, what is between the curl arm 27 and the curl guide 28 (gap) serves as a passing portion for passing the object 1 toward the abutment portion 25.

Further, as illustrated in FIG. 4, the binding machine main body 5 is provided with wire guides 31 to 33 for guiding or restricting the position of the wire 3 at the entering side and exiting side of the feeding unit 16, and at least a base portion of the curl arm 27, respectively. Among them, the wire guide 31 disposed on the entering side of the feeding unit 16 is for guiding the wire 3 from the reel 12 to the feeding unit 16. The wire guide 32 disposed on the exiting side of the feeding unit 16 is for guiding the wire 3 from the feeding unit 16 to a cutting unit 34. The cutting portion 34 is provided for cutting the portion of the wire 3 that has become the ring 4 from other portions, and is configured to have a fixed blade and a movable blade. Further, it is possible for at least the wire guide 33 arranged at the base portion of the curl arm 27 to have a property in which it curls the wire 3 in a loop shape.

Figure 8:
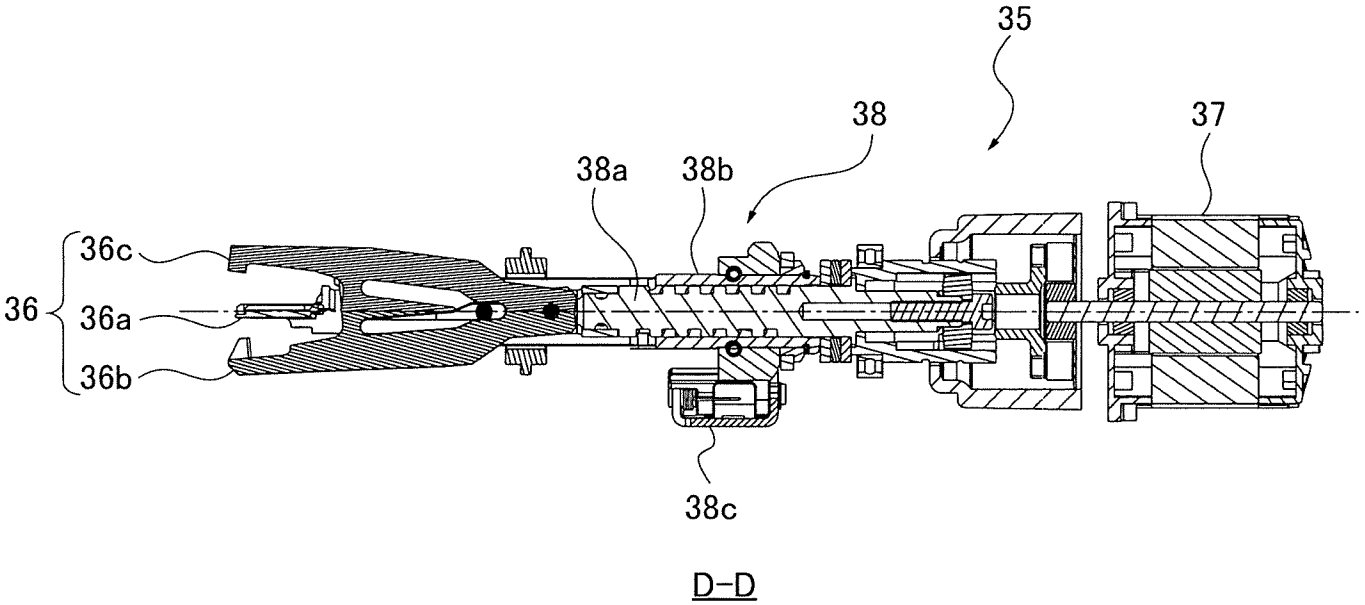
FIG. 8 is another cross sectional view illustrating the twisting unit of FIG. 6 as viewed from the top (cross sectional view taken along line D-D of FIG. 6).

In addition, the abutting portion 25 (See FIGS. 1 and 2) of the distal end side of the binding machine main body 5 is located on both sides of the ring 4 of the wire 3 in an axial direction and is provided in a pair, left and right at a predetermined interval. Inside the binding machine main body 5, at a position between the right and left abutting portions 25, a twisting unit 35 which enables the wire 3 to be tightened in respect to an object 1 by twisting and tightening a wire 3 made into a ring 4 as illustrated in the side view of FIG. 6, the plan view of FIG. 7 and the cross-sectional plan view of FIG. 8 is provided. The twisting unit 35 is provided with a holding portion 36 for fitting, releasing, or holding the wire 3, a twisting motor 37 for rotating the holding portion 36 by a predetermined number of times, and an operating mechanism 38 for opening operations, or twisting or retracting operations of the holding portion 36 in respect to the wire 3.

As illustrated in FIG. 8, the holding portion 36 is provided with a center hook 36*a* and a pair of left and right hooks 36*b* and 36*c* and it is made possible to be configured to have a left and right wire passing portion for passing each of the overlapped portions of the wire 3 made into a ring 4. Further, the operating mechanism 38 for opening and closing the holding portion 36 mainly includes a screw shaft 38*a*, a sleeve 38*b* screwed and coupled to the outer circumferential side of the screw shaft 38*a*, and a screw mechanism having a rotation restriction portion 38*c* for applying a rotation regulation to the sleeve 38*b* or releasing the rotation regulation.

The operating mechanism 38 is interposed between the holding portion 36 and the twisting motor 37. The operating mechanism 38 performs opening and closing operations, or twisting operation and such of the holding portion 36 by utilizing the relative displacement of the sleeve 38*b* in the longitudinal direction with respect to the screw shaft 38*a* due to the rotation of the screw shaft 38*a*. Further, the operating mechanism 38 can be operated by interlocking with the cutting unit 34 or the wire guide 33 of the base portion of the curl arm 27, and the like using interlocking mechanisms 34*a* and 33*a* (see FIG. 6).

In addition, when the wire 3 is twisted, the operating mechanism 38 closes the holding portion 36 (the left and right hooks 36*b* and 36*c* thereof) to hold an overlapped portion of the wire 3 made into a ring 4, and then twists it. After the ring 4 of the wire 3 is completely twisted, the operating mechanism 38 waits with the holding portion 36 (left and right hooks 36*b* and 36*c*) in an open state.

The feeding unit 16, the twisting unit 35, and the like are controlled by a control device 39 (see FIG. 3) installed inside the binding machine main body 5.

Also, as illustrated in FIG. 4, the reel 12 is provided with a tubular hub portion 41 which functions as a winding center for the wire 3 and a pair of flange portions 42 and 43 integrally provided at both axial end portions (or periphery) of the hub portion 41. The flange portions 42 and 43 are formed in a substantially disc shape having a larger diameter than the hub portion 41 and are provided concentrically with the hub portion 41. It is preferable for the pair of flange portions 42 and 43 to have the same diameter, or the flange portion 42 positioned on the inner side (left side in the drawing) of the housing unit 11 based on the attaching and detaching direction of the reel 12 with respect to the housing unit 11 may have a smaller diameter than that of the flange portion 43 located on the front side (right side of the drawing). A reinforcement rib, a thickness reduction portion, and the like can be appropriately formed on the flange portions 42 and 43 (see FIG. 6 and etc.). Further, the reel 12 is preferably formed of a resin having excellent resistance to wear and bending such as ABS resin, polyethylene, and polypropylene.

Further, the reel 12 is not driven to rotate specifically inside the housing unit 11 but is made to be rotated (driven) in accordance with the drawing of the wire 3 or the like. To this end, a rotating shaft portion (or a rotation guide portion) for supporting the rotation of the reel 12 is provided between the reel 12 and the housing unit 11.

Figure 9:
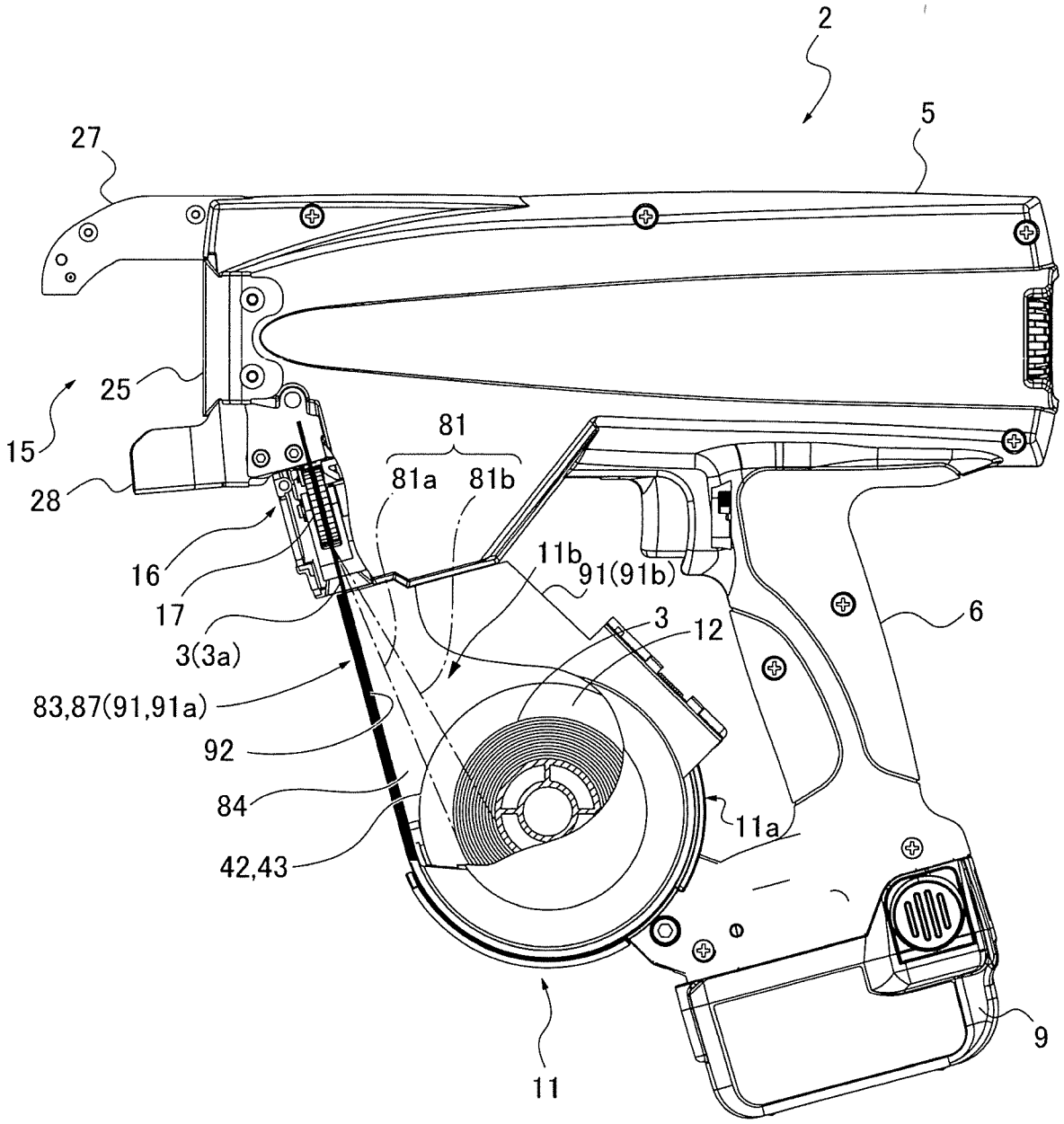
FIG. 9 is an overall side view of a binding machine having a first restriction unit (protective case), a part of which is broken.
Figure 10:
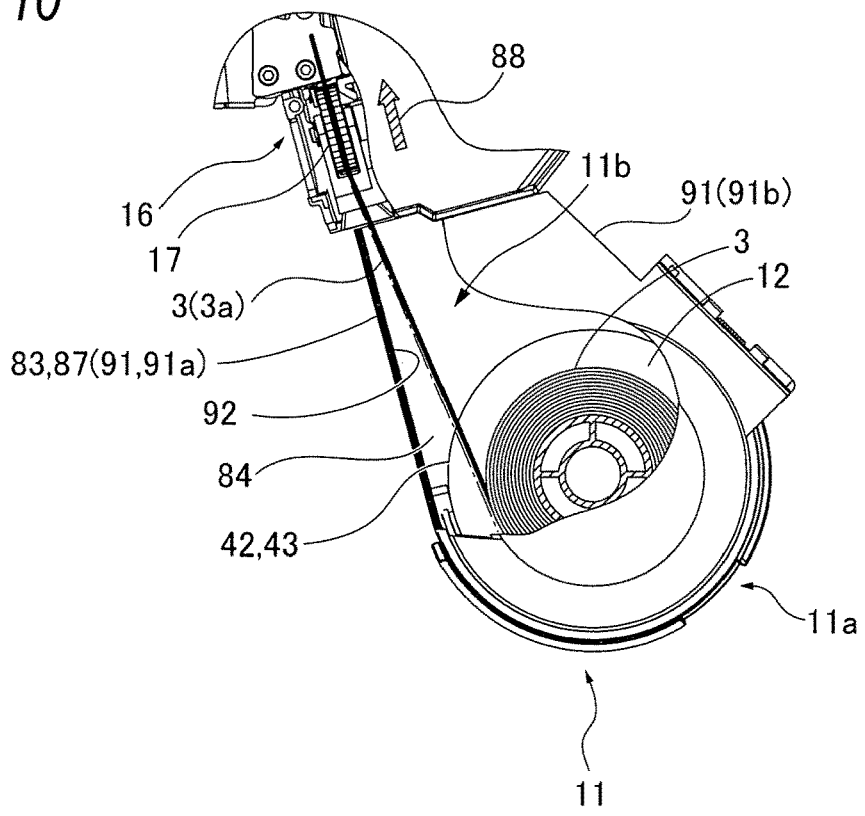
FIG. 10 is a partially enlarged view of the periphery of a housing unit of FIG. 9 illustrating the state of when a wire is fed out.

In this case, as illustrated in FIG. 9, the wire 3 is pulled substantially upward by the rotation of the reel 12 in a clockwise direction from a position of the front portion of the lower side of the reel 12. Further, the reel 12 is arranged in an offset state at one side of the left and right direction (for example, at the left side of the binding machine main body 5 or the left side of the feeding unit 16 (see right side of FIGS. 2 and 4) so as to be handled by a right-handed person and the like). In particular, the reel 12 is made to be completely offset in the lateral direction with respect to the curl arm 27.

In addition, the housing unit 11 includes a reel housing unit 11*a* configured as a substantially cylindrical recessed portion capable of accommodating the reel 12, a wire path 11*b* configured as a path of a wire 3 for guiding the wire 3 which was drawn from the reel 12 to the feeding unit 16 (the wire guide 31 of the entrance side thereof). The wire passage 11*b* is integrally connected to the reel housing unit 11*a* and becomes a space (free space) through which the wire 3 freely passes therein. In this case, the wire passage 11*b* has a side surface shape that is narrow on the top (or wider on the bottom) and is gradually reduced from the reel housing unit 11*a* toward the feeding unit 16, and the like.

Figure 16:
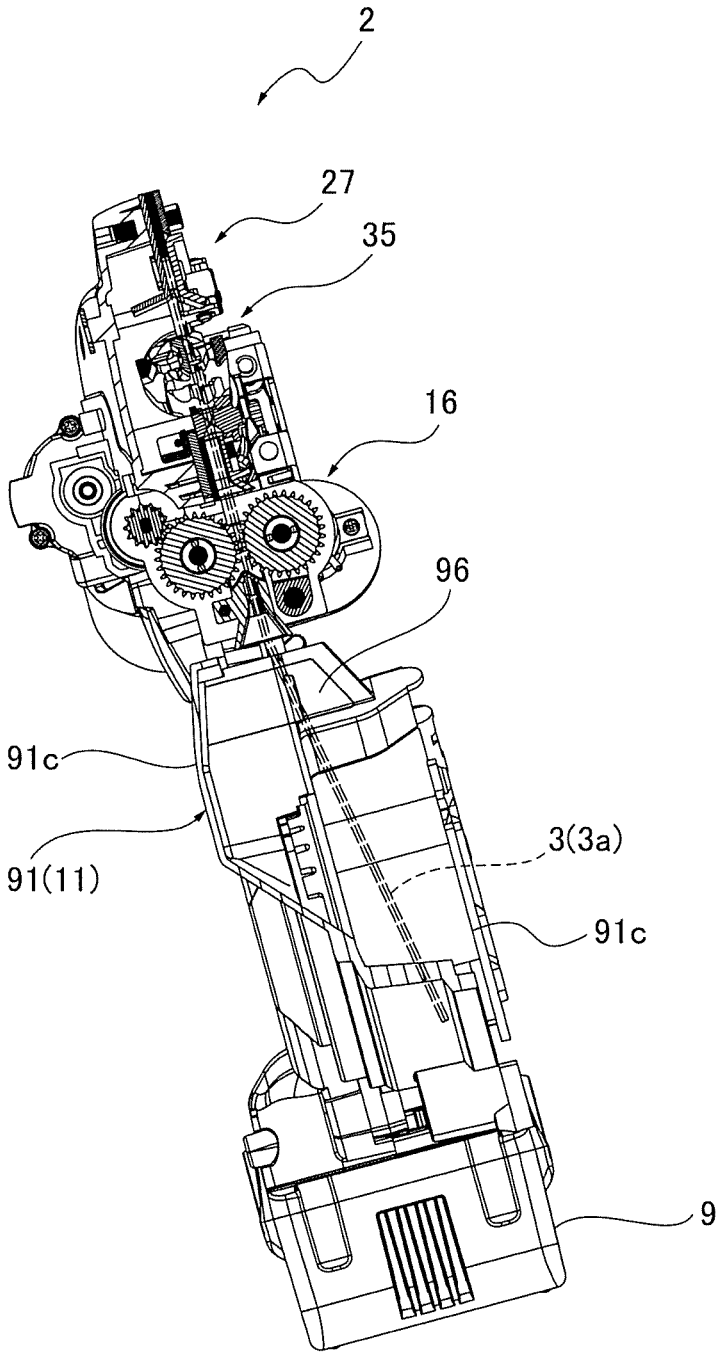
FIG. 16 is a front view of the binding machine of FIG. 15.

The housing unit 11 is configured with members such as a protective case 91 having a front wall 91*a*, a rear wall 91*b*, and a side wall 91*c* (see FIG. 16). Further, the protective case 91 is made of a resin formed integrally with the binding machine main body 5. It is preferable that the protective case 91 is made of a resin such as ABS resin, polyethylene, polypropylene or the like, which has good resistance to abrasion and bending, like the reel 12.

The protective case 91 is configured with, for example, a case main body, a cover for opening and closing an opening formed on aside surface of the case main body, and the like. The case body is called a magazine or the like, and the cover is called a magazine cover. As illustrated in FIG. 1, a hinge portion 61 is provided between the case body and the cover, and a lock device 62 for closing the opening of the case body by the cover is provided on the case body.

Further, with respect to the above-described binding machine, the following configuration are provided in this embodiment.

(1) As illustrated in FIG. 9 (to FIG. 11), relating to a line entrance path of the wire 3 when the wire 3 fed out from the reel 12 by the feeding unit 16 is guided (linearly) to the feeding unit 16, the drawn out portion 3*a* of the wire located between the reel 12 and the feeding unit 16 installs a first restriction unit (first restriction portion) 83 for restricting the drawn out portion 3*a* from deviating from the entering route 81 is provided in the housing unit 11.

Here, the drawing portion 3*a* of the wire 3 refers to a portion where the wire 3 is free from after being fed out from the reel 12 to going inside the feeding unit 16. When describing with relation to the entering route 81, the entering route 81 which is inside a wire path 11*b* made of a free space can range between, a linear path (the maximum diameter 81*a*) straightly guided in a state where the wire 3 is tightly pulled towards the feeding unit 16 when the wire 3 wound around the reel 12 has a maximum diameter (at the start of use), and a linear path (the minimum path 81*b*) straightly guided in a state where the wire 3 is tightly pulled towards the feeding unit 16 when the wire 3 wound around the reel 12 has a minimum diameter (or a substantially has the diameter of the hub portion 41).

Then, when the wire 3 is guided in the entering route 81 in a state in which the wire 3 is pulled tightly, the first restriction unit 83 does not guide the wire 3, and when the wire 3 is loosened and deviates from the winding path 81, it restricts the deviation of the wire 3. Therefore, a required margin 84 is formed between the entering route 81 and the first restriction unit 83. The margin 84 is a small range that does not cause any problems even if the wire 3 deviates from the entering route 81. That is, the margin 84 is configured to have an angle formed by the first restriction unit 83 and the line in the drawing direction of the wire 3 by the feeding unit 16 (same as the line 86 extending in the returning direction 85 of the wire 3 described below (see FIG. 11)) to be set to be about 3° to 10° (preferably 5° or less).

In addition, when the wire 3 is wound in the counter-clockwise direction of the drawing with respect to the reel 12, the wire 3 (fed portion 3*a* of) the wire 3 is loosely swollen toward the front side. Therefore, the first restriction unit 83 is located at least at the front side of the entering route 81. The first restriction unit 83 will be described in more detail below.

(2) Further, a second restriction unit (second restriction portion) 87 which restricts the wire 3 pulled back to the reel 12 side by the feeding unit 16 from deviating from the line 86 extending in the pulling back direction 85 (refer to FIG. 11) of the wire 3 by the feeding unit 16 is located inside the housing unit.

Here, the pulling back direction 85 of the wire 3 from the feeding unit 16 (refer to FIG. 11) will be described. The pulling back direction 85 of the wire 3 from the feeding unit 16 refers to a direction in which the wire 3 is directed downwards in the case where a pair of feed gears 17 of the feeding unit 16 are rotated so that a relative-face portion (the engagement portion with respect to the wire 3) is directed downwards. Further, the feed direction 88 (see FIG. 10) of the wire 3 from the feeding unit 16 refers to a direction in which the wire 3 is directed upwards in the case where a pair of feed gears 17 of the feeding unit are rotated so that the relative-face portion (the engagement portion with respect to the wire 3) is directed upwards.

The second restriction unit 87 restricts the swelling due to the return of the wire 3 when the wire 3 is pulled back in a loose state. Further, as described above, the wire 3 tends to loosen in a swollen manner towards the front side of the apparatus. Therefore, the second restriction unit 87 is located at least to the front side of the entering route 81. The second restriction unit 87 will be described in more detail below.

Although the first restriction unit 83 and the second restriction unit 87 are set separately based on different cases, they can be standardized by devising a structure.

(3) More specifically, the front wall 91*a* of the housing unit 11 configuring the surface opposed to the wire 3 fed out from the reel 12 may be located at a position to serve as the first restriction unit 83 or the second restriction unit 87.

In the present example, the front wall 91*a* is located with a margin 84 on the front side of the entering route 81. At this time, the margin 84 is adjusted so that the first restriction unit 83 coincides with the second restriction unit 87, so that the front wall 91*a* is configured to have both functions.

(4) In the above description, the front wall 91*a* of the housing unit 11 may be located with an abrasion preventing unit 92 capable of preventing abrasion of the front wall 91*a* due to contact with the wire 3.

(5) The abrasion preventing unit 92 may be a member made of a metal material configuring at least a part of the housing unit 11.

Here, the metallic member may be a protective case 91. At least a part of the housing unit 11 may be a front wall 91*a* of the protective case 91. The abrasion preventing unit 92 can be provided on all or at least a part of the front wall 91*a*.

(6) The abrasion preventing unit 92 may be a member made of a metal material configuring the entire housing unit 11.

Here, the metallic member may be the protective case 91. The entire housing unit 11 can be formed entirely of the protective case 91 (the front wall 91*a*, the rear wall 91*b*, and the sidewall 91*c*).

(7) Further, the abrasion preventing unit 92 may be a metal plate provided so as to cover at least a part of the front wall 91*a*.

Here, the metal plate can be provided by being attached or embedded in the inner surface of the protective case 91. In this case, the metal plate is to be provided over the entire inner surface of the protective case 91, or provided at least partially on a portion of the front wall 91*a*.

(8) The abrasion preventing unit 92 may be a member made of a metal material provided so as to protrude toward the inside of the housing unit 11.

Figure 12:
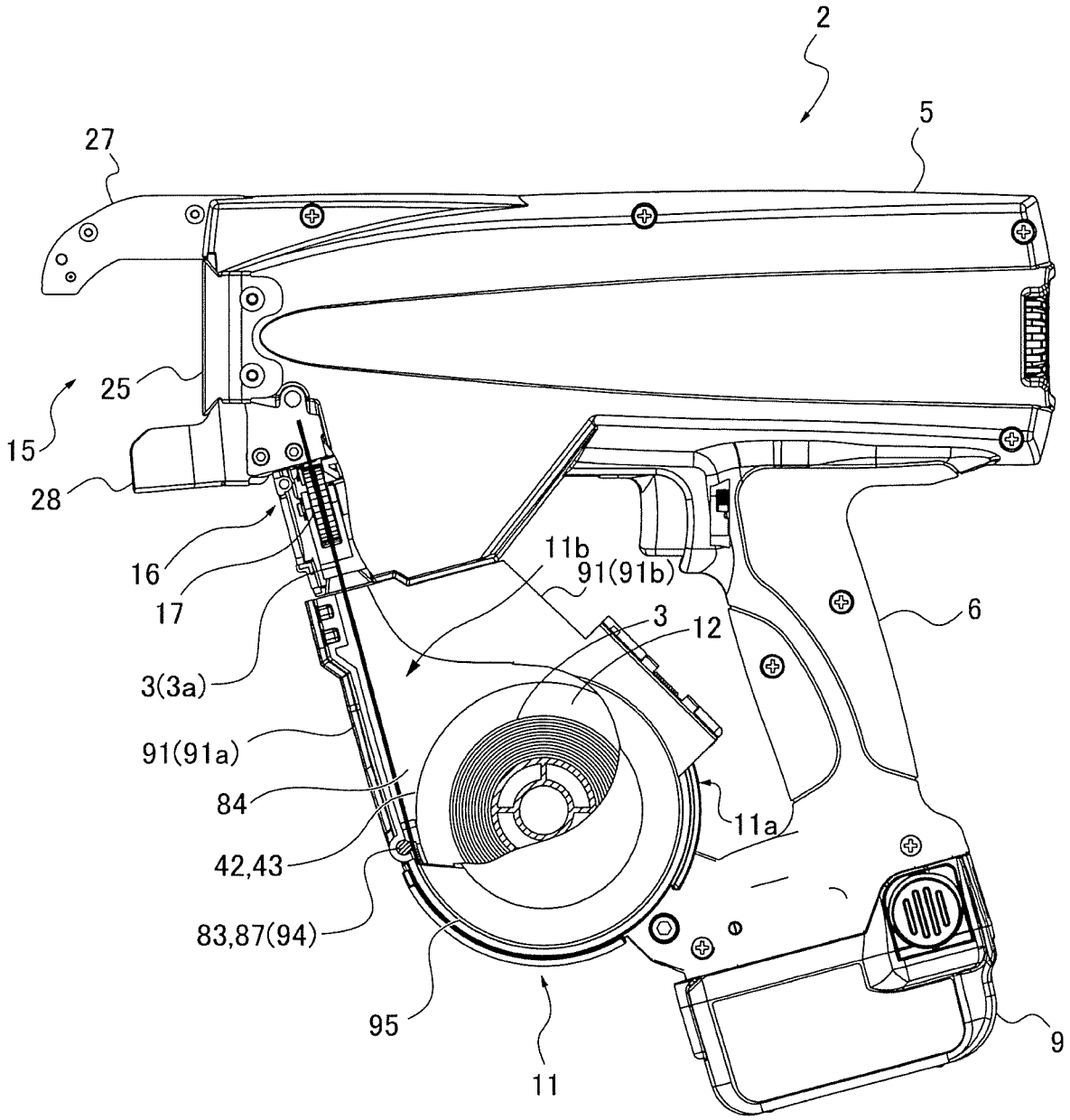
FIG. 12 is an overall side view in which a part of a binding machine having a first restriction unit (abutting member) is broken.
Figure 13:
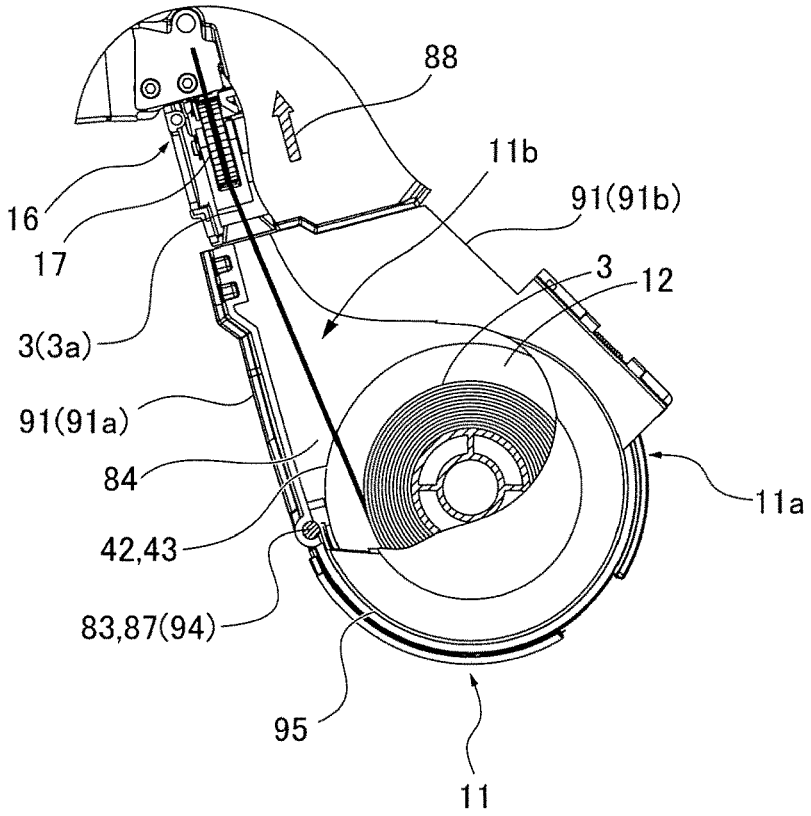
FIG. 13 is a partially enlarged view of the periphery of a housing unit of FIG. 12 illustrating the state of when a wire is fed out.

(9) Alternatively, in another embodiment, as illustrated in FIG. 12 (to FIG. 14) the first restriction unit 83 (or at least a part thereof) may be a single or plurality of abutting members capable of abutting against a drawing portion 3*a* of a wire 3. Further, it is not necessary for the abutting member 94 to abut onto the wire 3 at all times, and it is preferable for it to be able to abut at least in the case where the drawing portion 3*a* of the wire 3 is loosened.

(10) Further, in another embodiment, as illustrated in FIG. 12 (to FIG. 14), a second restriction unit 87 (at least a part thereof) may be a single or plurality of abutting members capable of abutting against a pullback wire 3 located between a reel 12 and a feeding unit 16. It is not necessary that the abutting member 94 has to be abut to the pulled back wire 3, and it is preferable for it to be able to be abut at least in the case where the looseness of the pulled back wire 3 becomes larger than necessary.

Here, the abutting member 94 may be a recessed member provided so as to protrude inward with respect to the housing unit 11 (the protective case 91), for example, a pin, particularly a metal pin or the like. The convex shaped member such as a metal pin or the like has a function of preventing abrasion (with respect to the abutting member 94) such as the above-described abrasion preventing unit 92 (with respect to the front wall 91*a*) in addition to the functions of the first restriction unit 83 and the second restriction unit 87. The metal pin for example, may have a circular cross section. Also, the metal pin may have a recessed portion protruding inward of the protective case 91 having a non-circular cross section such as a semicircular or D-shaped cross section.

In the case where the abutting member 94 is made of a metal pin, the metal pin extends in the axial direction of the reel 12 (the direction orthogonal to the paper surface of the drawing). By having the metal pin inserted into or pushed or the like into a pin hole (in a cantilever state) provided in at least one side of the right and left side walls 91*c* (see FIG. 16) of the housing unit 11, it is positioned in a position more inwards than the case 91 (the rear side of the front wall 91*a*). In this case, only one pin made of metal as the abutting member 94 is located at a position on the front side of the entering route 81.

Further, in the case where the abutting member 94 is provided, it is not always necessary for the front wall 91*a* of the housing unit 11 for mainly serving as the restriction unit (the first restriction unit 83 or the second restriction unit 87) to be used as the first restriction unit 83 or the second restriction unit 87. However, both the abutting member 94 and the front wall 91*a* may be combined for both to be either the first restriction unit 83 or the second restriction unit 87.

Further, the abutting member 94 may be freely detachable from the housing unit 11 so that it can be replaced when worn. Also, the abutting member 94 may be provided so that a portion of the abrasion preventing unit 92 in respect to the front wall 91*a* is partly protruded to the inside of the housing unit 11 so as to have a convex shape like the metal pin.

Figure 14A:
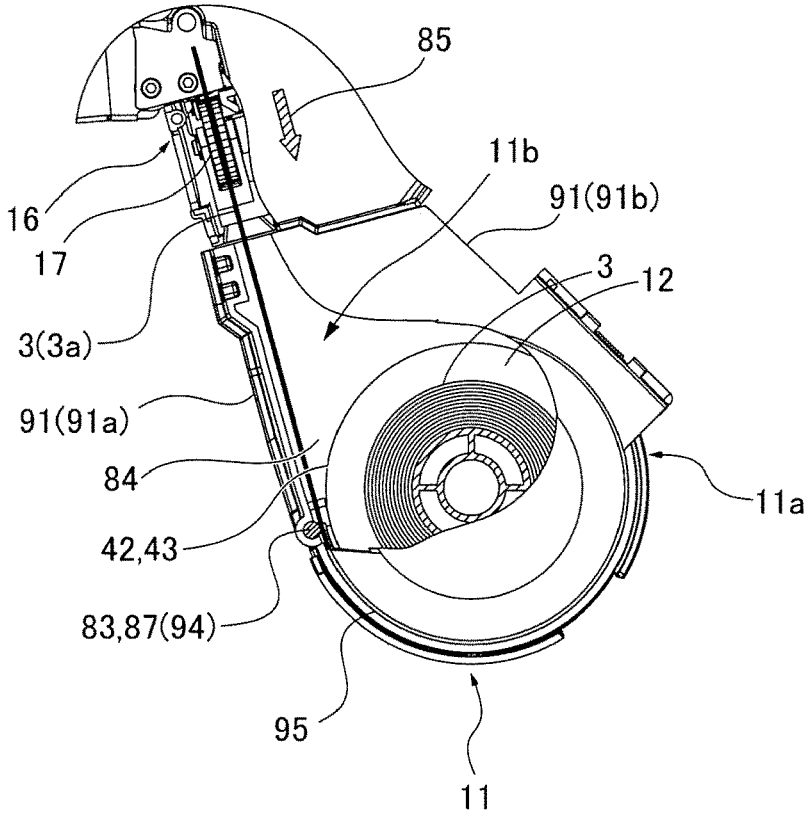
FIG. 14A is a partially enlarged view of the periphery of the housing unit of FIG. 12 illustrating the state of when the wire is pulled back.
Figure 14B:
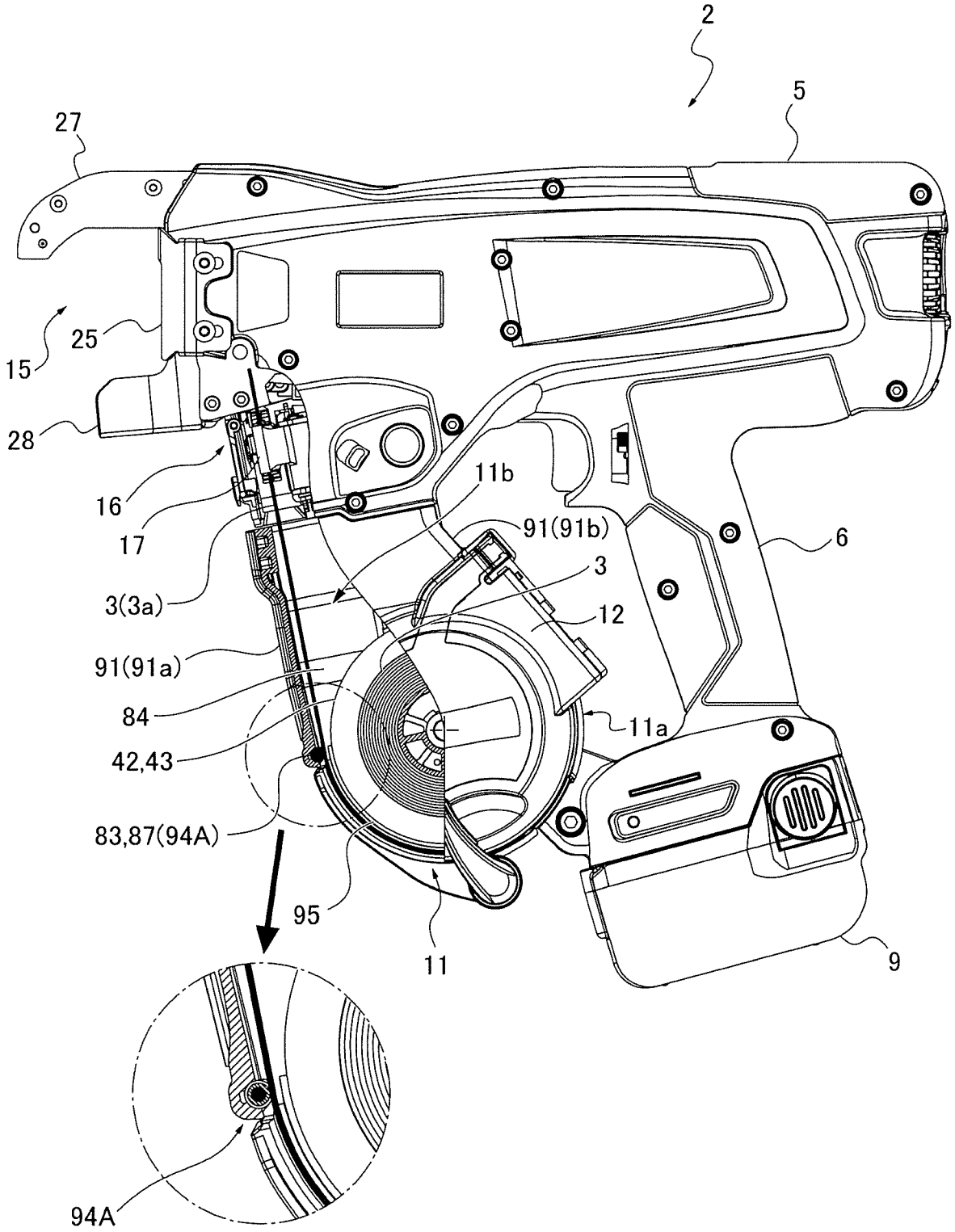
FIG. 14B is a view similar to FIG. 12 in which the abutting body is a roller.

(11) Further, as illustrated in FIG. 14B, the abutting member 94*a* may be a movable member (a movable contact member) or the like which can move a portion abutting with the wire 3, instead of a fixed abutting member such as the metal pin or the like.

Figure 14C:
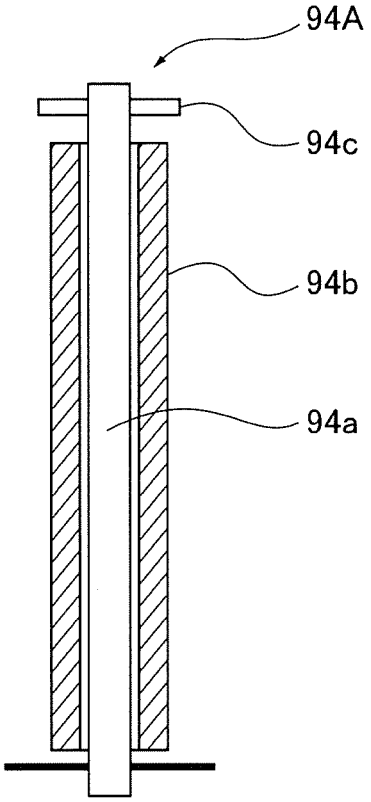
FIG. 14C is a view illustrating the structure of the roller.

(12) The movable member may be, for example, a rotatable roller. As illustrated in FIG. 14C, the roller is provided with a rotation shaft 94*a* and a tubular roller body 94*b* fitted outside the rotation shaft 94*a*. The roller body 94*b* is preferably provided with its own abrasion preventing unit 92. For this purpose, for example, the entire roller body 94*b* may be made of a metal material. Alternatively, a metal sleeve or a metal belt (steel belt) or the like may be mounted on the surface of the roller body 94*b* as the abrasion preventing unit 92. The metal sleeve or the metal belt may be detachably attached to the roller body 94*b* to be exchangeable. In addition, the roller body 94*b* itself can be detachably and exchangeably held by detachably mounting a hooking member such as an E-ring 94*c* to the leading end portion of the rotary shaft 94*a*.

Figure 14D:
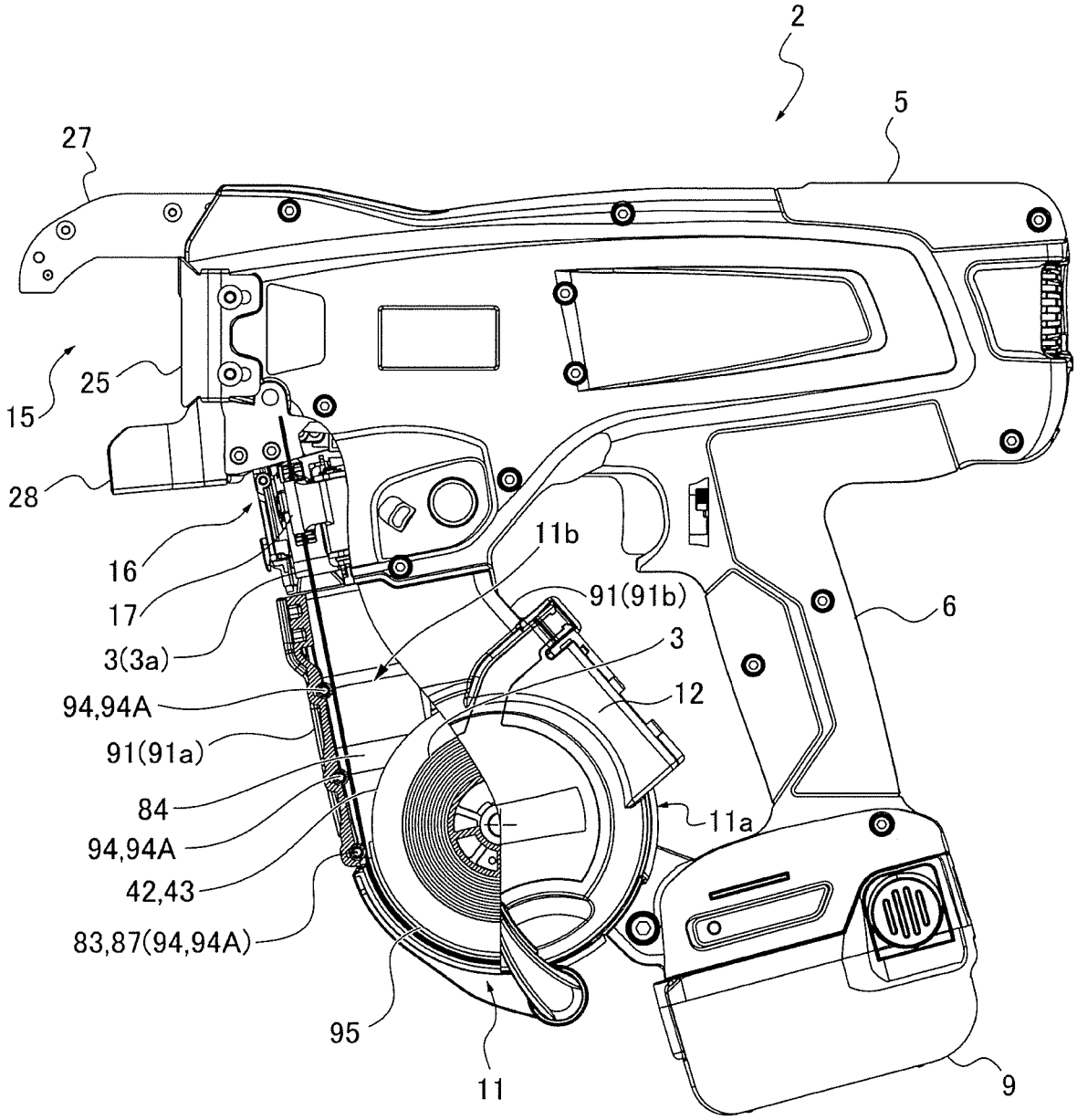
FIG. 14D is a view similar to FIG. 12 in which a plurality of abutting members are installed.

In this case, only one roller (movable body) serving as an abutting member 94*a* is provided at a position more on the front side than the entering route 81 (FIG. 9 illustrates the entering route 81). However, as illustrated in FIG. 14D, the abutting members 94 and 94A (the metal pins or the rollers (movable members) as the members) may be provided as a plurality (as three in the drawing) spaced apart from each other by a predetermined distance according to the position more on the front side than the entering route 81. The metal pin and roller may be used together. Further, in the case where a plurality of the abutting members 94 and 94A (the metal pins or the rollers (movable members) as the members) are provided, a metal belt (steel belt) or the like may be further interposed therebetween so as to be a movable member on a conveyor.

(13) The abutting member 94 may be a convex shaped member protruding inwards of the housing unit 11.

(14) In the above description, the feeding direction 88 or the returning direction 85 of the wire 3 by the feeding unit 16 is directed in the tangential direction with respect to a virtual circle 95 provided at a maximum diameter portion of the reel 12 or in the vicinity thereof. In addition, at least one abutting member 94 is located at the position of a contact point between a tangent line and the virtual circle 95 or in the vicinity thereof.

Here, in the reel 12, flange portions 42 and 43 have are set to be maximum diameter portions. Therefore, the virtual circle 95 set at the maximum diameter portion of the reel 12 refers to the outer circumferential edges of the flange portions 42 and 43. The virtual circle 95 provided in the vicinity of the maximum diameter portion may be for example, a circle along the inner circumferential wall of the reel housing unit 11*a*. The inner circumferential wall of the reel housing unit 11*a* is at least slightly larger in diameter than the inner flange portion 42 so that the reel 12 is inserted.

Figure 11:
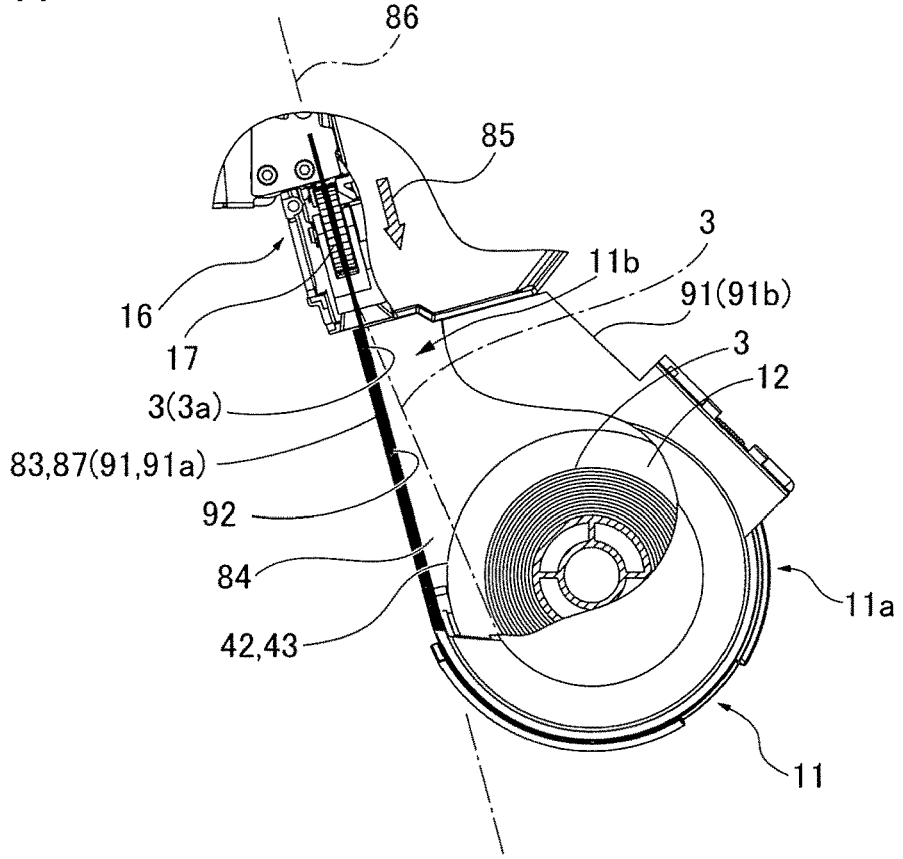
FIG. 11 is a partially enlarged view of the periphery of the housing unit of FIG. 9 illustrating the state of when the wire is pulled back.

The tangent line corresponds to a line 86 extending in the pullback direction 85 of the wire 3 (see FIG. 11). The abutting member 94 is located at a position slightly above the tangent line from the front side of the apparatus.

Figure 15:
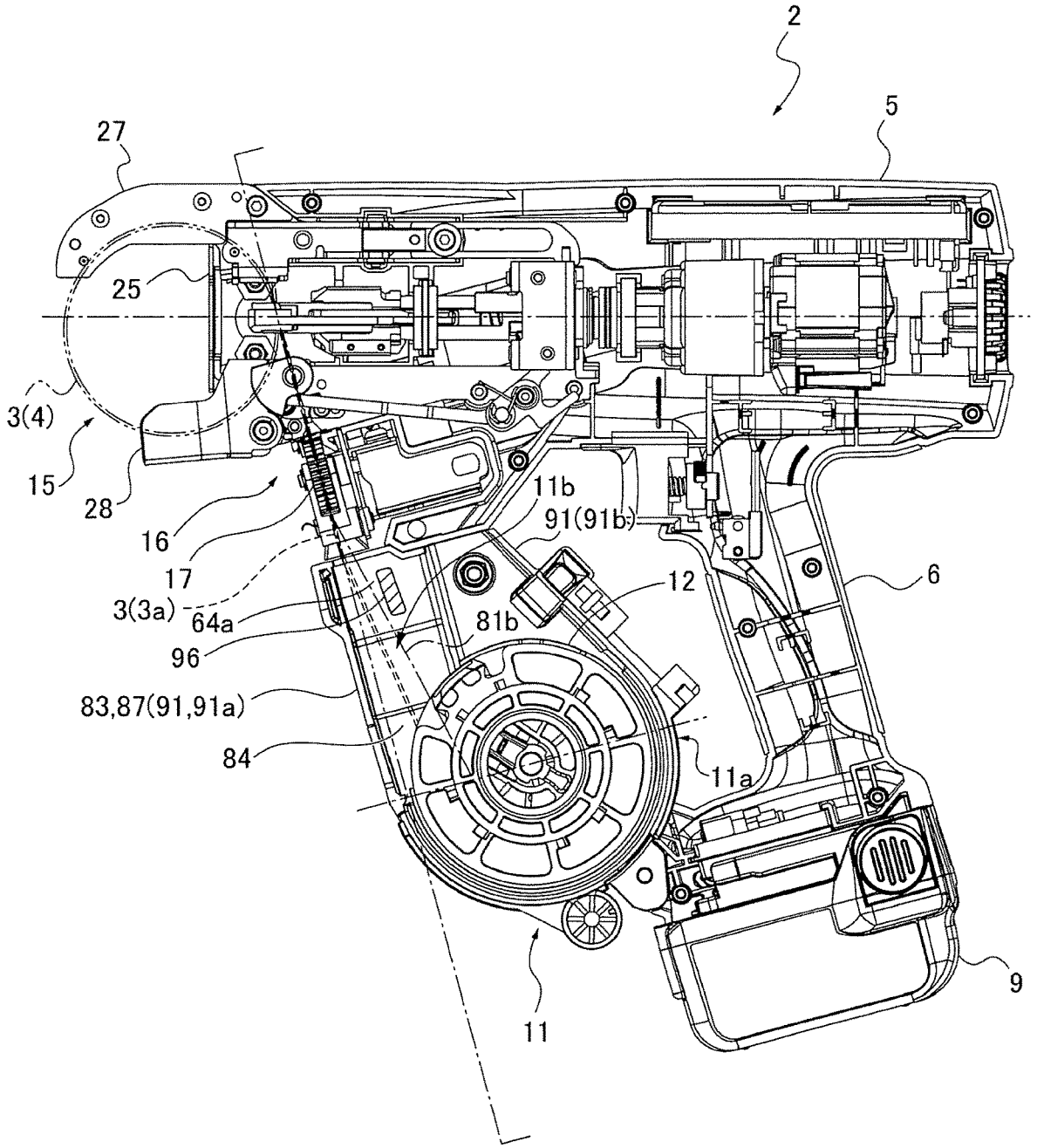
FIG. 15 is an overall side view of the binding machine having a third restriction unit, a part of which is broken.

(15) Also, as illustrated in FIG. 15 (FIG. 16), it is preferable to provide a third restriction unit (third restriction portion) for restricting the wire 3 at a rear side (right side of FIG. 15) of the entering route 81 (see FIG. 9) of the wire when the wire 3 drawn out from the reel 12 in the housing unit 11 is guided to the feeding unit 16.

Here, the second restriction unit 96 restricts the deformation (deformation due to meandering or the like) of the rear directed wire 3. The deformation of the wire 3 being directed towards the rear is firstly caused by the loss of a place for the wire 3 (drawn portion 3*a* thereof) to avoid in a forward direction after being deformed in a swollen manner towards the forward direction.

(16) The third restriction unit 96 may be, for example, a pressurizing rib extending from the side wall 91*c* of the housing unit 11 (the protective case 91).

Here, this pressurizing rib (third restriction unit 96) is located at a rear side position than the minimum path 81*b* of the wire 3 with a slight margin 64*a* relative to the minimum path 81*b*. In this case, the pressurizing rib is located provided so as to extend substantially in the cantilevered state toward the axial direction of the reel 12 at a position near the feeding unit 16 above the protective case 91.

<Operation>

The operation of this embodiment will be described below.

As illustrated in FIGS. 1 and 3, in the binding machine 2, the reel 12 on which the wire 3 is wound is provided with the housing unit 11, and the wire 3 is pulled upward so that the reel 12 is rotated clockwise from the position of the lower front part of the reel 12, thereby passing it through the feeding unit 16 and the curling arm 27 of the curve forming unit 26 and finally becoming an unstable state.

Then, the power switch of the binding machine body 5 is on and the lock switch 8 is released, thereby an object 1 such as a reinforcing bar brings into contact with the abutting portion 25 of the distal end (a binding portion 15) of the binding machine body 5. The binding machine 2 is operated by pulling a trigger 7 to bind the object 1 such as a reinforcing bar.

Figure 17:
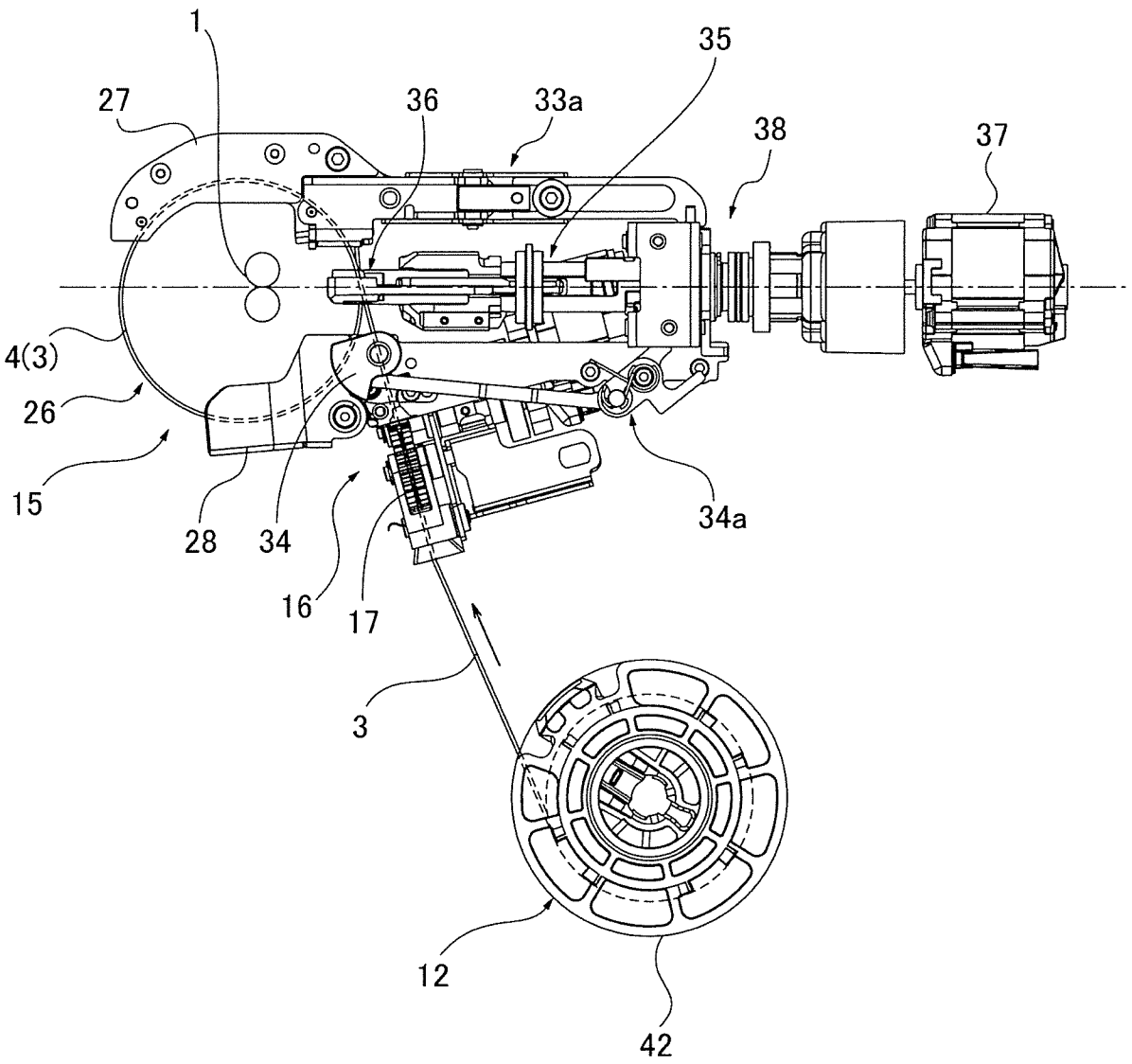
FIG. 17 is a front view illustrating a wire feeding step, in which a part of a housing unit illustrating is broken.

At this time, when the trigger 7 is pulled, first, the wire 3 is fed at a specified amount toward the upper curl arm 27 by the feeding gear 17 of the feeding unit 16, as illustrated in FIG. 17, and curled by the curl arm 27 (a curl groove portion thereof) so that the wire 3 faces downward at the position of the curl arm 27. The distal end of the curled wire 3 is rotated counterclockwise, jumps into the curl guide 28, passes through a holding portion 36 of a twisted portion 35 while being guided by the curl guide 28, and becomes a ring 4 surrounding the periphery of the object 1, and strikes the base portion of the curl arm 27 (a wire feeding step).

Next, the twisted portion 35 is operated, and the wire guide 33 of the base portion of the curl arm 27 restricts the position of the distal end of the wire 3 that has become the wheel 4 via the interlocking mechanism 33*a* (see FIG. 6), and the distal end portion of the wire 3 is held at the holding portion 36 (a wire gripping process).

Figure 18:
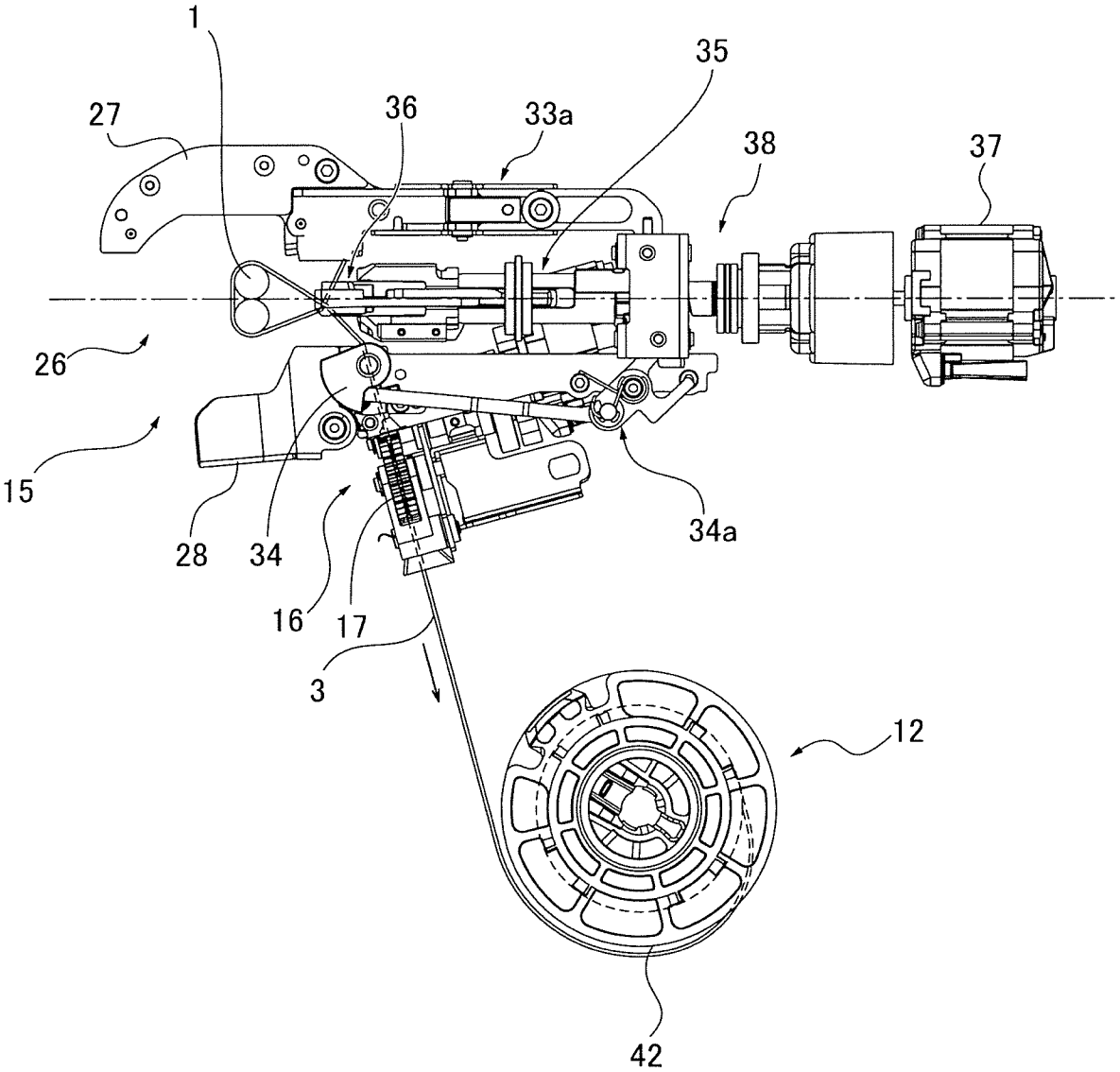
FIG. 18 is a side view of the twisting unit and etc. similar to FIG. 6, illustrating a wire returning step.

Further, as illustrated in FIG. 18, the feeding gear 17 of the feeding unit 16 reversely rotates to pull back the wire 3 downward by a predetermined amount (a wire pulling back step). By pulling back the wire 3, it is possible to minimize the amount of the wire 3 used for one binding to increase the number of times of binding. Further, the winding shape of the wire 3 for binding the object 1 is small and thus well arranged. However, when the wire 3 is pulled back, looseness of the wire 3 may occur within the housing unit 11. Further, in addition to the above, the looseness of the wire 3 may occur, for example, when the reel 12 is excessively rotated due to rotational inertia at the time of drawing out the wire 3, when the reel is rotated excessively little by little due to vibration occurring in the binding machine 2 at the time of binding.

Figure 19:
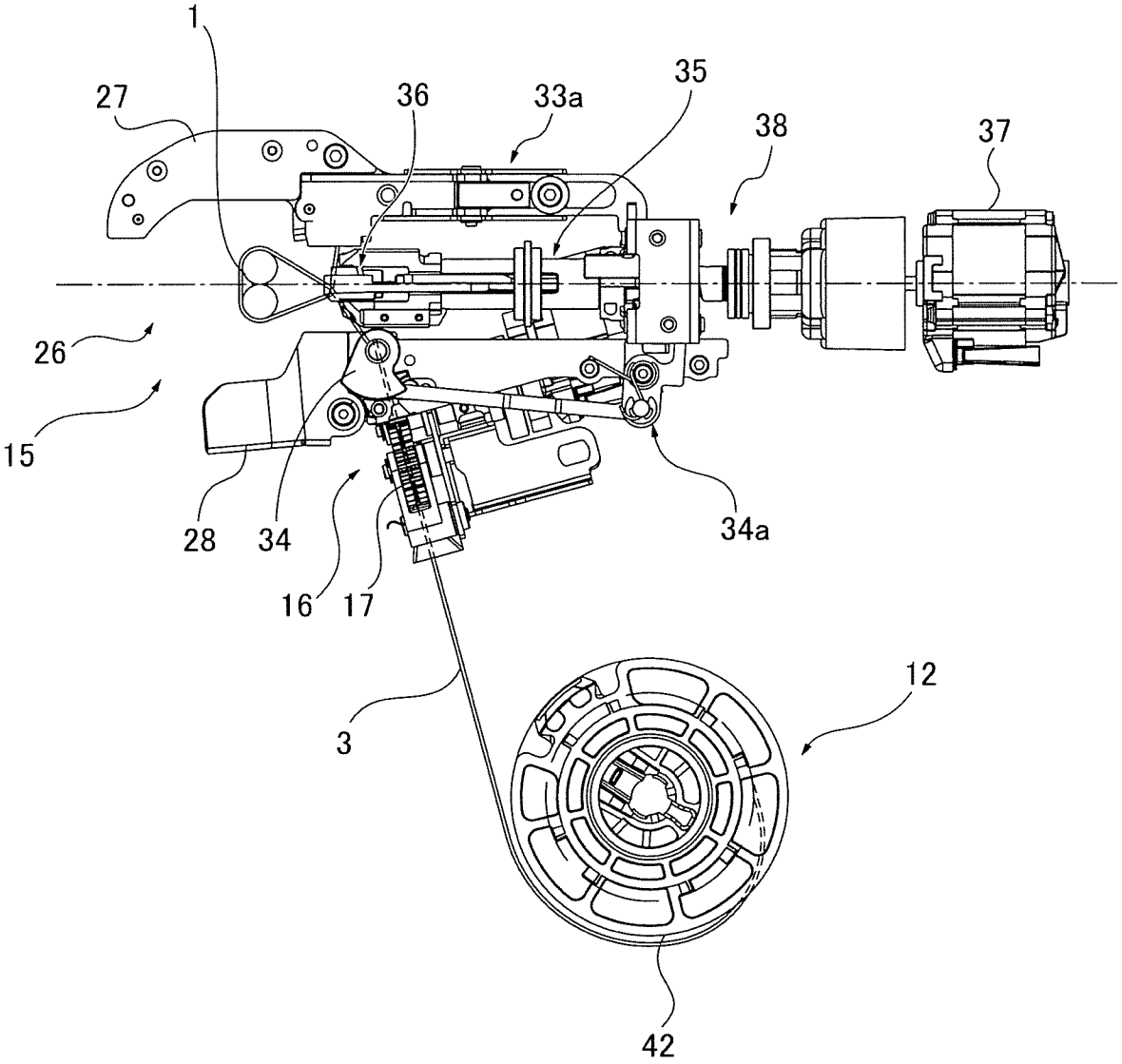
FIG. 19 is a side view of the twisting unit and etc. similar to FIG. 6 illustrating a wire cutting step.

Subsequently, as illustrated in FIG. 19, the cutting portion 34 operates to cut the wire 3 (a wire cutting step).

Figure 20:
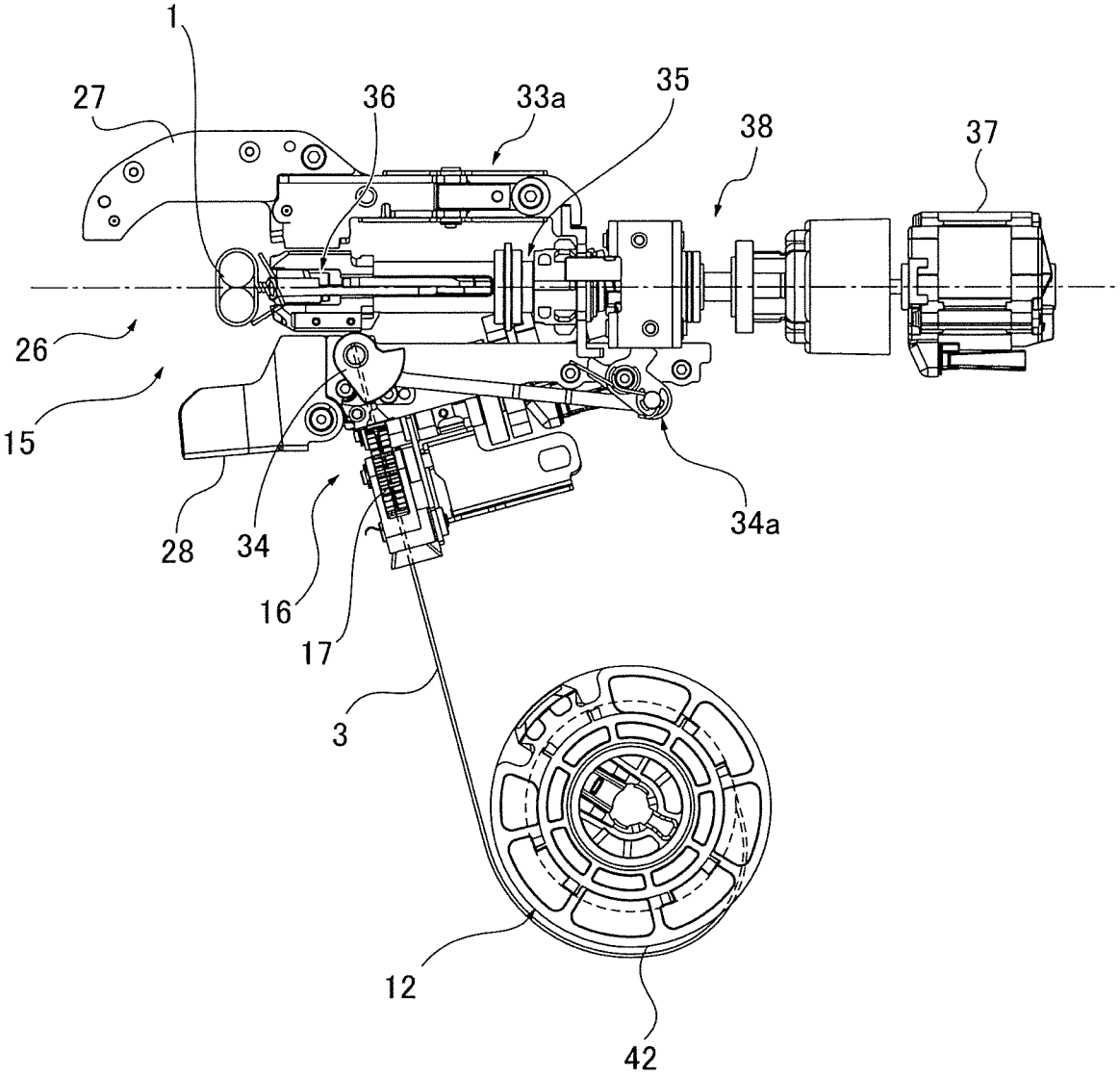
FIG. 20 is a side view of the twisting unit and etc. similar to FIG. 6 illustrating a wire twisting step.

Thereafter, as illustrated in FIG. 20, the holding portion 36 of the twisted portion 35 is twisted, thereby twisting the wire 3, and the holding portion 36 advances to reduce the size of the wheel 4 and to reduce the twisted portion of the wire 3 to a reinforcing bar or the like close to the object 1, and binding is performed by tightening (a wire twisting step).

Figure 21:
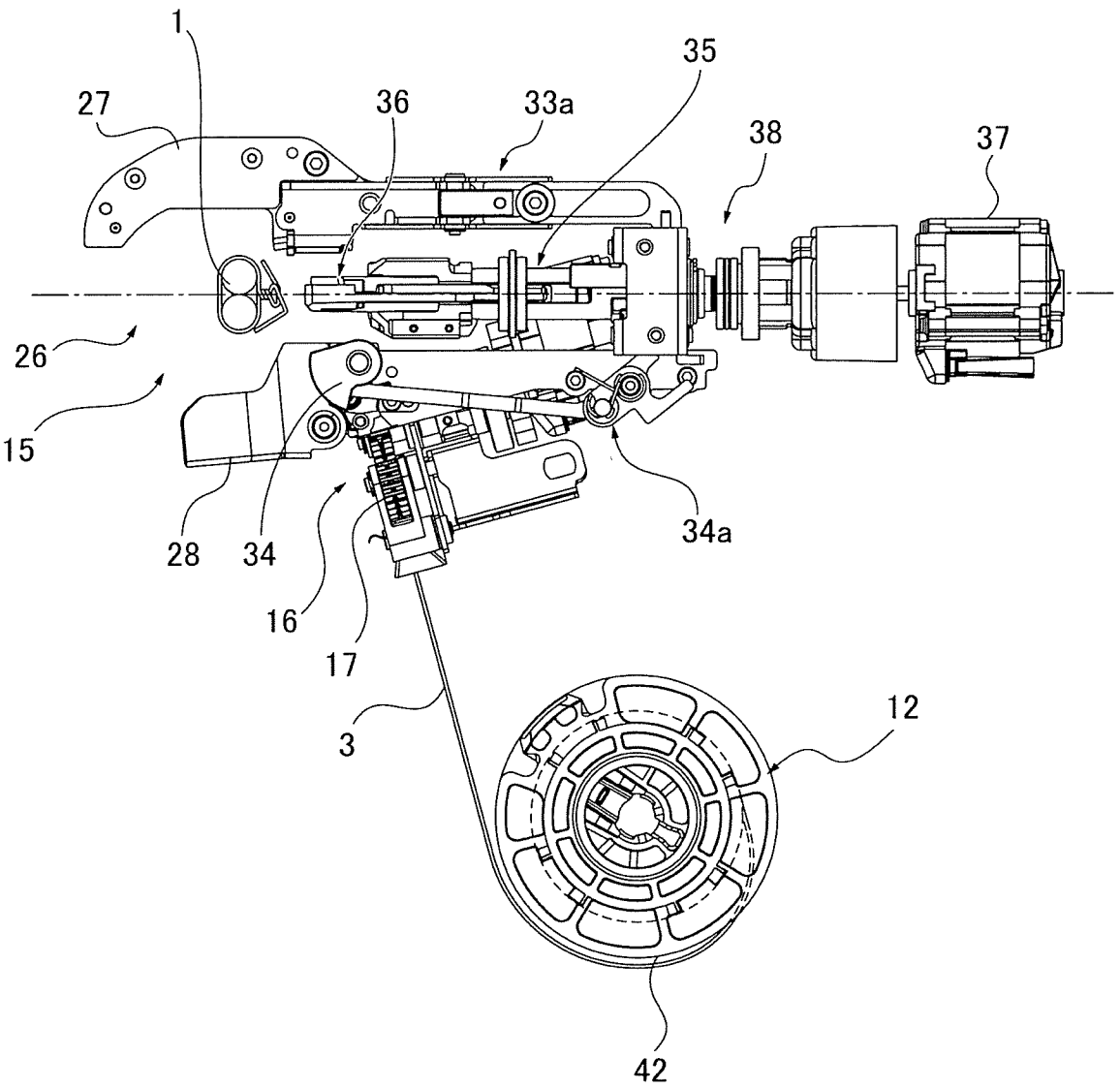
FIG. 21 is a side view of the twisting unit and etc. similar to FIG. 6 illustrating a wire separating step.

Finally, as illustrated in FIG. 21, the holding portion 36 is retracted from the object 1 such as a reinforcing bar and the binding is terminated by separating the twisted part of the wire 3 (a wire separating step).

<Effect>

According to this embodiment, the following effects can be obtained.

(Effect 1) The first restriction unit 83, which restricts the drawing portion 3*a* of the wire 3 located between the reel 12 and the feeding unit 16 from detaching from the entering route 81 of the wire 3 guided to the feeding unit 16, is provided inside the housing unit 11. Thereby, the first restriction unit 83 can restrict the drawing portion 3*a* of the wire 3 so as not to be greatly detached from the entering route 81. That is, the wire 3 is loosened when the wire 3 is pulled back, or the reel 12 is excessively rotated by a rotational inertia when the wire 3 or the like is drawn out, or the reel 12 is excessively rotated little by little due to vibration or the like generated in the binding machine 2 at the time of binding. The looseness generated in these cases can be restricted.

Further, as described above, since the drawing portion 3*a* of the wire 3 is restricted so as not to be greatly detached from the entering route 81, the drawing portion 3*a* of the wire 3 is kept in a state where the deformation resistance load is high (that is, a state of being close to substantially straight line without bending of the drawing portion 3*a*), and the bending of the drawn out portion 3*a* is increased, so that it is possible to prevent the deformation load of the drawn out portion 3*a* from being reduced to a state that is likely to cause buckling or the like.

Figure 22:
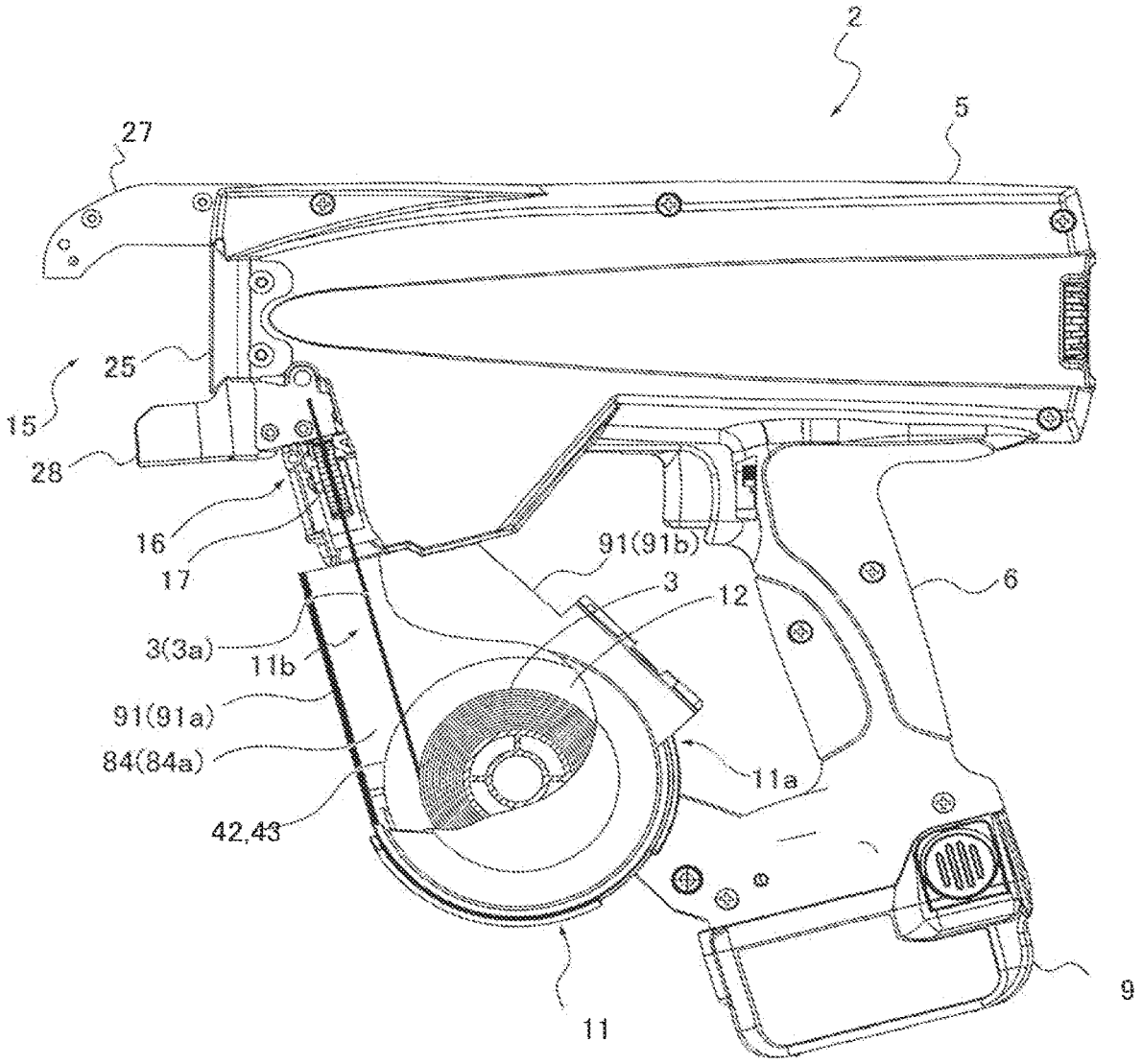
FIG. 22 is a side view of a binding machine having no restriction unit as a comparative example, a part of which is broken.

On the other hand, when the first restriction unit 83 is not provided at all, it is considered that, as illustrated in FIG. 22 (to FIG. 25), the housing unit 11 is set to be larger than necessary, thereby allowing looseness of the wire 3 to the maximum (excessive surplus allowance 84*a*).

Figure 23:
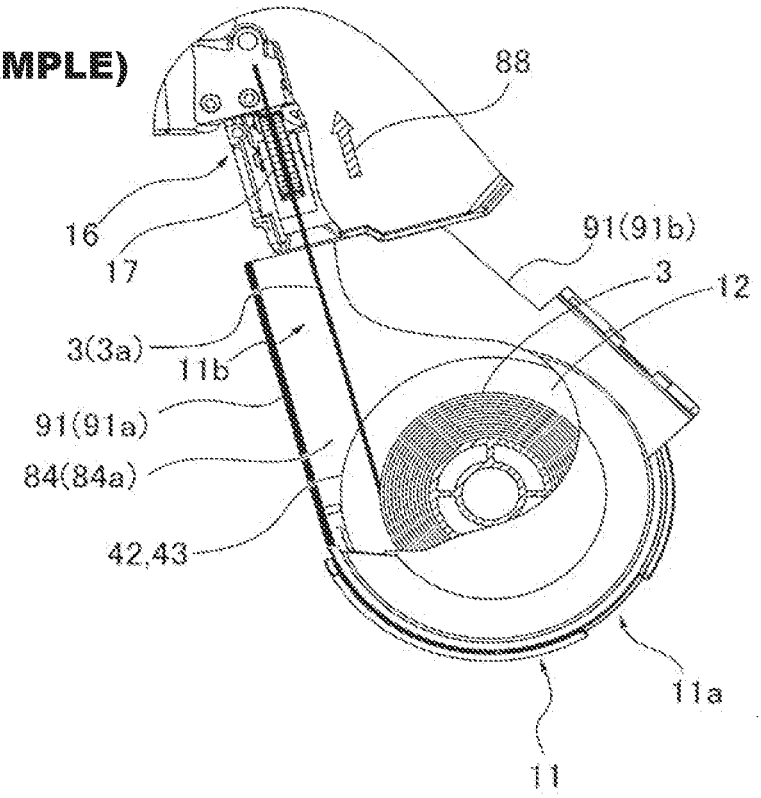
FIG. 23 is an enlarged view of the periphery of the housing unit of FIG. 22 illustrating the state of when the wire is fed out.
Figure 24:
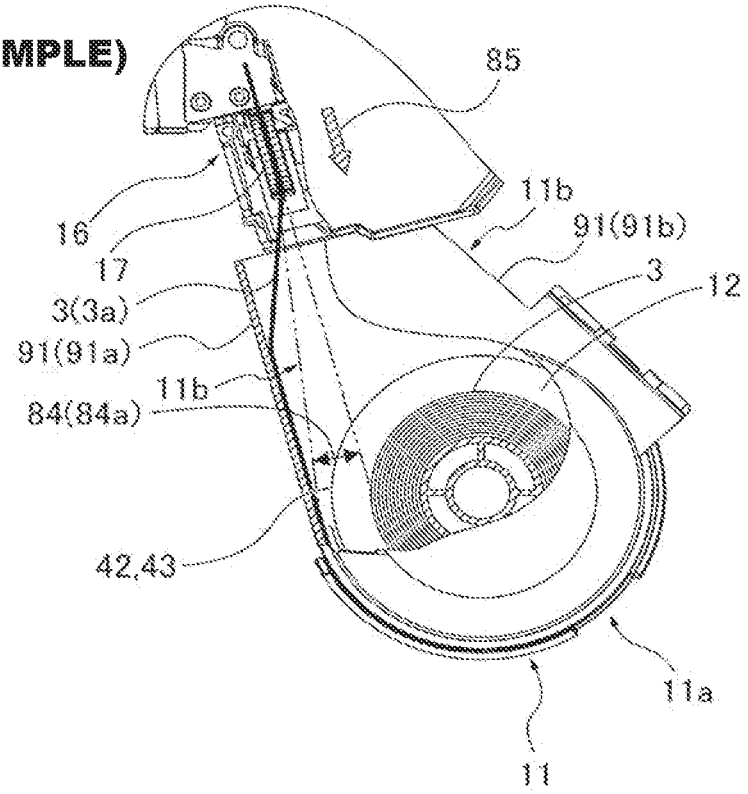
FIG. 24 is an enlarged view of the periphery of the housing unit of FIG. 22 illustrating the state of when the wire is retracted.
Figure 25:
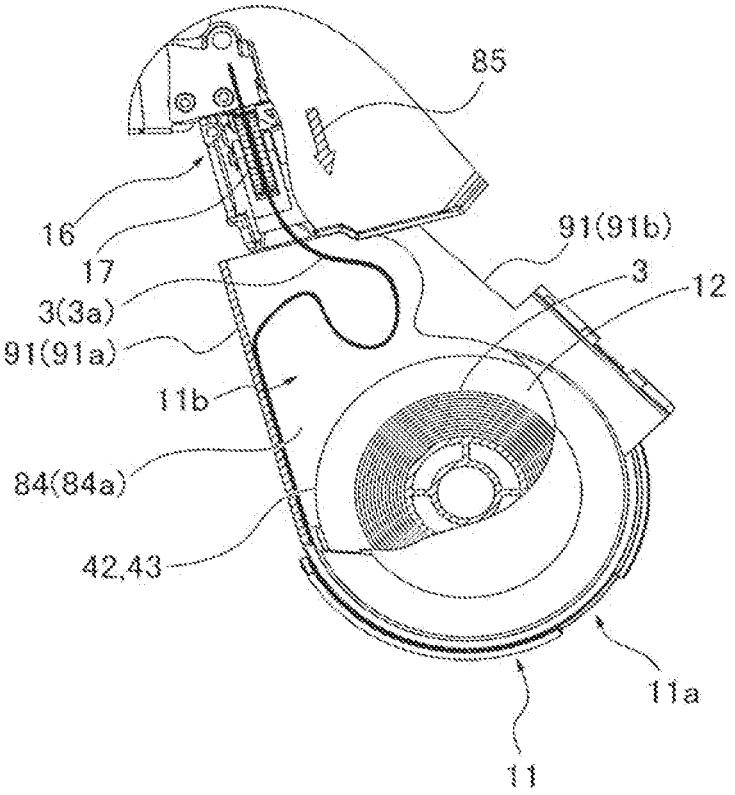
FIG. 25 is a partially enlarged view of the periphery of the housing unit of FIG. 22 illustrating the state in which bending occurs in the wire due to pulling back.

However, if the housing unit 11 is unnecessarily enlarged, it seems to be good at first sight, but for example, while repeating the feeding of the wire 3 illustrated in FIG. 23 and the pulling back of the wire 3 illustrated in FIG. 24, the loosened wire 3 gradually bulges and swells inside the housing unit 11, and contacts the front wall 91*a* of the wire passage 11*b* to stick to the front wall 91*a*. Then, the wire 3 sticking to the front wall 91*a* of the wire passage 11*b* has a large curvature when the escape place to the front side disappears as much as it is largely swollen, so that the reduction of the deformation resistance load becomes remarkable. Therefore, it bends to the rear side, causing deformation (meandering or the like) of the wire 3 going backward as illustrated in FIG. 25. Therefore, taking a margin 84 larger than necessary will promote rampage of the wire 3 and the like, therefore, it tends to cause troubles rather.

In contrast, as in this embodiment, the first restriction unit 83 is provided inside the housing unit 11 to appropriately restrict the dislocation of the wire 3 with respect to the entering route 81, and thereby it is possible to effectively prevent the deformation such as buckling and meandering of the wire 3.

(Effect 2) Further, when the wire 3 fed by (the reverse rotation of) the feeding unit 16 is forced to pull back, if the wire 3 deviates from the line 86 extending in the pullback direction 85 of the wire 3 by the feeding unit 16, the drawn-out portion 3*a* of the wire 3 is likely to be bent. Further, when the curvature of the drawing portion 3*a* of the wire 3 becomes larger than a certain curvature, the deformation resistance load of the wire 3 decreases (as compared to when the wire 3 is in a straight state) as describe above. Therefore, the drawn out portion 3*a* of the wire 3 is easily broken by a force where the feeding unit 16 is forced to pull back the wire 3 (that is, the drawing portion 3*a* of the wire 3 is likely to buckle).

As described above, when the drawing portion 3*a* of the wire 3 is bent, there arise a problem that, for example, the wire 3 cannot be fed at the next binding, or the wire 3 jumps out from the housing unit 11.

Therefore, a second restriction unit 87 for restricting so that the wire 3 (the drawn out portion 3*a* thereof) pulled back to the reel 12 side by the feeding unit 16 is prevented from being deviating from a line 86 extending in the pullback direction 85 (see FIG. 11) of the wire 3 by the feeding unit 16, is provided in the housing unit 11.

Thus, since it is difficult for the drawing portion 3*a* of the wire 3 to bend, the deformation resistance load of the drawing portion 3*a* of the wire 3 does not decrease, and the drawn-out wire 33*a* of the wire 3 can be prevented from being easily bent by a force where the feeding unit 16 is forced to pull back the wire 3. Therefore, for example, it is possible to effectively prevent problems, such as failure to send the wire 3 at the next binding and jumping out of the housing unit 11 of the wire 3.

In addition, in order to make it easier to make a wheel 4 with the curve forming portion 26, there is a case where a certain degree of bending (curling) is given to the wire 3 by the feeding unit 16 at the time of feeding the wire 3. In such a case, when the feeder 16 is rotated reversely to pull back the wire 3, a part of the wire 3 curled by the feeding unit 16 is returned to the reel 12 side in a state in which the wire 3 is bent. Due to such curling, the drawn out portion 3*a* of the wire 3 tends to easily deviate from the line 86 extending in the pullback direction 85 of the feeding unit 16. However, it is also effective to prevent the deviation (from the line 86 extending in the pullback direction 85) of the drawn out portion 3*a* of the wire 3 by pulling back the curled wire 3 by providing the restriction unit 87.

Particularly, in the case of using the wire 3 having a small wire diameter (for example, a wire diameter of about 0.5 mm to 1.5 mm), since the wire 3 itself is easy to bend, the buckling of the wire 3 are likely to occur by pulling back by the feeding unit 16. Even in such a case, however, since deviation of the wire 3 can be prevented by providing the second restriction unit 87, it is possible to stably continue the wire connecting operation in which the feeding and pulling back operations of the wire 3 are repeatedly performed.

(Effect 3) Even when the front wall 91*a* of the housing unit 11 configuring the surface opposed to the wire 3 fed out from the reel 12 may be disposed at the position which serves as the first restriction unit 83 or the second restriction unit 87. This makes it possible to effectively use the front wall 91*a* of the protective case 91 to provide the restriction unit 83 or 87 and also eliminate the necessity of providing dedicated restriction unit 83 or 87 separately from the protective case 91. Further, by using the protective case 91 as the restriction unit 83 or 87, it is also possible to reduce the size of the binding machine 2 and the housing unit 11.

(Effect 4) Wear prevention unit 92 capable of preventing wear of the front wall 91*a* due to contact of the wire 3 is provided on the front wall 91*a* of the housing unit 11. Thus, even when the wire 3 (the drawing portion 3*a* thereof) is loosened and detached from the entering route 81 and comes into contact with the front wall 91*a* of the protective case 91 serving as the restriction unit 83 or 87, wear of the protective case 91 due to rubbing against the contact wire 3 can be prevented by the metal wear preventing unit 92. Further, since the metallic wear preventive unit 92 reduces the frictional resistance with the wire 3, it is possible to avoid problems that the wire 3 deviating from the entering route 81 and contacting the protective case 91 is stuck to the protective case 91 to become immovable. Therefore, by providing the metallic wear prevention unit 92, even if the wire 3 comes in contact with the protective case 91 or sticks to the protective case 91, it is possible to prevent the deformation of the wire 3 and also to smoothly conduct pulling back.

(Effect 5) The wear preventing unit 92 can be a metallic member configuring at least a part of the housing unit 11. For example, the wear preventing unit 92 can be provided for at least a part or the entire of the front wall 91*a* of the protective case 91 configuring the housing unit 11. As a result, it is possible to prevent wear of at least part or all of the protective case 91.

(Effect 6) Specifically, the wear preventing unit 92 can be a metallic member (for example, a protective case 91) configuring the whole housing unit 11. As a result, the whole of the protective case 91 can be the wear preventing unit 92.

(Effect 7) In addition, the wear preventing unit 92 can be a metal plate provided so as to cover at least a part of the front wall 91*a*. As a result, it is possible to effectively prevent wear of the housing unit 11 with the metal plate. In this case, the metal plate can be provided by being affixed or embedded in the entire inner surface of the protective case 91, or at least to the portion of the front wall 91*a*.

(Effect 8) Furthermore, the wear preventing unit 92 may be a metallic member provided so as to protrude toward the inside of the housing unit 11. As a result, it is possible to effectively prevent wear of the housing unit 11 with a metallic member.

(Effect 9) The first restriction unit 83 (or at least a part thereof) may be one or a plurality of abutting members 94 capable of abutting against the extended portion 3*a* of the wire 3. By means of the single or plural abutting members 94, looseness of the wire 3 at the time of drawing out the wire 3 can be effectively restricted.

(Effect 10) The (second) restriction unit 87 (at least a part thereof) can also be used as one or a plurality of abutting members 94 capable of abutting against the pullback wire 3 positioned between the reel 12 and the feeding unit 16. By means of a single or a plurality of abutting members 94, looseness of the wire 3 at the time of pulling back the wire 3 can be effectively restricted.

(Effect 11) The abutting member 94A may be a movable member (movable type abutting member) that an abutting portion with the wire 3 can move. In this way, by making the abutting member 94A as a movable member, it is possible to make it more resistant to abrasion (as compared with the case where the abutting member 94 is a fixed type abutting member such as a pin). Thus, even when the binding machine 2 is used in an adverse environment where dusts or the like are likely to be generated, the abutting member 94A is more resistant to abrasion, so that the performance with respect to feeding and pulling back of the wire 3 continues to maintain for a long period of time.

(Effect 12) Specifically, the movable member may be a roller. In this way, by making the abutting member 94A (movable member) as a roller, it is possible to make it practically strong against abrasion. Further, the roller main body 94*b* itself may be made of a metal, or the roller main body 94*b* may have a metallic surface such as a metallic sleeve or a belt, so that the abutting member 94A can be more resistant to abrasion. In addition, by making the roller main body 94*b* detachable and replaceable, even if a movable member such as a roller is worn out, the function can be recovered by replacement, so that the function of the abutting member 94A can be maintained over a long period of time.

(Effect 13) Further, the abutting member 94 may be a projecting member provided so as to protrude toward the inside of the housing unit 11. In this manner, by forming the abutting member 94 as a convex shaped member, the above-described operation and effect can be obtained.

(Effect 14) In the state in which the looseness of the wire 3 occurs, the feeding direction 88 of the wire 3 by the feeding unit 16 or the pulling back direction 85 is directed in the direction of the tangent to the virtual circle 95 set at the maximum diameter portion of the reel 12 or in the vicinity thereof. This makes it possible to bring the feeding direction 88 of the wire 3 and the pulling back direction 85 by the feeding unit 16 close to the direction of the entering route 81 of the wire 3 from the reel 12 to the feeding unit 16 within a reasonable range. As a result, it becomes easy to install the abutting member 94 at a position effective for both of the restriction unit 83 and 87.

Further, at least one abutting member 94 was placed at the position of the contact point between the tangent line and the virtual circle 95 or in the vicinity thereof.

When the wire 3 is pulled back by the feeding unit 16, the pullback wire 3 (the drawn-out section 3*a*) bulges so as to expand the winding of the wire 3 with respect to the reel 12 inside the reel housing unit 11*a* (see the portion 131 in FIG. 1). Then, the bulge tends to loosen so that the bulge propagates from the side closer to the reel 12 inside the wire passage 11*b* toward the feeding unit 16.

Therefore, the abutting member 94 is arranged at the position of the contact point between the feeding direction 88 of the feeding unit 16 and the virtual circle 95 or in the vicinity thereof in the state in which the looseness of the wire 3 has occurred, so that the looseness of the wire 3 inside the wire passage 11*b* can be restricted at an early stage, which is effective. Moreover, the number of the abutting members 94 to be installed can be small.

Further, by arranging the abutting member 94 at the position of the contact point between the feeding direction 88 of the feeding unit 16 and the virtual circle 95 or in the vicinity thereof, when the wire 3 pulled back toward the reel 12 by the feeding unit 16 is swollen forward and loosened, the wire 3 can be separated from the front wall 91*a* of the protective case 91 so that the wire does not come into close contact with the front wall 91*a* of the protective case 91 or the like.

(Effect 15) If the wire 3 is pulled back by reversing the feeding unit 16, the wire 3 pulled back toward the reel 12 (the drawing portion 3 thereof) largely bulges toward the front side of the entering route 81 as described above. Moreover, when there is no space to be swollen due to contact with the front wall 91*a*, now it bends so as to meander toward the rear side of the entering route 81. Finally, troubles such as buckling of the wire 3 and jumping out from the housing unit 11 occur.

Therefore, the third restriction unit 96 is provided at the rear side position of the entering route 81 of the wire 3 when the wire 3 is guided to the feeding unit 16. Thereby, the deformation of the wire 3 at the rear side of the entering route 81 can be directly restricted by the third restriction unit 96. Therefore, the rearward bending of the wire 3, the buckling of the wire 3 due to this bending, and the jumping out of the housing unit 11 can be reliably prevented by the third restriction unit 96.

(Effect 16) The third restriction unit 96 is a pressing rib extending from the side wall 91*c* of the housing unit 11 (protective case 91). Thereby, the third restriction unit 96 is provided in the housing unit 11, and the above-described action and effect can be reliably obtained by the third restriction unit 96.

Although the embodiments have been described in detail with reference to the drawings, the embodiments are merely illustrative. Therefore, the present invention is not limited only to the embodiments, and design or the like can also be changed within a range not deviating from the gist. Further, for example, in the case where each of the embodiments includes a plurality of configurations, a possible combination of these configurations is naturally included if not specifically mentioned. In addition, in the case where a plurality of embodiments and modifications are disclosed, combinations of configurations spanning these ranges can be naturally included even if not specifically mentioned. In addition, the constitution depicted in the drawings is naturally included even if not particularly mentioned. Furthermore, the term "etc." is used in the sense that it includes equivalent ones. In addition, when there are terms such as "almost", "about", "degree", etc., they are used in the sense that they include ranges and precision that are commonly accepted.

Hereinafter, a second embodiment of the binding machine according to the present invention will be described with reference to the drawings.

Example 2

In the present invention, this example is applied to a reinforcing bar binding machine (binding machine) that binds and fixes parallel or intersecting reinforcing bars to each other.

Figure 26:
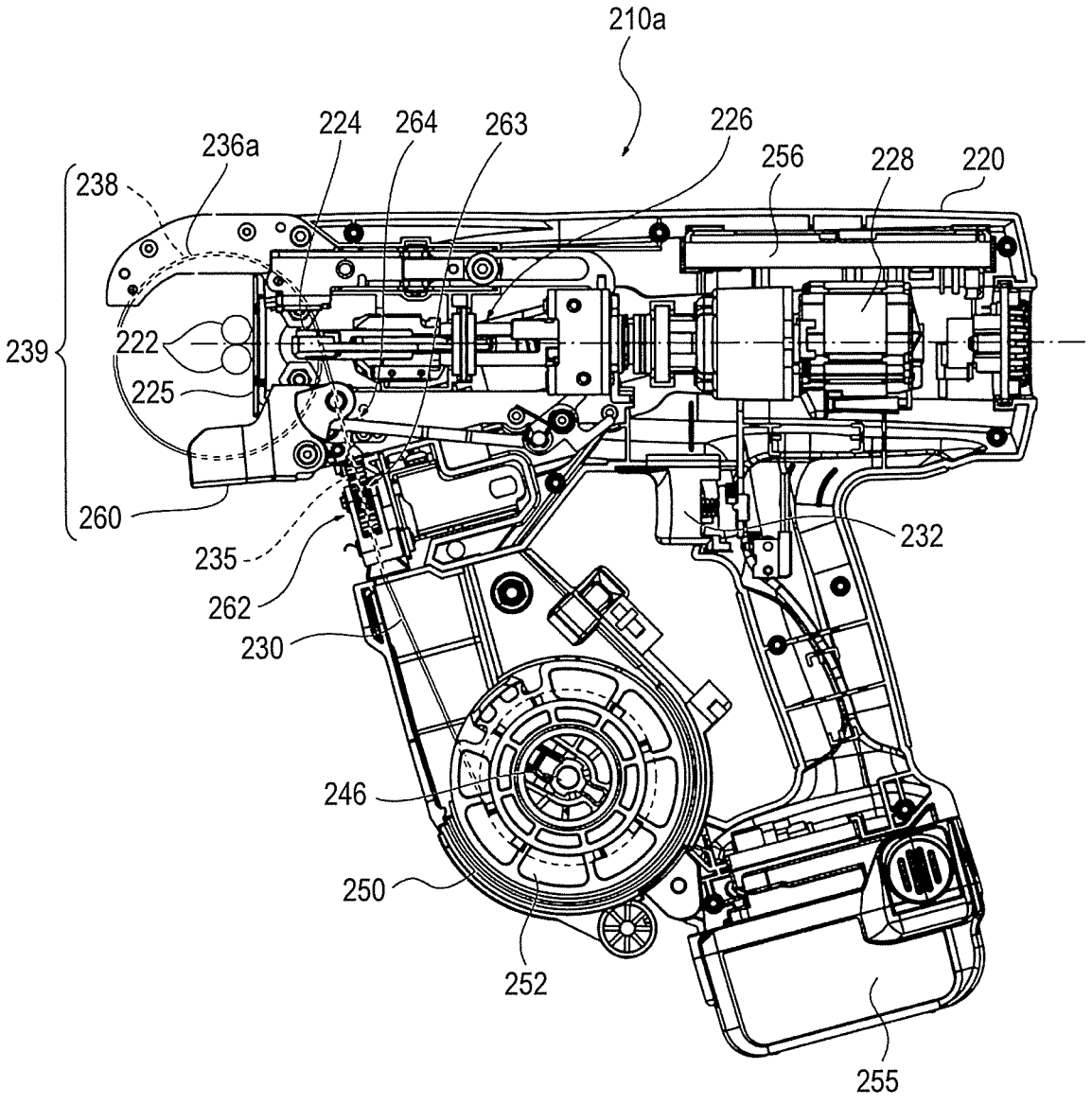
FIG. 26 is a partial cross sectional view illustrating a schematic structure and operation outline of a reinforcing bar binding machine according to Example 2 which is a specific embodiment of the present invention.

First, with reference to FIG. 26, a schematic structure of the reinforcing bar binding machine 210*a* in Example 2 will be described. As illustrated in FIG. 26, a magazine 250 is provided on the lower side of the binding machine main body 220. Inside the magazine 250, for example, a wire reel 252 around which a wire 230 made of an iron wire having a diameter of about 1 mm is wound is rotatably attached to a mounting shaft 246. The wire 230 wound around the wire reel 252 is fed from the magazine 250 to the upper binding machine body 220 by the wire feeding unit 262.

A curve forming portion 239 for plastically deforming the wire 230 so as to draw a circular arc is provided above the wire feeding unit 262. The curve forming portion 239 includes a curl arm 238 having a groove-shaped passage 236*a* curved in an arc shape which is arranged along a path through which the wire 230 passes, and a curl guide 260 for picking up the distal end of the wire plastically deformed in circular arc shape when passing through the curl arm 238.

A twisting hook 226 having a wire insertion groove 224 at the distal end portion is installed between the curl arm 238 and the curl guide 260. The reinforcing bar binding machine 210*a* is inserted between the curl arm 238 and the curl guide 260 so as to straddle the reinforcing bar 222 as a body to be bound, and the reinforcing bar 222 is held in a state of being in contact with the abutting portion 225, thereby binding the reinforcing bar 222.

The twisting hook 226 can be rotated by a twisting motor 228. The twisting hook 226 stands by at a position away from the wire 230, by directing the wire insertion groove 224 in a direction orthogonal to the direction of the loop of wire 230, thereby the wire 230 plastically deformed in a loop shape can be easily inserted into the wire insertion groove 224 at the standby time before the rotation start of the twisting motor 228

Inside the binding machine main body 220, a gear drive motor 241 (FIG. 28) is installed in addition to the twisting motor 228. These motors are powered by a rechargeable battery built in the battery pack 255. The forward rotation, reverse rotation and stop of the twisting motor 228, and forward rotation, reverse rotation, and stop of the gear drive motor 241 are conducted by the operation of the trigger 232. Operation control of the twisting motor 228 and the gear drive motor 241 is performed by the control unit 256 built in the binding machine main body 220.

The gear drive motor 241 (FIG. 28) is rotatable in both forward and reverse directions. When the gear drive motor 241 rotates forward (clockwise in FIG. 28), the wire 230 is fed to the upper side of the binding machine body 220 and wound around the reinforcing bar 222. Thereafter, when it is detected that the wire 230 has been withdrawn for a predetermined length by the delivery amount detection unit (not illustrated), the gear drive motor 241 is rotated reversely (counterclockwise in FIG. 28) after grasping the distal end of the wire, and the wire 230 is pulled back toward the wire reel 252, and then the gear drive motor 241 is stopped. Then, the twisting motor 228 is rotated, whereby the wire 230 wound around the reinforcing bar 222 is twisted to bind the reinforcing bar 222. Detailed operation will be described later.

The wire 230 wound around the wire reel 252 is fed to the curl arm 238 by the wire feeding unit 262. A wire cutting portion 264 described below is provided in the middle of a passage (wire passage 235) of a wire 230 provided between the wire feeding unit 262 and the curl arm 238.

Next, with reference to FIG. 27, a detailed structure of the wire cutting portion 264 in the reinforcing bar binding machine 210*a* will be described.

Figure 27:
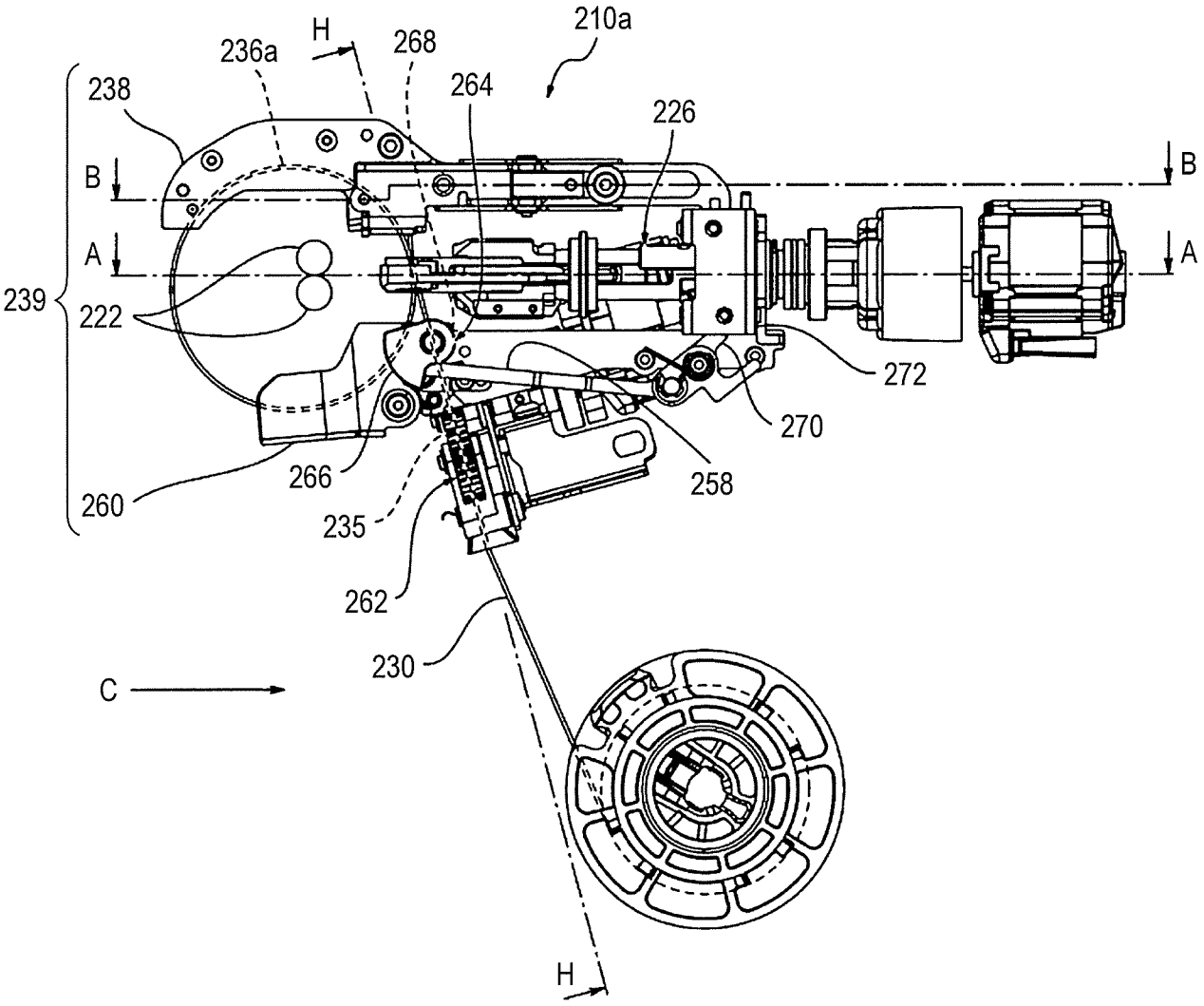
FIG. 27 is a structural view illustrating the main internal structure of the reinforcing bar binding machine illustrated in FIG. 26.

FIG. 27 is a structural diagram illustrating the main internal structure of the reinforcing bar binding machine 210*a*. As illustrated in FIG. 27, a movable cutter 266 connected to one end of the cutter connecting rod 258, and a fixed cutter 268 installed with the wire path 235 sandwiched between the movable cutter 266 in FIG. 27 are disposed facing each other at the rear end of the curl guide 260. The movable cutter 266 and the fixed cutter 268 constitute a wire cutting portion 264 including a pair of cutting blades described above.

The other end of the cutter connecting rod 258 is connected to a cutter lever 270 rotatably installed with respect to the curl guide 260. The cutter lever 270 is movable in a direction in which the cutter connecting rod 258 moves forward and backward according to the back and forth motion of the cutter ring 272 installed at the rear side of the twisting hook 226. In accordance with the motion of the cutter lever 270, the movable cutter 266 connected to the cutter connecting rod 258 rotates and is brought into sliding contact with a fixed cutter 268, whereby the wire 230 is cut.

Next, with reference to FIGS. 28 and 29, the detailed structure of the wire feeding unit 262 will be described. FIG.

Figure 28:
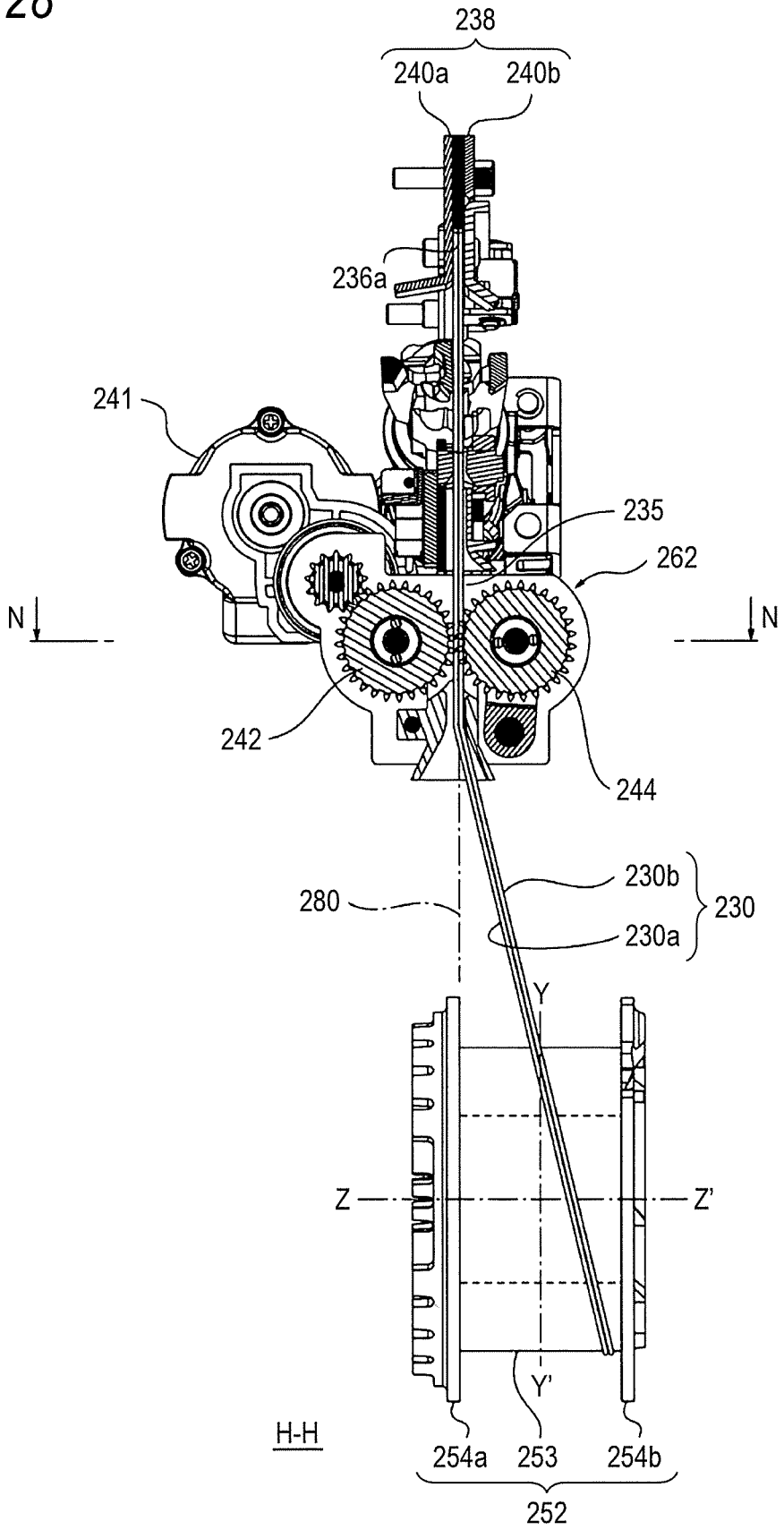
FIG. 28 is a cross sectional view taken along line H-H of FIG. 27, illustrating the detailed structure of the wire feeding unit.
Figure 29:
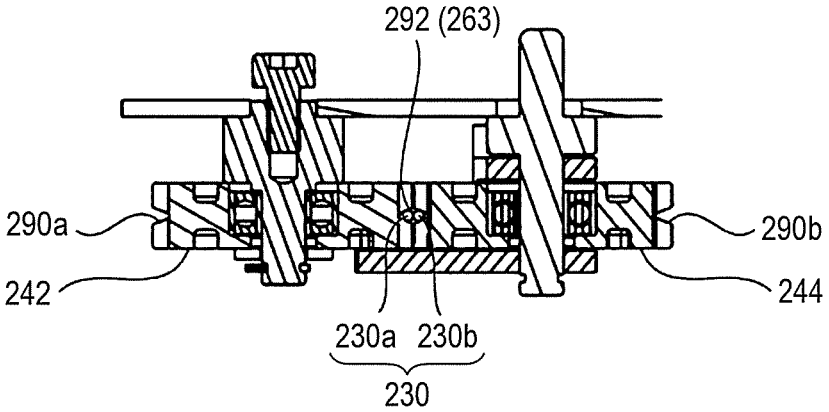
FIG. 29 is a cross sectional view taken along line N-N of FIG. 28 illustrating the detailed structure of a feed gear.

28 is a cross-sectional view taken along the line H-H in FIG. 27, and FIG. 29 is a cross sectional view taken along the section line N-N in FIG. 28.

Between the curl arm 238 and the wire reel 252 is provided a wire feeding unit 262 for feeding the wire 230 wound around the wire reel 252 toward the curl arm 238. A portion from the wire feeding unit 262 to the wire passage 236*a* provided in the curl arm 238 is a wire passage 235 allowing passage of the wire. In addition, in Example 2, the wire 230 is fed almost simultaneously as a pair of wires 230*a* and 230*b* (double wire).

The wire feeding unit 262 is provided with a drive feed gear 242 that is rotated in a direction along the feeding direction of the wires 230 (230*a*, 230*b*) by transferring the driving force from the gear drive motor 241, and a driven feed gear 244 that meshes with the drive feed gear 242. As illustrated in FIG. 29, a cutout portion 290*a* is provided in the central portion of the tooth tip of the drive feed gear 242. Further, a cutout portion 290*b* is provided in the central portion of the tooth tip of the driven feed gear 244. These cutouts 290*a* and 290*b* form an opening 292 having a size in which the wires 230 (230*a* and 230*b*) are inscribed when the drive feed gear 242 and the driven feed gear 244 mesh with each other.

The wire 230 (230*a*, 230*b*) is clamped while being subjected to a pressing force by the notch 290*a* of the drive feed gear 242 and the cutout 290*b* of the driven feed gear 244. Therefore, when the gear drive motor 241 rotates forward (clockwise in FIG. 28), it is fed to the upper side of the binding machine body 220 by a frictional force. Further, when the gear drive motor 241 rotates in the reverse direction (counterclockwise in FIG. 28), it is pulled back to the lower side of the binding machine body 220 by the frictional force.

As illustrated in FIG. 28, the center line of the curl arm 238 coincides with the meshing position of the drive feed gear 242 and the driven feed gear 244. The wire 230 fed from the wire feeding unit 262 is plastically deformed to draw an arcuate locus when passing through the curl arm 238. That is, it is curbed so as to form a curl. The plane formed by a circular arc of the wire 230 shaped in the curl arm 238 (the plane including an arc of the wire 230 and a center of the circular arc) is referred to as a virtual plane 280 in this specification. Specifically, the virtual plane 280 is a plane that passes between the first wall portion 240*a* or the second wall portion 240*b* forming the curl arm 238, and is substantially a plane parallel to the inner wall surface of the first wall portion 240*a* and the second wall portion 240*b* and passing through the middle of the two wall surfaces.

The wire reel 252 includes a cylindrical hub 253 around which the wire 230 is wound, and a pair of disc shaped first flange portions 254*a* and second flange portions 254*b* provided on both sides of the hub 253, respectively. The wire reel 252 is made of a plastic such as ABS resin, polyethylene, polypropylene or the like which is highly resistant to abrasion and bending.

Further, as illustrated in FIG. 28, the center position (line Y-Y') of the hub 253 of the wire reel 252 is arranged at a position offset in the Z' direction at the axial center (line Z-Z') of the wire reel 252 with respect to the virtual plane 280. By arranging the curl arm 238 and the wire reel 252 in such a positional relationship, it is possible to suppress variations in the deflection direction of the wire 230 sent out from the curl arm 238. Details will be described later.

Next, the detailed structure of the twisting hook 226 will be described with reference to FIG. 30.

Figure 30:
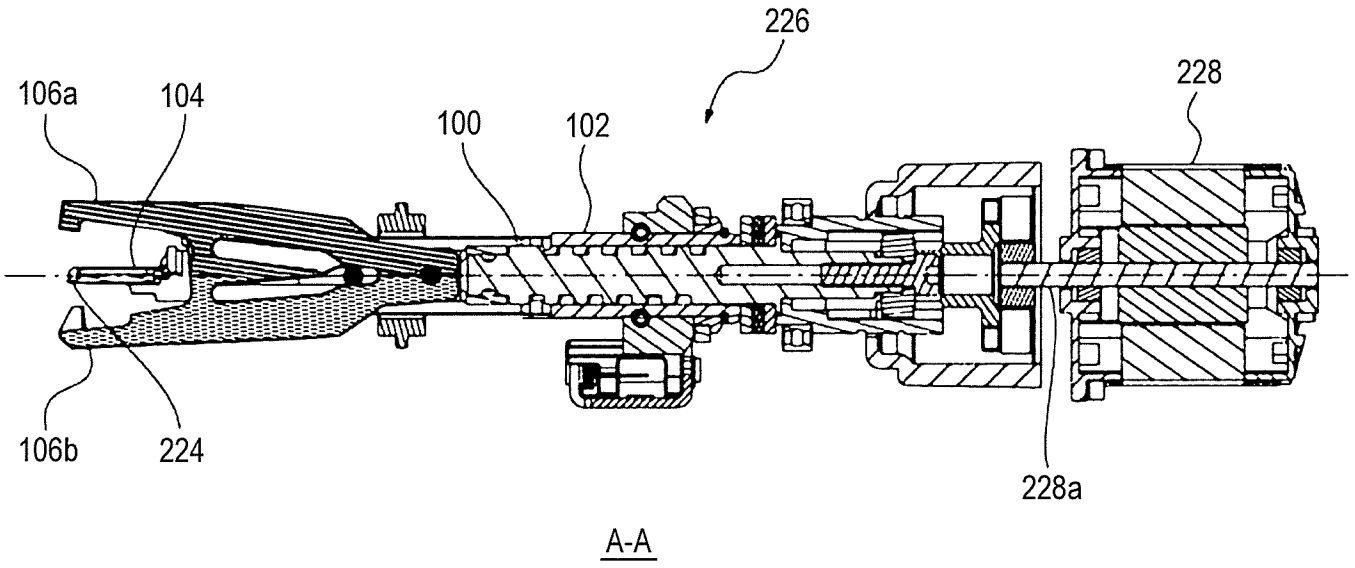
FIG. 30 is a cross sectional view taken along line A-A of FIG. 27 illustrating the detailed structure of a torsion hook.

FIG. 30 is a cross-sectional view taken along the section line A-A of FIG. 27. As illustrated in FIG. 30, the twisting hook 226 includes a twisting motor 228, a distal end shaft 100 attached to the rotation shaft 228*a* of the twisting motor 228, a cylindrical sleeve 102 guided to the distal end shaft 100, a front end shaft 100, and a center hook 104 and a pair of hook L106*a*, hooks R106*b* provided in the end portion of the distal end shaft 100.

The sleeve 102 advances toward the pair of hooks L106*a* and the hook R106*b* or retreats in the opposite direction, in response to the rotation direction of the distal end shaft 100.

At the distal end of the center hook 104, a wire insertion groove 224 is formed. The sleeve 102 advances toward the distal end side of the pair of hooks L106*a* and hook R106*b*, or moves backward in the opposite direction. Then, when the sleeve 102 advances toward the distal ends of the pair of hooks L106*a* and R106*b*, the wire 230 (230*a*, 230*b*) not illustrated in FIG. 30 is locked in the wire insertion groove 224 to some extent in a free state. Further, when the center hook 104 retracts, the wires 230 (230*a* and 230*b*) not illustrated in FIG. 30 are detached from the wire insertion groove 224.

The pair of hooks L106*a* and the hook R106*b* perform an opening and closing operation in conjunction with the movement of the sleeve 102. That is, when the distal end shaft 100 rotates and the sleeve 102 moves backward, the hook L106*a* and the hook R106*b* are opened. On the other hand, when the distal end shaft 100 rotates and the sleeve 102 moves forward, the hook L106*a* and the hook R106*b* are closed.

Figure 31:
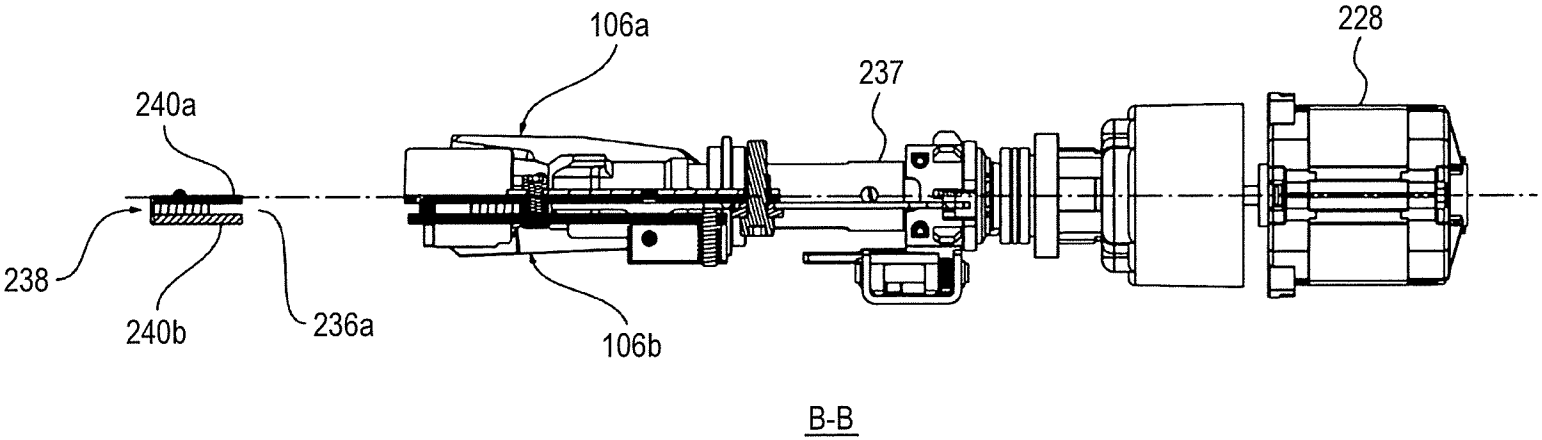
FIG. 31 is a cross sectional view taken along line B-B of FIG. 27 illustrating the detailed structure of a curl arm.

FIG. 31 is a cross-sectional view of FIG. 27 taken along the section line B-B. As illustrated in FIG. 31, there are provided with a first wall portion 240*a* configuring one of the curl arms 238 and a second wall portion 240*b* configuring the other of the curl arms 238. The narrow passage provided between these two wall portions forms the wire passage 236*a*.

Figure 32:
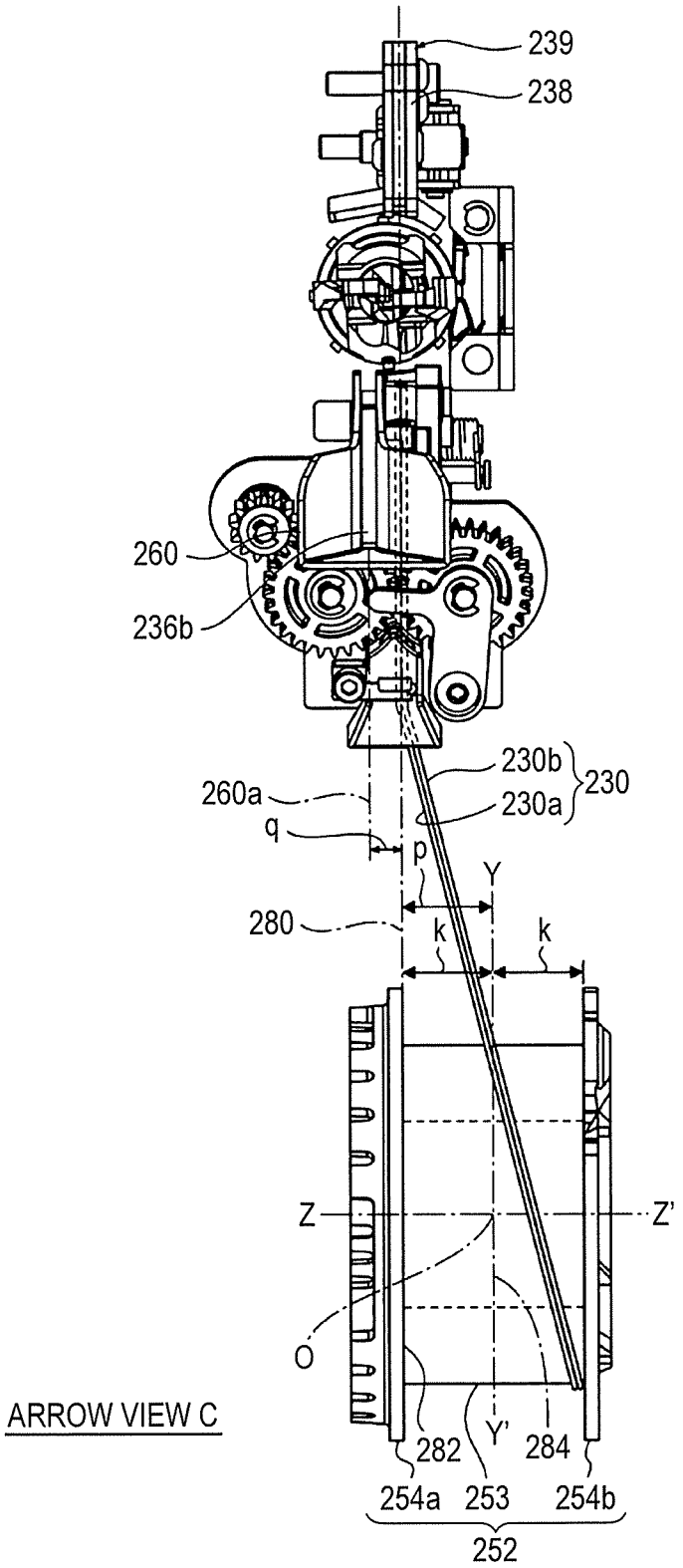
FIG. 32 is a side view of FIG. 27 seen from the direction of arrow C.

Next, with reference to FIG. 32, the layout of the curl guide 260 and the wire reel 252 in Example 2 will be described. FIG. 32 is a side view of a main part of the reinforcing bar binding machine 210*a* illustrated in FIG. 27 as seen from the direction of the arrow C.

As illustrated in FIG. 32, the virtual plane 280 is disposed at a position offset from the virtual plane 280 with respect to a virtual cut plane 284 (a plane including line Y-Y') obtained by cutting the center O of the core of the wire reel 252 in a direction substantially orthogonal to the axis of the hub 253 (line Z-Z'). In other words, the virtual cutting surface 284 of the wire reel 252 is disposed at a position offset from the virtual plane 280. In this example, the virtual plane 280 is formed so as to coincide with the virtual cut plane 282 when it is cut in a direction substantially orthogonal to the axial center (line Z-Z') of the hub 253 at the axial end of the hub 253. This is a state in which the virtual plane 280 is disposed at approximately the same position as the inner surface of the first flange portion 254*a* and is cut in a direction substantially orthogonal to the axial center of the hub at the intermediate position between the virtual plane 280 and the hub 253. This is the case where the distance p from the virtual cut plane coincides with a half (length k) of the entire axial length of the hub 253.

Further, the wire passage 236*b* provided at the center position 260*a* of the curl guide 260 through which the picking-up wire 230 (230*a*, 230*b*) passes is offset and disposed in a direction opposite to the offset direction of the position of distance q from the virtual plane 280, that is, the center position (line Y-Y') of the wire reel 252 with respect to the virtual plane 280. The distance q (offset amount) from the virtual plane 280 of the curl guide 260 is appropriately set at a position where the curl guide 260 can reliably pick up the wire 230 (230*a*, 230*b*) sent out from the curl arm 238.

Next, with reference to FIGS. 33A to 33E, the operation of the reinforcing bar binding machine 210*a* in Example 2 will be explained step by step. Further, FIGS. 33A to 33E modifies and illustrates FIG. 27, respectively, so that the states of the reinforcing bar binding machine 210*a* in each operation phase are clearly illustrated.

Figure 33A:
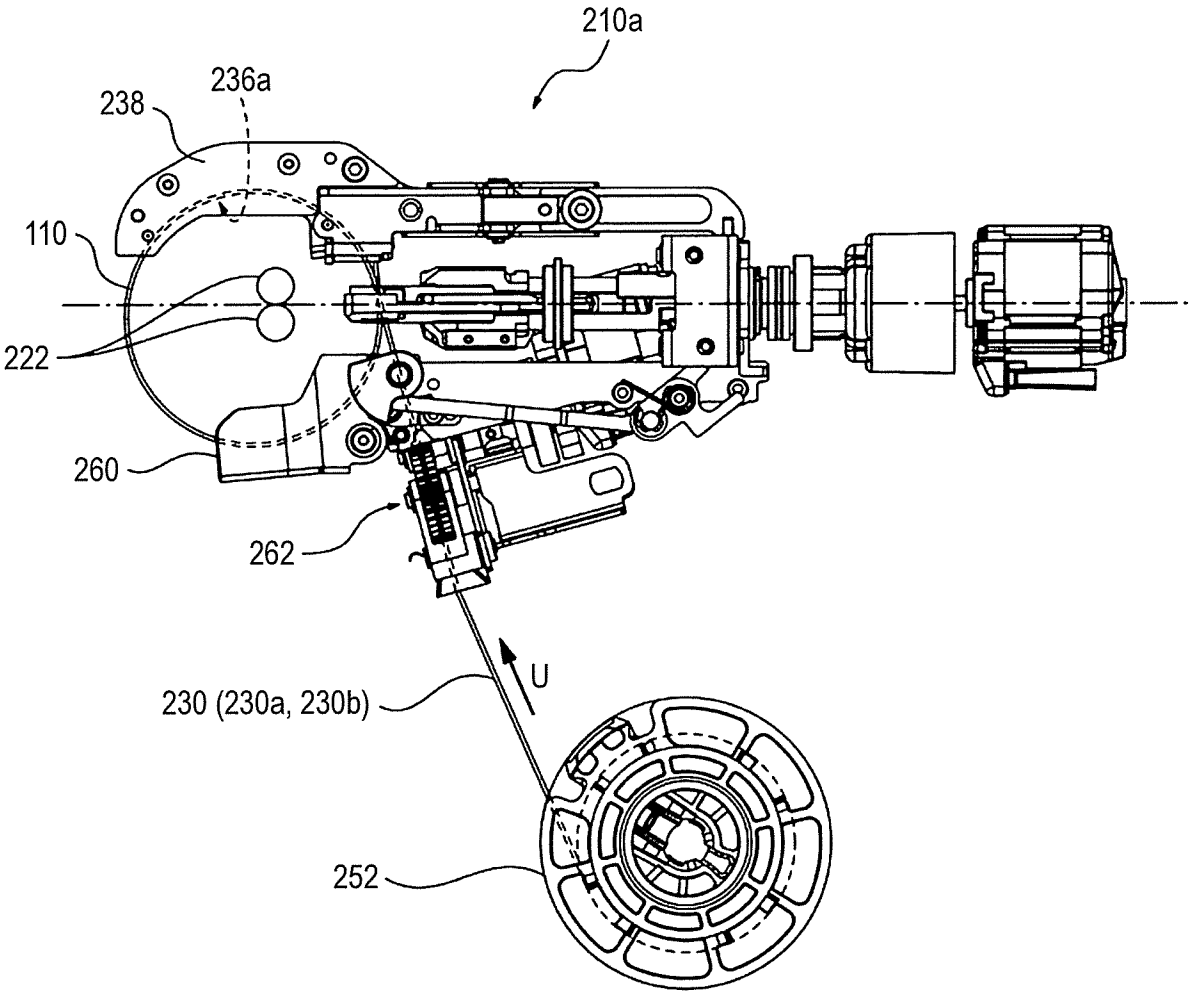
FIG. 33A is a view for explaining the action of the wire feeding operation of the reinforcing bar binding machine.

FIG. 33A is a view for explaining the wire feeding operation of the reinforcing bar binding machine 210*a*. When the trigger 232 (FIG. 26) is operated, the gear drive motor 241 (FIG. 28) rotates in the forward direction (counterclockwise in FIG. 28) and the wire 230 (230*a*, 230*b*) is drawn out from the wire reel 252, and is drawn out in the direction of the arrow U by the wire feeding unit 262. Then, the wires 230 (230*a*, 230*b*) are plastically deformed in an arc shape by the arcuate groove provided in the curl arm 238 to be curled.

After passing through the curl arm 238, the wire 230 (230*a*, 230*b*) fed from the wire feeding unit 262 by a predetermined length is picked up by the curl guide 260. Then, the loop 110 of the wire 230 is formed around the reinforcing bar 222 (the body to be bound) sandwiched between the curl arm 238 and the curl guide 260.

Figure 33B:
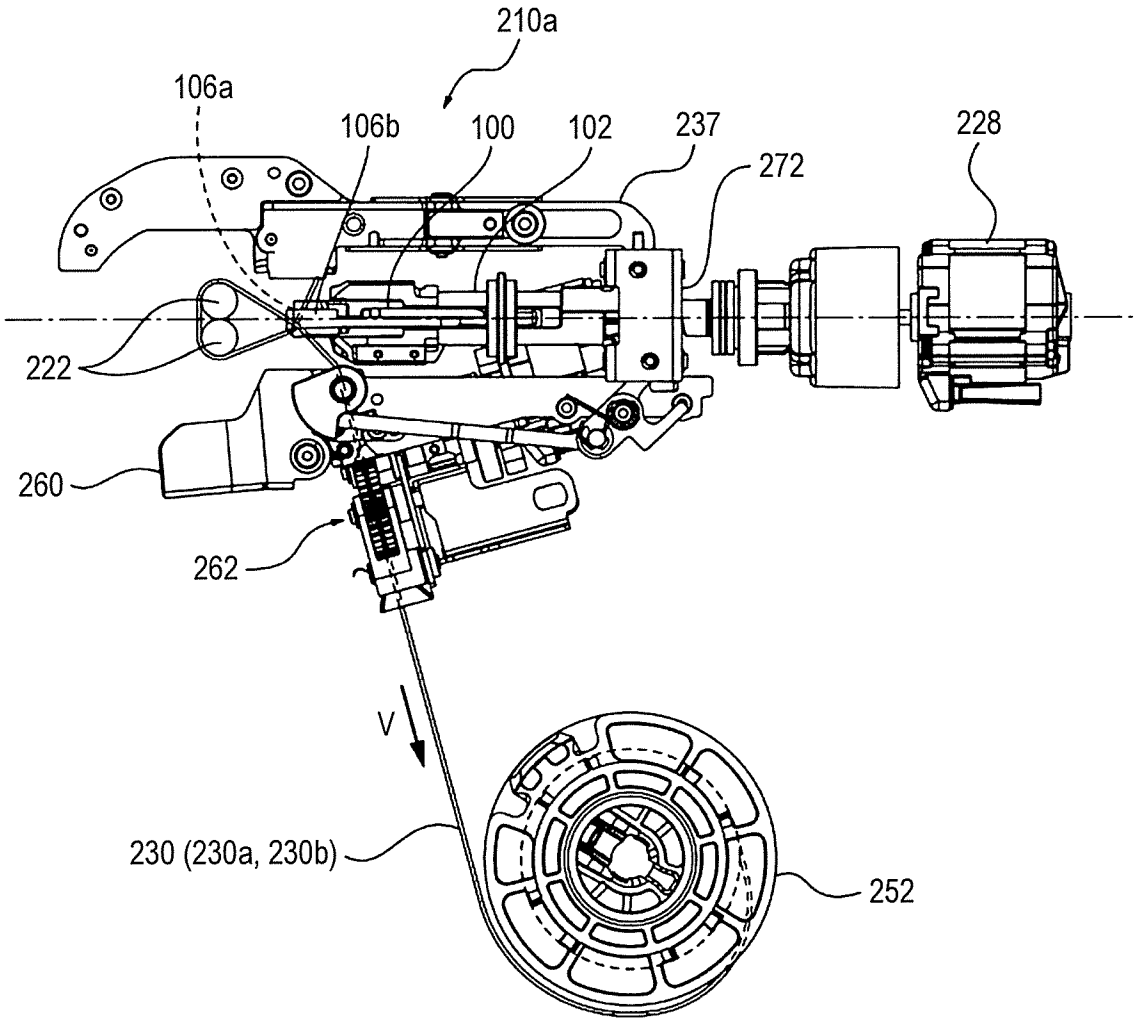
FIG. 33B is a view for explaining the action of the wire retraction operation of the reinforcing bar binding machine.

FIG. 33B is a view for explaining the wire retracting operation of the reinforcing bar binding machine 210*a*. After completing the wire feeding operation illustrated in FIG. 33A, the distal end shaft 100 rotates by the action of the twisting motor 228, and the sleeve 102 moves forward in the direction of the reinforcing bar 222, and the hook L106*a* and the hook R106*b* (FIG. 30) are closed. Then, the wire 230 (230*a*, 230*b*) is gripped only on the side of the hook L106*a*.

Then, the gear drive motor 241 (FIG. 28) rotates in the reverse direction (clockwise in FIG. 28), and the wire 230 is pulled back in the direction of the wire reel 252 (direction of arrow V) by the wire feeding unit 262. By this pull back operation, the wire 230 is wrapped around the reinforcing bar 222 (the body to be bound).

For gripping of the wire 230, it may be only one side of the hook L106*a* or hook R106*b*, between the center hook 104 and the hook L106*a*, or between the center hook 104 and the hook R106*b*.

Figure 33C:
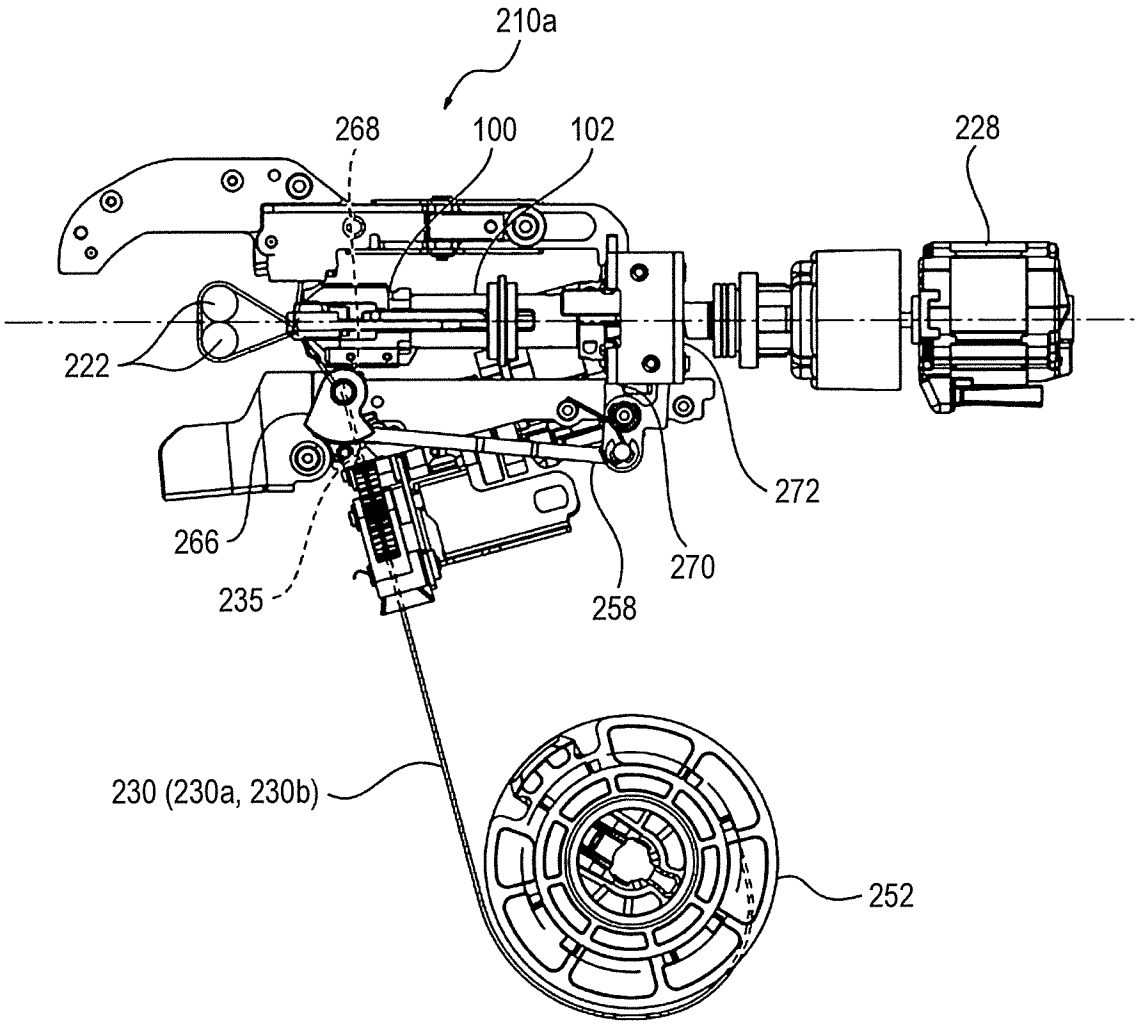
FIG. 33C is a view for explaining the action of the wire cutting operation of the reinforcing bar binding machine.

FIG. 33C is a view for explaining the wire cutting operation of the reinforcing bar binding machine 210*a*. When the distal end shaft 100 rotates and the sleeve 102 moves forward in the direction of the reinforcing bar 222, the cutter lever 270 is rotated by the cutter ring 272 interlocked with the sleeve 102.

Then, the movable cutter 266 is rotated by the link mechanism of the cutter lever 270 and the cutter connecting rod 258, and the wire 230 (230*a*, 230*b*) in the wire passage 235 is sandwiched and cut between the movable cutter 266 and the fixed cutter 268.

Figure 33D:
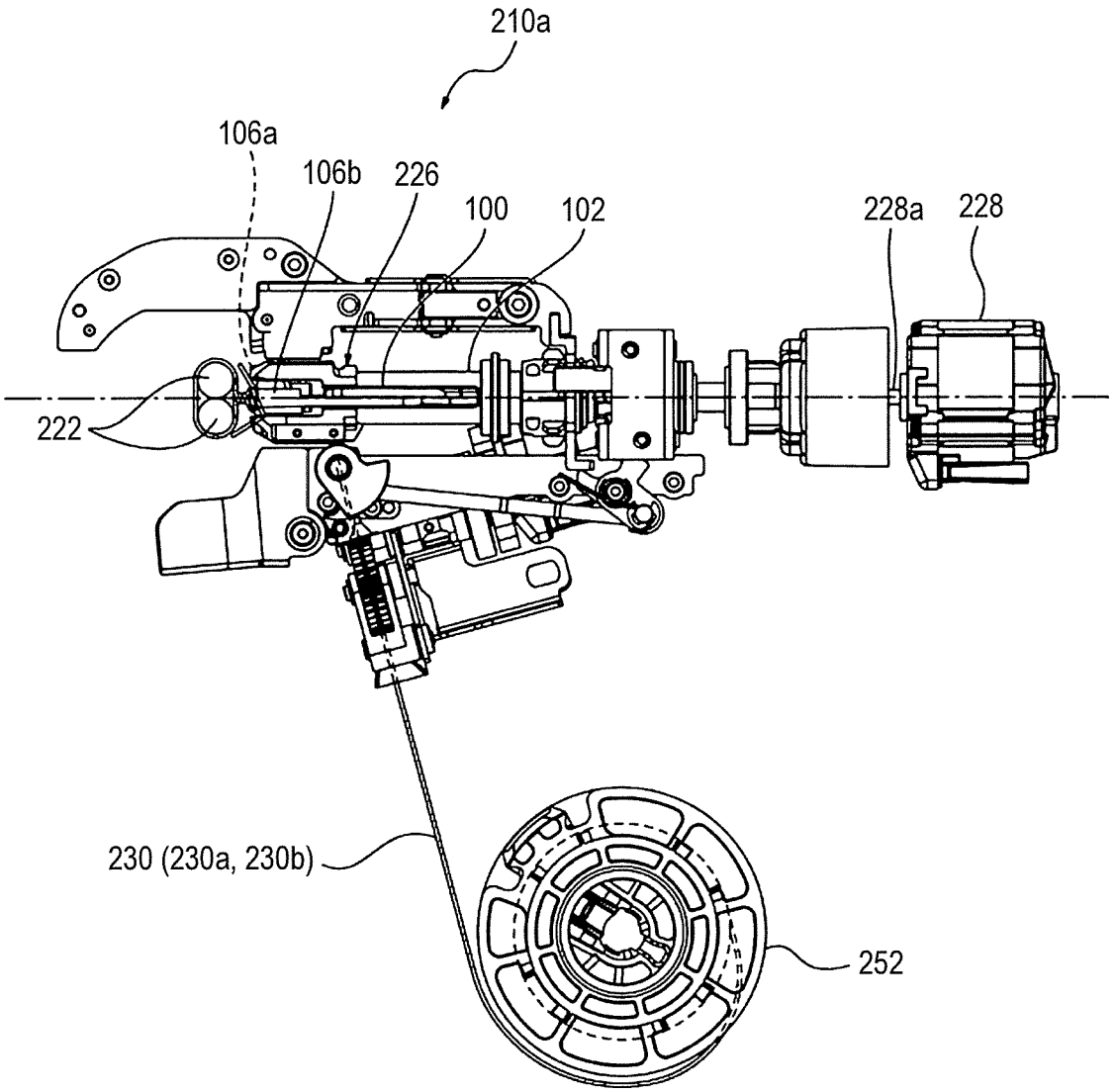
FIG. 33D is a view for explaining the action of the wire twisting operation of the reinforcing bar binding machine.

FIG. 33D is a view for explaining the wire twisting operation of the reinforcing bar binding machine 210*a*. The sleeve 102 moves forward in the direction of the reinforcing bar 222, and the wire 230 is bent toward the reinforcing bar 222 (body to be bound) with the walls on the front end side of the hook L106*a* and the hook R106*b*.

When the sleeve 102 further advances, the restriction of the rotation direction of the sleeve 102 is released and the sleeve 102 rotates together with the distal end shaft 100 around the rotation shaft 228*a* of the twisting motor 228. Then, the twisting hook 226 rotates while gripping the wire 230 (230*a*, 230*b*), and twists the wire 230.

Figure 33E:
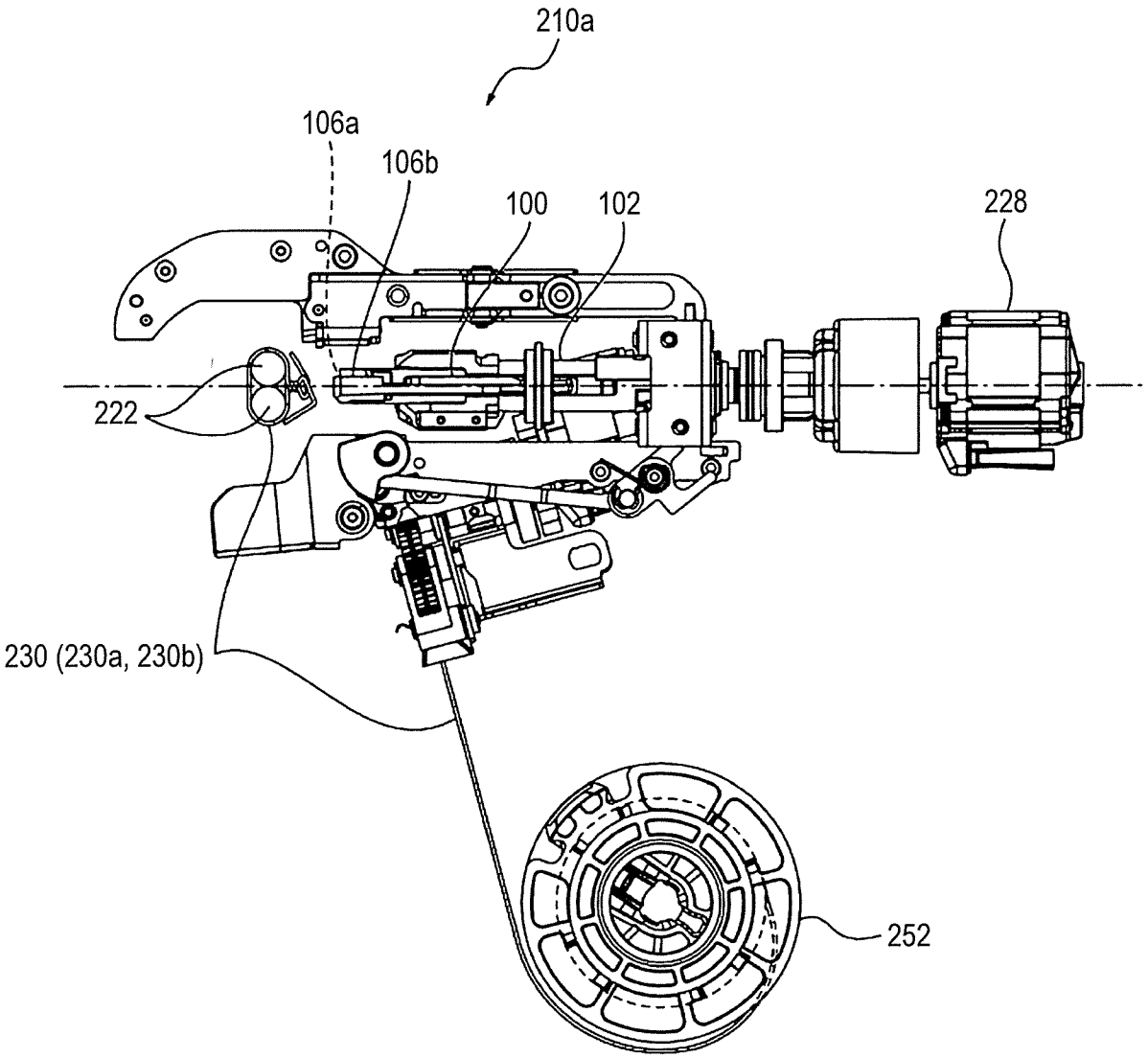
FIG. 33E is a view for explaining the action of the wire separating operation of the reinforcing bar binding machine.

FIG. 33E is a view for explaining the wire separating operation of the reinforcing bar binding machine 210*a*. When the twisting motor 228 rotates in the reverse direction and the distal end shaft 100 rotates in a direction opposite to that in the twisting operation, the sleeve 102 moves backward in a direction away from the reinforcing bar 222.

Thereafter, as the sleeve 102 moves backward, the hooks L106*a* and the hooks R106*b* are opened, and the gripping of the wires 230 (230*a* and 230*b*) is released. As a result, the binding operation of the reinforcing bars 222 (bodies to be bound) is completed.

Next, with reference to FIGS. 34A and 34B, the picking-up action of the wire 230 in the reinforcing bar binding machine 210*a* of the second embodiment will be described.

Figure 34A:
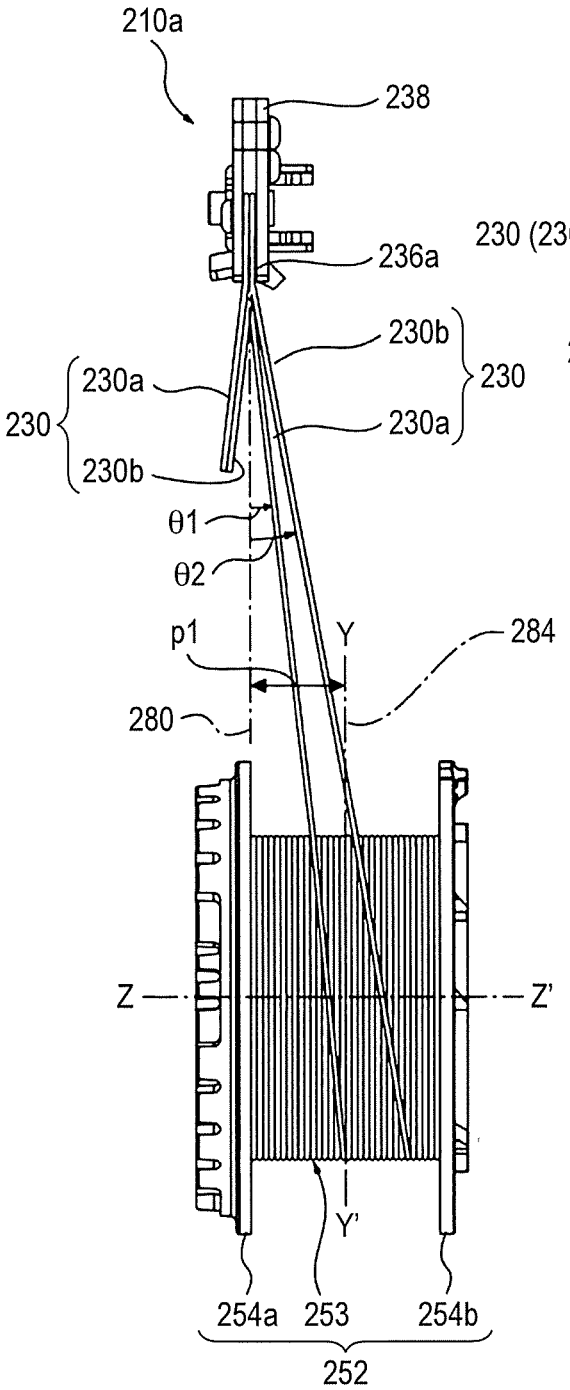
FIG. 34A is a view illustrating the positional relationship between a wire reel and a curl guide of the reinforcing bar binding machine according to Example 2.

FIG. 34A is a side view of FIG. 27 as viewed in the direction of arrow C, and is an explanatory view illustrating a positional relationship between the wire reel 252 and the curl arm 238 of the reinforcing bar binding machine 210*a* in Example 2. Referring to FIG. 34A, the wire 230 (230*a*, 230*b*) actually enters the curl arm 238 via the wire feeding unit 262 (FIG. 28). However, in order to simplify the explanation, the wire feeding unit 262 is omitted. In addition, the curl guide 260 is also omitted. FIG. 34B is a side view of FIG. 27 as viewed from the direction of the arrow C, illustrating the positional relationship between the distal end shaft 100 and the virtual plane 280 of the twisting hook 126 and the curl guide 260.

As the wire 230 (230*a*, 230*b*) is repeatedly fed and pulled back, looseness is generated in the wire 230 (230*a*, 230*b*), so that the aligned state of the wire 230 wound around the wire reel 252 collapses. This is because the wire 230 wound so as to be in close contact with the hub 253 gradually becomes loose as feeding and pulling back are repeated, and a part of the wire 230 to be pulled back enters the curl arm 238 to form an arcuate deformation. When looseness occurs in the wound wire 230 wound in this manner, the drawn-out positions of the wires 230*a* and 230*b*, which are the double wires, are different from each other. FIG. 34A illustrates angles θ1 and θ2 formed by the wires 230*a* and 230*b* with different pulling-out positions and the virtual plane 280 when the wire feeding unit 262 performs the feeding operation.

When the wire 230 (230*a*, 230*b*) enters the curl arm 238 from one side of the virtual plane 280 via the wire feeding unit 262 with the above-mentioned angle θ1, θ2, the wire 230 (230*a*, 230*b*) is discharged from the distal end of the curl arm 238 toward the other side of the virtual plane 280. That is, when entering the curl arm 238 with angles θ1 and θ2 from the Z' side as viewed from the front side orthogonal to the virtual plane 280, the traveling direction is changed by the curl arm 238 along the virtual plane 280 (formed in a curve) and discharges the wire 230 with an angle toward the opposite side Z.

Further, in the example illustrated in FIG. 34A, the angle θ2 formed by the wire 230*b* is larger than the angle θ1 formed by the wire 230*a*. However, the difference between the angles of the wire 230*a* and the wire 230*b* after passing through the curl arm 238 is smaller than the angle difference (the difference between θ1 and θ2) on the penetration side with respect to the virtual plane 280. That is, even if the angle on the penetration side with respect to the virtual plane 280 is large at the discharge side after passing through the curl arm 238, the angle to the penetration side does not become large. Further, the wire penetrated from one side of the virtual plane 280 is discharged only to the other side of the virtual plane 280, and is not discharged to the side that is penetrated. This means that the range to be discharged is narrowed.

As described above, when the wire 230 enters the curl arm 238 from the side biased towards one side with respect to the virtual plane 280, the wire 230 is discharge in a state in which bias is reduced toward the opposite side of the virtual plane 280. Therefore, by arranging the hub of the wire reel 252 at a position biased from the virtual plane 280, it is possible to converge the arrival position of the wire 230 to a proper range after passing through the curl arm 238 to a certain range.

When the offset amount p1 illustrated in FIG. 34A is 0, the virtual plane 280 and the center position of the hub 253 coincide with each other, and thus the wire is discharged in the front and back directions of the virtual plane 280 as described above. There is a tendency that the range where the distal end of the wire reaches becomes wider. On the other hand, as the offset amount p1 illustrated in FIG. 34A increases, the range where the distal end of the wire gradually arrives tends to become narrower.

As described above, even if the incident angle of the wire 230 with respect to the virtual plane 280 increases, the discharge angle from the curl arm 238 does not increase so much. This is presumed to be one of the reasons described below.

That is, when the wire 230 penetrate into the curl arm 238, a deforming force such as bending of the wire 230 is applied in the middle of the movement path according to the magnitude of the penetration angle. However, even if the wire 230 deforms due to this deforming force, since the wire passage 236*a* of the curl arm 238 is formed to have a narrow width, it is considered that the function of correcting the bending of the wire occurs. Since this correcting action strongly acts according to the increase in the angle of the penetrating wire, the correction force itself also strongly works when the angle of penetration increases, as a result, it is considered that the output angle from the curl arm 238 does not increase greatly as the approach angle increases.

On the other hand, as in comparative examples described with reference to FIGS. 36A and 36B, when the hub 253 of the wire reel 252 is present on the center line (virtual plane 280) of the curl arm 238 as viewed from the front side orthogonal to the virtual plane 280, the incident angle to the virtual plane 280 becomes shallow, so the correction force of the angle by the curl arm 238 is not strong. Therefore, the discharge angle of the wire tends to fluctuate according to the incident angle to the virtual plane 280. When comparing such a specification that the center line (substantially virtual plane 280) of the curl arm 238 passes through the hub 253 of the wire reel 252, with the specification passing through the end portion of the above-mentioned hub 253, obviously the latter has less fluctuation at the position where the wire discharged from the curl arm 238 reaches.

The reinforcing bar binding machine 210 according to this example is characterized by utilizing these properties, and the position of the curl arm 238 and the position of the wire reel 252 (the hub 253 on which the wire is wound) are suitably arranged, whereby the variation of the distal end of the wire discharged from the curl arm 238 is converged within a certain range.

Figure 36A:
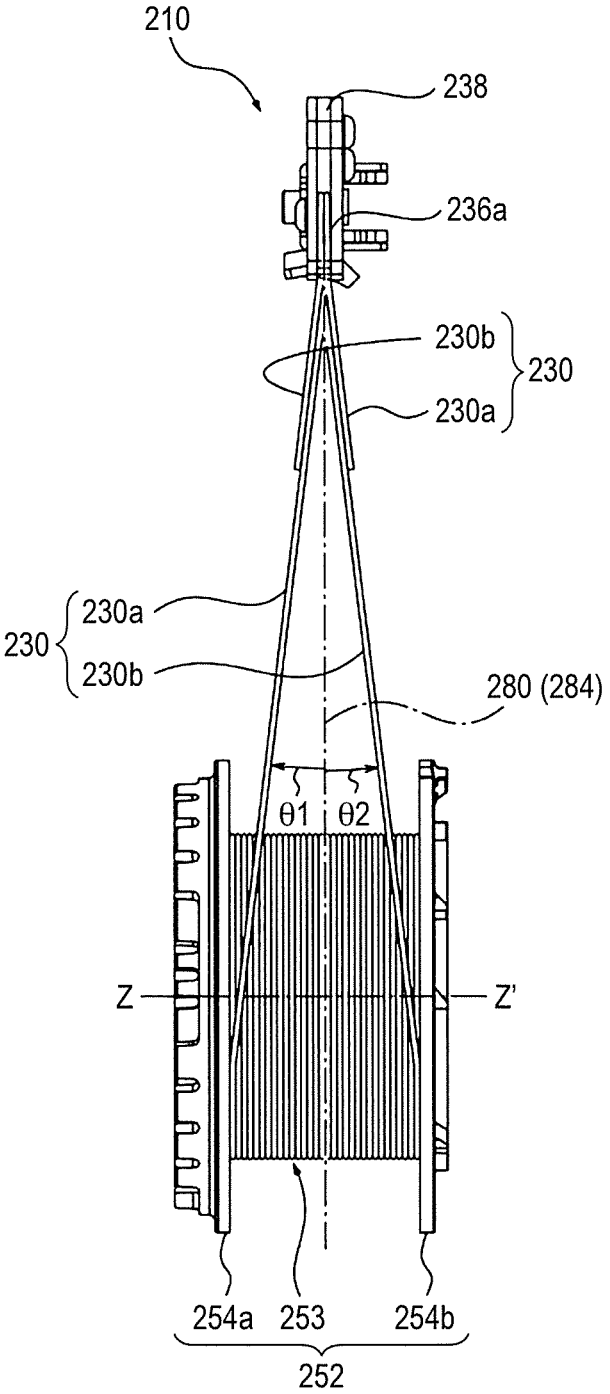
FIG. 36A is a view illustrating the positional relationship between a wire reel and a curl guide in a reinforcing bar binding machine of a comparative example.
Figure 36B:
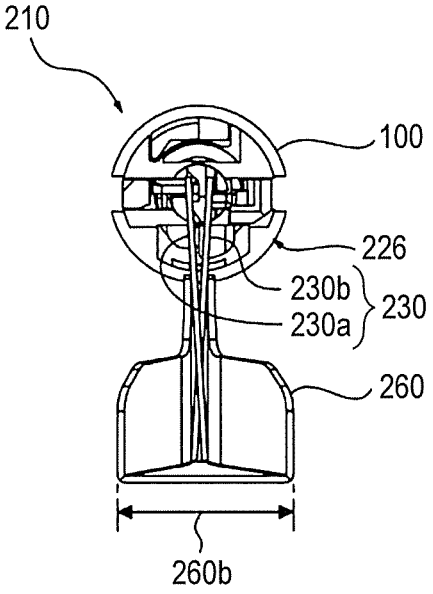
FIG. 36B is a view illustrating the positional relationship between a distal end axis of a twisting hook and the curl guide of the reinforcing bar binding machine of the comparative example.

FIGS. 36A and 36B are views illustrating the positional relationship between the wire reel 252, the curl arm 238 and the curl guide 260 of the reinforcing bar binding machine 210 in the comparative example. Further, FIGS. 36A and 36B are drawn so as to correspond to FIGS. 34A and 34B, respectively. In the reinforcing bar binding machine 210 illustrated in FIG. 36A, it is arranged so that the position where the virtual plane 280 coincides with the center position of the hub 253 of the wire reel 252, that is, the distance between the virtual plane 280 and the virtual cutting surface 284 is 0.

Even in the reinforcing bar binding machine 210 illustrated in FIG. 36A, as described in the explanation of FIG. 34A, the two wires 230*a* and 230*b* are scattered by repeatedly feeding out and pulling back the wires 230 (230*a* and 230*b*). Thus, it is fed out from a different position on the wire reel 252. That is, when there is a wire 230*a* entering from one side of the virtual plane 280 with an angle θ1 and a wire 230*b* entering from the other side of the virtual plane 280 on the opposite side with an angle θ2, each wire has a virtual plane 280 on the different side.

Therefore, in the case of this comparative example, the spreading amount (width 260*b*) of the distal end of the curl guide 260 illustrated in FIG. 36B is increased, so that the distal end of the wire 230 (230*a* and 230*b*) swung to the different side can be reliably picked up.

Modified Example of Example 2

Figure 37:
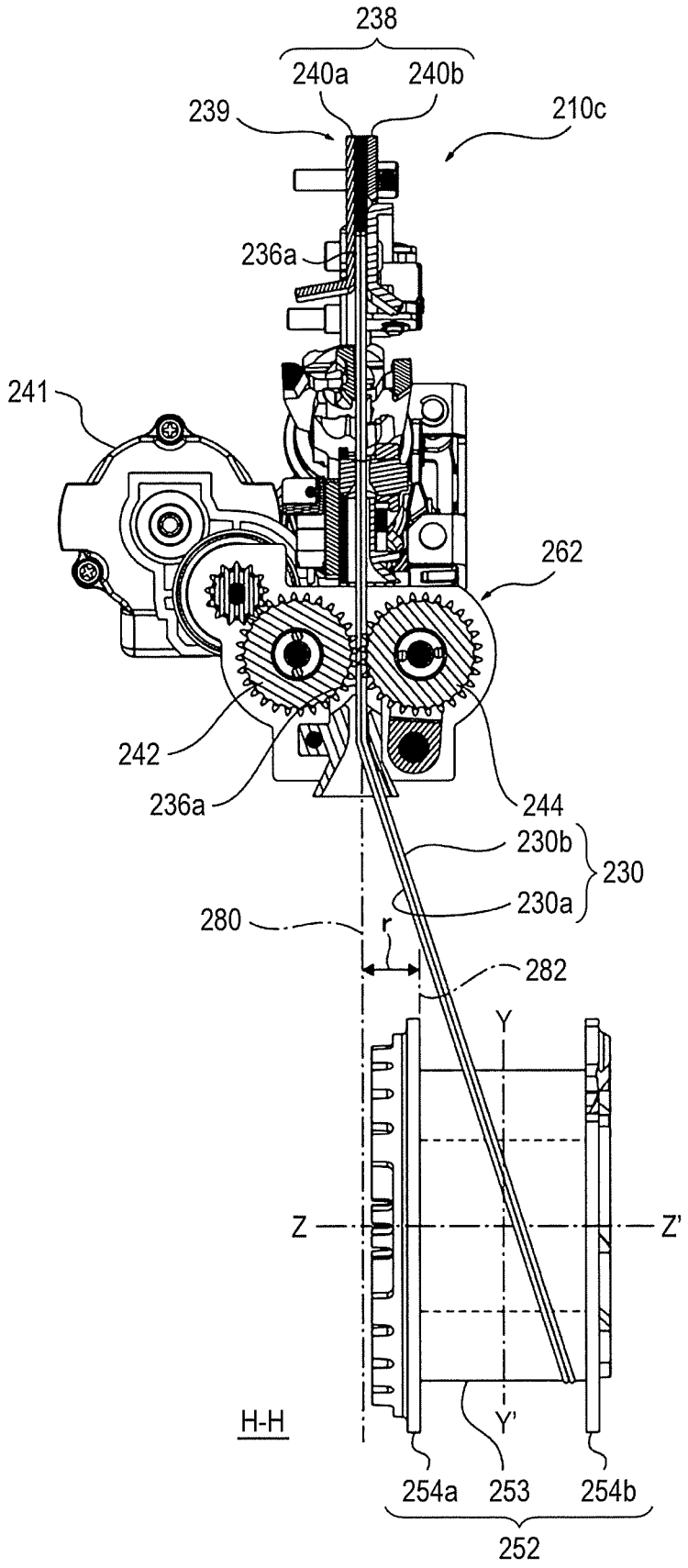
FIG. 37 is a view illustrating a configuration of a modified example of Example 1.
Figure 38A:
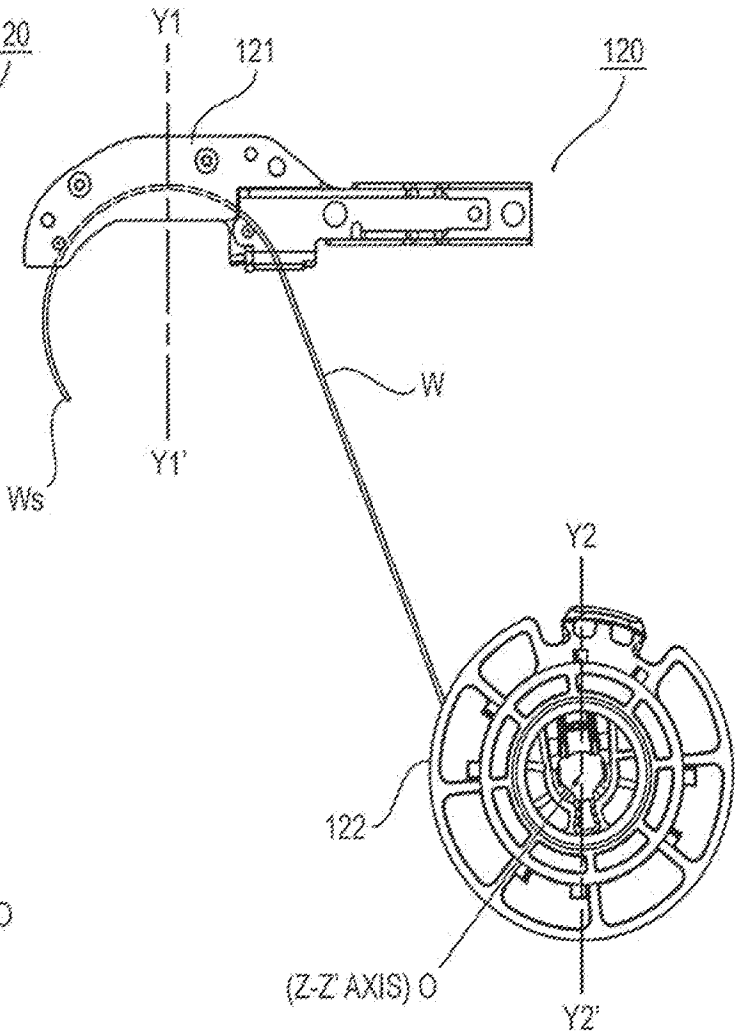
FIG. 38A (PRIOR ART)
FIG. 38A is a view illustrating the relationship between a curl arm and a wire reel in a conventional binding machine, and illustrates a state in which the relationship between the curl arm and the wire reel is viewed from a side.
Figure 38B:
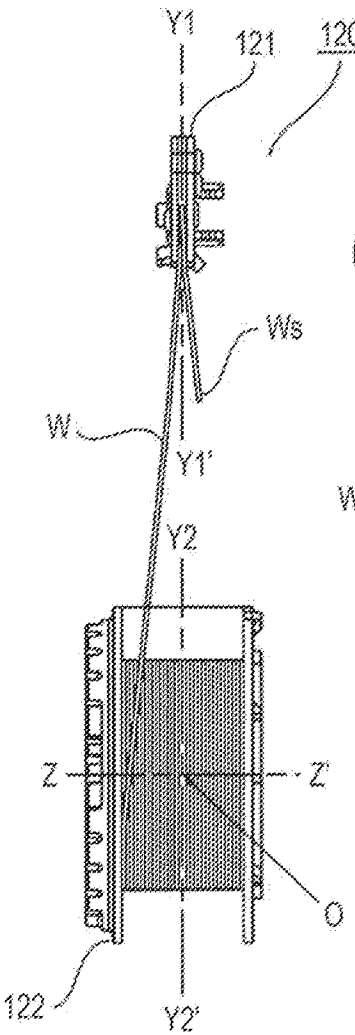
FIG. 38B (PRIOR ART)
FIG. 38B is a view illustrating a relationship between a curl arm and a wire reel in a conventional binding machine, and is a view illustrating the front view of the relationship between the curl arm and the wire reel illustrated in FIG. 38A, and further is a view illustrating the case where the feeding unit of the wire is biased more in the Z direction than the winding center O of the wire reel.
Figure 38C:
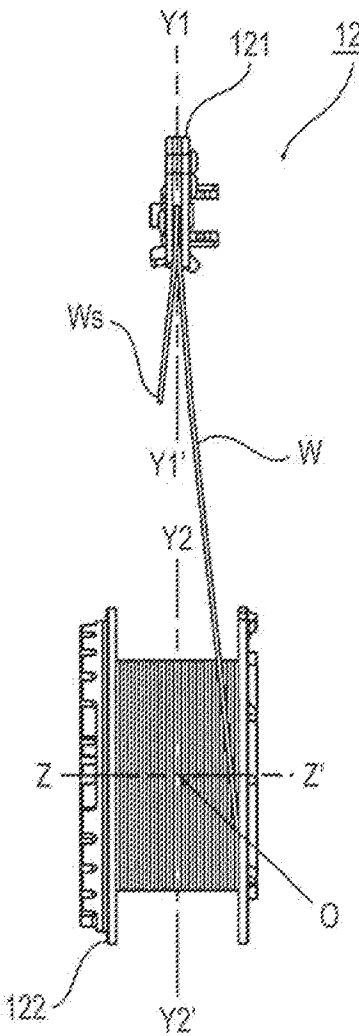
FIG. 38C (PRIOR ART)
FIG. 38C is a view illustrating a relationship between a curl arm and a wire reel in a conventional binding machine, and is a view illustrating the front view of the relationship between the curl arm and the wire reel illustrated in FIG. 38A, and further is a view illustrating the case where the feeding unit of the wire is biased more in the Z' direction than the winding center O of the wire reel.

Next, a modified example of Example 2 will be described with reference to FIG. 37. FIG. 37 is a view corresponding to the above-described FIG. 32, illustrating the internal configuration of the main part of the reinforcing bar binding machine 210*c* (binding machine) which is a modified example of Example 2. In the reinforcing bar binding machine 210*c* (binding machine) illustrated in FIG. 27, the virtual plane 280 is disposed at a position offset in the inner surface of the hub 235 by the further distance r from a virtual cutting surface 282 (the inner surface of the first flange portion 254*a*) when the axial end of the hub is cut in a direction substantially orthogonal to the axial center of the hub 1.

Therefore, similarly to the configuration of FIG. 34A, the wire 230 (230*a* and 230*b*) always enters the wire feeding unit 262 from the same side with respect to the virtual plane 280. For this reason, the distal ends of the wires 230 (230*a* and 230*b*) that have passed through the curl arm 238 are always fed to the virtual plane 280 while being swung to the same side at all times.

Figure 34B:
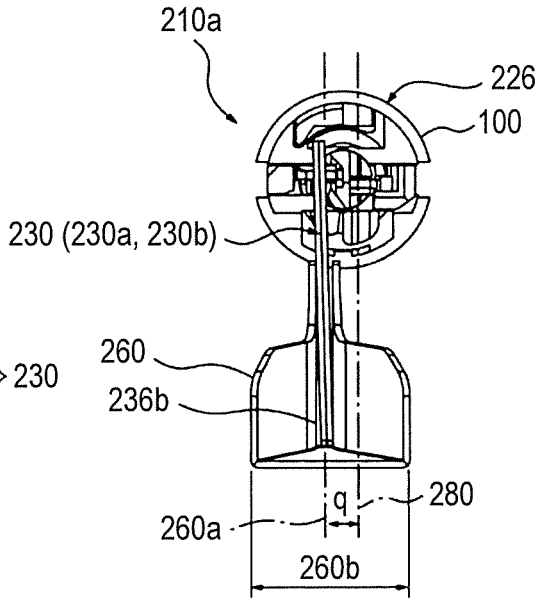
FIG. 34B is a view illustrating the positional relationship between the distal end axis of the twisting hook and the curl guide of the reinforcing bar binding machine according to Example 2.

Therefore, similarly to the case illustrated in FIG. 34B, the curl guide 260 (not illustrated) is offset and arranged in the direction opposite to the offset direction of the wire reel 252 with respect to the curl arm 238. Thereby, it is possible to surely pick up the distal end of the wire 230 (230*a* and 230*b*) fed while swinging to the same side, thereby achieving the same effect as that of Example 2.

Next, a specific third embodiment of the binding machine according to the present invention will be described with reference to the drawings.

Example 3

The reinforcing bar binding machine 210*b* (binding machine) illustrated in Example 3 has substantially the same structure as the reinforcing bar binding machine 210*a* illustrated in Example 2, and only the offset position of the wire reel 252 with respect to the virtual plane 280 is different. Hereinafter, the operation of the reinforcing bar binding machine 210*b* in Example 3 will be described.

Figure 35A:
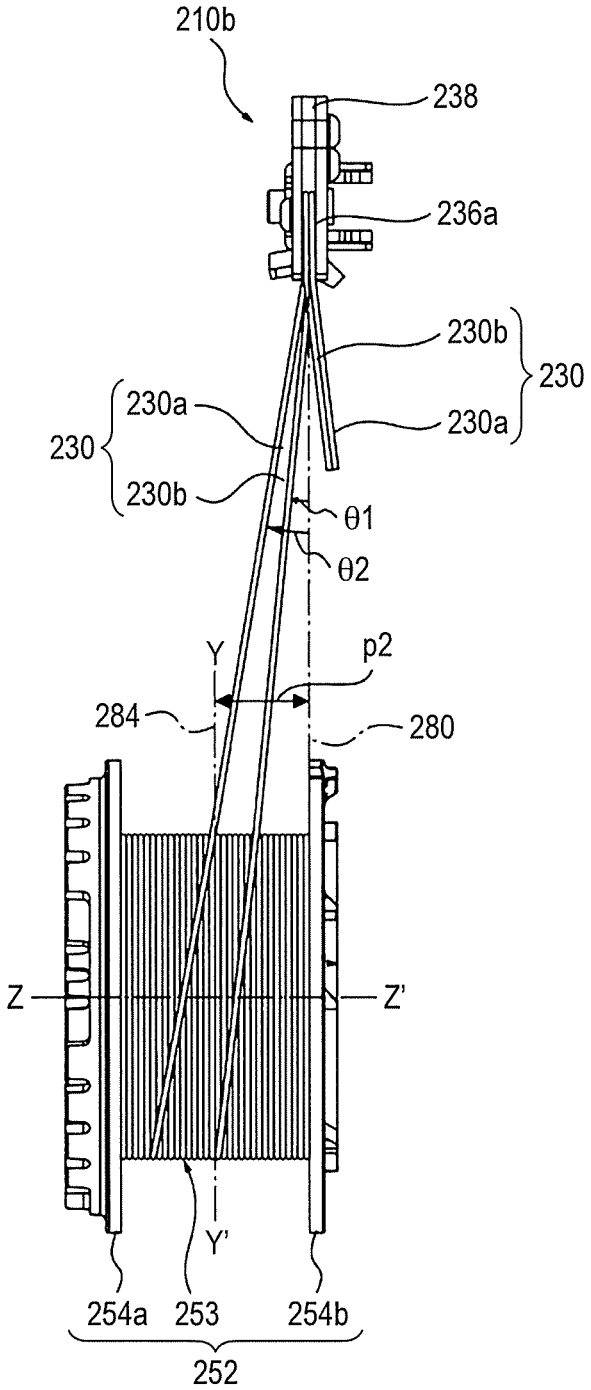
FIG. 35A is a view illustrating the positional relationship between a wire reel and a curl guide of the reinforcing bar binding machine according to Example 3.
Figure 35B:
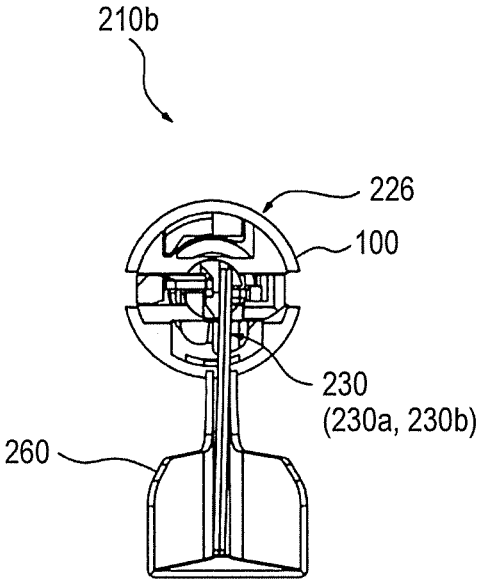
FIG. 35B is a view illustrating the positional relationship between a distal end axis of a twisting hook and the curl guide of the reinforcing bar binding machine according to Example 3.

FIGS. 35A and 35B are views illustrating the positional relationship between the wire reel 252, the curl arm 238 and the curl guide 260 of the reinforcing bar binding machine

210*b* in Example 3. In addition, FIGS. 35A and 35B are drawn so as to correspond to FIGS. 34A and 34B, respectively.

As illustrated in FIG. 35A, in the reinforcing bar binding machine 210*b*, the virtual plane 280 is installed at a position overlapping the axial end of the hub which is at the same position as the inside surface of the second flange portion 254*b*. That is, the virtual cutting surface 284 (the plane including the line Y-Y'), which is the center position of the hub 253 of the wire reel 252, is arranged at positions offset in the Z direction at the axial center (line Z-Z') of the wire reel 252 with respect to the virtual plane 280. The offset amount corresponds to the distance p <b> 2 with respect to the virtual cutting surface 284.

Further, as illustrated in FIG. 35B, the curl guide 260 is offset and disposed at the center position of the distal end shaft 100 of the twisting hook 226, that is, in the direction opposite to the offset direction of the wire reel 252 with respect to the curl arm 238 illustrated in FIG. 35A.

That is, referring to FIG. 35A, both the angle θ1 formed by the wire 230*a* fed out from the wire reel 252 and the angle θ2 in which the wire 230*a* forms the virtual plane 280 are negative. Therefore, similarly to the reinforcing bar binding machine 210*a* described in Example 2, when the wires 230 (230*a*, 230*b*) are fed into the curl arm 238, curls in the same direction are given to the virtual plane 280. Accordingly, the wire 230 (230*a*, 230*b*) is fed from the curl arm 238 in a state of swinging to the same side. Therefore, the curl guide 260 can reliably pick up the distal ends of the wires 230 (230*a*, 230*b*).

As described above, according to the reinforcing bar binding machine 210*a* (binding machine) of Example 2 and the reinforcing bar binding machine 210*b* (binding machine) of Example 3 which are configured as described above, a virtual plane 280 formed by a circular arc where the plastically deformed wire 230 is formed in the curl arm 238, is disposed at a position offset from the virtual cutting surface 284 when the center O of the core of the wire reel 252 is cut in a direction substantially orthogonal to the axial center (line Z-Z') of the hub 253, and thus the direction of the spatial variation of the distal end of the wire 230 curled in the curl arm 238 can be kept within a certain range with respect to the direction orthogonal to the virtual plane 280. Therefore, it is possible to downsize the curl guide 260 which picks up the distal end portion of the curled wire 230, thereby making it possible to downsize the reinforcing bar binding machine 210*a*, 210*b* (binding machine).

In addition, according to the reinforcing bar binding machine 210*a* (binding machine) of Example 2 and the reinforcing bar binding machine 210*b* (binding machine) of Example 3, since the virtual plane 280 is arranged to be substantially the same as the virtual cut plane 282 when the axial end of the hub 253 is cut in the direction substantially orthogonal to the axial center (line Z-Z') of the hub 253, the direction of the spatial variation the distal ends of the curled wire 230 curled by the curved arm 238, with respect to the direction orthogonal to the virtual plane 280, can be kept within a still narrower range. Therefore, it is possible to further downsize the curl guide 260 for picking up the distal end portion of the curled wire 230.

In addition, according to the reinforcing bar binding machine 210*a* (binding machine) of Example 2 and the reinforcing bar binding machine 210*b* (binding machine) of Example 3, since a plurality of wires 230*a* and 230*b* are formed as one set and fed almost simultaneously, the spatial variation direction of the distal ends of the wires 230*a* and 230*b* in the direction orthogonal to the virtual plane 280 can be aligned and the variation can be kept within a narrow range. Therefore, it is unnecessary to design the curl guide 260 to have a wider range than necessary, so that it is possible to downsize the reinforcing bar binding machine 210*a* or 210*b* (binding machine). Furthermore, since it is unnecessary to use a thick wire, the load of the twisting motor 228 necessary for cutting the wires 230*a* and 230*b* can be kept low, and the downsizing of the reinforcing bar binding machines 210*a* and 210*b* (binder) and power saving can be obtained.

Further, in Examples 2 and 3, it is described that the wire reel 252 is provided on the lower side of the binding machine main body 220, but the same operation and effect can be obtained even with a configuration in which the wire reel 252 is provided on the rear side of the binding machine main body 220.

Further, in Examples 2 and 3, the wire 230 (230*a*, 230*b*) is fed by one wire feeding unit 262 so that an arcuate winding curl is formed by one curling arm 238, but this portion may be configured so that the wires 230*a* and 230*b* are respectively fed by different wire feeding units, and even if the wires 230*a* and 230*b* are wound with different curling arms, the same operation and effect can be obtained.

Furthermore, in Examples 2 and 3, the wire 230 (230*a*, 230*b*) is simultaneously (together) fed in a pair of two to bind the reinforcing bars 222 (the body to be bound), but even if the wires 230 are configured so as to be fed one by one, the same operation and effect can be obtained.

In addition, in Example 2, the curl arm 238 is formed to have the first wall portion 240*a* and the second wall portion 240*b* as inner surfaces, respectively, but this can pass through the wire 230 (230*a*, 230*b*), and is not limited to the wall surface as long as the wire passage 236*a* for restricting the width direction of the wire 230 can be formed similarly to the wall surface. That is, instead of the wall portion, for example, it may be a wire passage having a plurality of discretely arranged rollers as side faces.

Although examples of the present invention have been described in detail with reference to the drawings, these are only examples of the present invention, and the present invention is not limited only to the configuration of the examples. Even if there are design changes or the like within the scope not deviating from the gist of the invention, it is naturally included in the present invention.

Some or all of the above embodiments can be described as follows.

(Additional Note 1)

A binding machine comprising:

a feeding unit that draws out and feeds a wire from a reel provided with a housing (magazine); and a first restriction portion that is provided in the housing and that restricts a wire drawing portion located between the reel and the feeding unit from deviating from an entering route of the wire when the wire fed from the reel by the feeding unit is guided to the feeding unit.

(Additional Note 2)

The binding machine according to (1), wherein the feeding unit is capable of pulling back the fed wire to the reel side, and the binding machine includes a second restriction portion that is provided in the housing and that restricts the wire pulled back to the reel side by the feeding unit from being deviating from a line extending in a pullback direction of the wire.

(Additional Note 3)

The binding machine according to (1) or (2), wherein the first restriction portion or the second restriction portion is at least a part of a front wall of the housing including a surface to face the wire fed from the reel.

(Additional Note 4)

The binding machine according to (1) or (2), wherein the first restriction portion or the second restriction portion is an abutting member protruding from a front wall of the housing including a surface to face the wire fed from the reel.

(Additional Note 5)

The binding machine according to (3) or (4), wherein the first restriction portion or the second restriction portion is partially made of metal.

(Additional Note 6)

The binding machine according to (3) or (4), wherein the first restriction portion or the second restriction portion is entirely made of metal.

(Additional Note 7)

The binding machine according to any one of (4) to (6), wherein the abutting member is a movable member which is capable of moving a contact portion with the wire.

(Additional Note 8)

The binding machine according to (7), wherein the movable member is a roller.

(Additional Note 9)

The binding machine according to any one of (1) to (8), further comprising a third restriction portion that restricts movement of the wire on a rear side of the entering route of the wire or a rear side of a line extending in the pullback direction.

(Additional Note 10)

The binding machine according to (9), wherein the third restriction portion is a protrusion protruding from a sidewall of the housing.

(1)

A binding machine comprising: a feeding unit that feeds a wire from a reel provided with a housing, characterized in that, with respect to an entering route of the wire when the wire fed from the reel by the feeding unit is guided to the feeding unit, a first restriction unit is provided inside the housing to restrict a drawn out portion of the wire from deviating from the entering route, the drawn out portion being between the reel and the feeding unit.

(2)

A binding machine comprising: a feeding unit that feeds a wire from a reel provided with a housing, and that pulls back the fed wire to a reel side, characterized in that, a second restriction unit is provided inside the housing to restrict the wire pulled back to the reel side by the feeding unit from deviating from a line extending in a pullback direction of the wire by the feeding unit.

(3-1)

The binding machine according to (1), characterized in that a front wall of the housing is located at a position which forms the first restriction unit, the front wall including a surface to face the wire fed out from the reel.

(3-2)

The binding machine according to (2), characterized in that a front wall of the housing is located at a position which forms the second restriction unit, the front wall including a surface to face the wire fed out from the reel.

(4)

The binding machine according to (3-1) or (3-2), characterized in that an abrasion prevention unit is provided on the front wall of the housing to prevent abrasion of the front wall due to contact of the wire.

(5)

The binding machine according to (4), characterized in that the abrasion prevention unit is a metal material configuring at least a part of the housing.

(6)

The binding machine according to (4), characterized in that the abrasion prevention unit is a metal material configuring the entire housing.

(7)

The binding machine according to (4), characterized in that the abrasion prevention unit is a metal plate provided so as to cover at least a part of the front wall.

(8)

The binding machine according to (4), characterized in that the abrasion prevention unit is a metal material provided so as to protrude toward an inside of the housing.

(9)

The binding machine according to (1), characterized in that the first restriction unit is a single or a plurality of abutting members which is capable of abutting against a drawn portion of the wire.

(10)

The binding machine according to (2), characterized in that the second restriction unit is a single or a plurality of abutting members which is capable of abutting against the pullback wire located between the reel and the feeding unit.

(11)

The binding machine according to (9) or (10), characterized in that the abutting member is a movable member which is capable of moving a contact portion with the wire.

(12)

The binding machine according to (11), characterized in that the movable member is a roller.

(13)

The binding machine according to (9) or (10), characterized in that the abutting member is a convex member provided so as to protrude toward an inside of the housing.

(14)

The binding machine according to any one of (8) to (13), characterized in that a feeding direction or a pulling back direction of the wire by the feeding unit is directed in a direction of a tangent to a virtual circle located at the maximum diameter portion of the reel or in the vicinity thereof, and at least one of the abutting bodies is located at or in the vicinity of a contact point between the tangent and the virtual circle.

(15)

The binding machine according to any one of (1) to (14), characterized in that a third restriction unit that restricts the wire provided on the rear side of the entering route of the wire when the wire drawn out from the reel in the housing is guided to the feeding unit.

(16)

The binding machine according to (15), characterized in that the third restriction unit is a pressing rib protruding from a side wall of the housing.

(17)

A binding machine comprising: a wire feeding unit that is capable of feeding a wire from a reel which has a tubular hub to wind a wire and which is rotatably supported on a main body of the binding machine; and a curl arm that plastically deforms the wire fed out from the wire feeding unit to form a circle locus, wherein the binding machine twists the wire to bind a binding object after winding the wire which is plastically deformed by the curl arm, around the binding object, characterized in that a virtual plane is located at a position offset with respect to a virtual cross section, the virtual plane is formed by the circle of the plastically deformed wire inside the curl arm and the virtual cross section is formed by cutting through a center point of the hub in a direction substantially orthogonal to an axial center of the hub.

(18)

The binding machine according to (17), characterized in that the virtual plane is provided substantially the same as a virtual cross section formed by cutting through an axial end portion of the hub in the direction substantially orthogonal to the axial center of the hub.

(19)

The binding machine according to (17) or (18), characterized in that the wire is a set of a plurality of wires and is fed out substantially concurrently.

This application is based upon Japanese Patent Application Nos. 2015-145261 and 2015-145262 filed on Jul. 22, 2015, and Japanese Patent Application No. 2016-135747 filed on Jul. 8, 2016, the contents of which are hereby incorporated by reference.

REFERENCE SIGNS LIST

1: object
2: binding machine
3: wire
3*a*: drawing portion
4: wheels
11: housing unit
12: reels
16: feeding unit (feeding portion)
26: curve forming portion
35: twisting unit
81: entering route
83: first restriction unit (first restriction portion)
85: pullback direction
86: lines
87: second restriction unit (second restriction portion)
88: feeding direction
91: protective case
91: front wall
92: wear prevention unit
94: abutting member (pin)
94A: abutting member (movable member, roller)
95: virtual circle
96: third restriction unit (third restriction portion)
210, 210*a*, 210*b*: reinforcing bar binding machine (binding machine)
220: binding machine main body
222: reinforcement member (body to be bound)
230, 230*a*, 230*b*: wire
238: curling arm
239: curve forming part
252: wire reel
253: hub
254*a*: first flange (flange portion)
254*b*: second flange part (flange part)
260: curl guide
262: wire feeding unit
280: virtual plane
282, 284: virtual cutting plane

The invention claimed is:

1. A binding machine comprising:

a housing that houses a reel on which a wire is wound; and a feeding unit that feeds the wire from the reel provided in the housing and pulls back a fed wire in a pullback direction toward the reel, wherein the housing includes:

a first restriction unit which abuts a drawn out portion of the wire between the reel and the feeding unit and which restricts the drawn out portion of the wire from deviating from an entering route;

a second restriction unit that restricts the wire pulled back toward the reel by the feeding unit from deviating from a line extending in the pullback direction of the wire; and a front wall which faces the reel, which provides a surface facing the wire fed out from the reel and which is located in a radial direction of the reel;

the second restriction unit includes at least one abutting member which is arranged to abut against the wire pulled back to the reel deviating from the line in the pullback direction, and wherein the at least one abutting member protrudes inward with respect to the front wall of the housing in a direction toward the line extending in the pullback direction, wherein the pullback direction of the wire toward the reel is directed in a direction of a tangent to a virtual circle located at the maximum diameter portion of the reel or in the vicinity thereof, and the at least one abutting member of the second restriction unit is located at or in the vicinity of a contact point between the tangent and the virtual circle; and the entering route is a route of the wire in a case where the wire fed from the reel by the feeding unit is guided to the feeding unit.

2. The binding machine according to claim 1, wherein the first restriction unit is at least a part of the front wall of the housing.

3. The binding machine according to claim 2, wherein the first restriction unit is at least partially made of metal.

4. The binding machine according to claim 2, wherein the first restriction unit includes an abrasion prevention unit which prevents abrasion of the front wall due to contact of the wire.

5. The binding machine according to claim 4, wherein the abrasion prevention unit is at least partially made of metal.

6. The binding machine according to claim 5, wherein the abrasion prevention unit a metal plate provided so as to cover at least a part of the front wall.

7. The binding machine according to claim 4, wherein the abrasion prevention unit is a metal material provided so as to protrude toward an inside of the housing.

8. The binding machine according to claim 1, wherein the first restriction unit includes at least one first restriction abutting member which is capable of abutting against the wire fed out from the reel.

9. The binding machine according to claim 8, wherein the at least one first restriction abutting member protrudes inward with respect to the front wall of the housing.

10. The binding machine according to claim 8, wherein the at least one first restriction abutting member includes a movable member which is movable relative to the housing such that a contact portion at which the wire contacts the movable member changes.

11. The binding machine according to claim 10, wherein the movable member is a roller.

12. The binding machine according to claim 1, wherein the second restriction unit is partially made of metal.

13. The binding machine according to claim 1, wherein the at least one abutting member of the second restriction unit is a movable member, and the movable member includes a contact portion with the wire, and the contact portion is movable.

14. The binding machine according to claim 1, further comprising: a third restriction unit that restricts movement of the wire on a rear side of the entering route of the wire.

15. The binding machine according to claim 14, wherein the third restriction unit is a protrusion protruding from a sidewall of the housing.

* * * * *